US011020981B2

(12) United States Patent
Yamashita

(10) Patent No.: US 11,020,981 B2
(45) Date of Patent: Jun. 1, 2021

(54) LIQUID EJECTION DEVICE

(71) Applicant: KYOCERA Document Solutions Inc., Osaka (JP)

(72) Inventor: Hiroshi Yamashita, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/814,399

(22) Filed: Mar. 10, 2020

(65) Prior Publication Data

US 2020/0307242 A1 Oct. 1, 2020

(30) Foreign Application Priority Data

Mar. 25, 2019 (JP) ..... JP2019-056671

(51) Int. Cl.
*B41J 2/175* (2006.01)
*B41J 2/14* (2006.01)
*B41J 2/18* (2006.01)

(52) U.S. Cl.
CPC ..... *B41J 2/17596* (2013.01); *B41J 2/14* (2013.01); *B41J 2/17513* (2013.01); *B41J 2/17523* (2013.01); *B41J 2/17556* (2013.01); *B41J 2/18* (2013.01)

(58) Field of Classification Search
CPC . B41J 2/14; B41J 2/175; B41J 2/17513; B41J 2/17523; B41J 2/17556; B41J 2/17596; B41J 2/18
See application file for complete search history.

(56) References Cited

U.S. PATENT DOCUMENTS 5,231,424 A * 7/1993 Kaneko ..... B41J 2/16508 347/29
7,661,798 B2 * 2/2010 Mukai ..... B41J 2/175 347/56
7,950,786 B2 * 5/2011 Cheng ..... B41J 2/175 347/85
8,616,689 B2 * 12/2013 von Essen ..... B41J 2/175 347/89
8,974,018 B2 * 3/2015 Iwata ..... B41J 29/38 347/6
2005/0073559 A1 4/2005 Aruga et al.
(Continued)

FOREIGN PATENT DOCUMENTS

WO 03/041964 5/2003

*Primary Examiner* — Anh T Vo
(74) *Attorney, Agent, or Firm* — Gerald E. Hespos; Michael J. Porco; Matthew T. Hespos

(57) ABSTRACT

A liquid ejection device includes a liquid supply unit configured to supply liquid to a liquid ejection head, a first supply passage, a second supply passage, a return pipe and a short-circuit pipe serving as a liquid flow passage, and a pump mechanism. A controller executes an ejection control for supplying the liquid from a pressure chamber to the liquid ejection head by opening first and second valve bodies and closing third and fourth valve bodies, a first circulation control for circulating the liquid through the liquid ejection head by closing the first and fourth valve bodies, opening the second and third valve bodies and operating the pump mechanism, and a second circulation control for circulating the liquid through the short-circuit pipe by closing the second valve body while opening the first, third and fourth valve bodies and operating the pump mechanism with an air vent mechanism released.

7 Claims, 28 Drawing Sheets

(56) References Cited

U.S. PATENT DOCUMENTS

| | | | | |
|---|---|---|---|---|
| 2007/0115333 | A1 | 5/2007 | Aruga et al. | |
| 2010/0079562 | A1* | 4/2010 | Katada | B41J 2/175<br>347/85 |
| 2010/0271447 | A1 | 10/2010 | Aruga et al. | |
| 2012/0212549 | A1 | 8/2012 | Aruga et al. | |
| 2013/0235127 | A1 | 9/2013 | Aruga et al. | |
| 2013/0265372 | A1 | 10/2013 | Aruga et al. | |
| 2014/0210909 | A1 | 7/2014 | Aruga et al. | |
| 2015/0022596 | A1 | 1/2015 | Aruga et al. | |
| 2015/0165784 | A1* | 6/2015 | Tanaka | B41J 2/155<br>347/92 |
| 2016/0009101 | A1 | 1/2016 | Aruga et al. | |
| 2016/0121616 | A1 | 5/2016 | Aruga et al. | |
| 2017/0157946 | A1 | 6/2017 | Aruga et al. | |
| 2017/0341409 | A1 | 11/2017 | Aruga et al. | |
| 2018/0257385 | A1 | 9/2018 | Aruga et al. | |
| 2019/0224983 | A1 | 7/2019 | Aruga et al. | |

* cited by examiner 43
43A
43B
43C
441
419
43S
41
661
66
6
61
67
g
62
62A
63
42
45
UP
DOWN
LEFT
RIGHT

LIQUID EJECTION DEVICE

INCORPORATION BY REFERENCE

This application is based on Japanese Patent Application No. 2019-56671 filed with the Japan Patent Office on Mar. 25, 2019, the contents of which are hereby incorporated by reference.

BACKGROUND

Field of the Invention

The present disclosure relates to a liquid ejection device with a liquid ejection head and a liquid supply unit for supplying liquid stored in a liquid storage container to the liquid ejection head.

Related Art

For example, in an ink jet printer (liquid ejection device), a liquid ejection head for injecting a tiny amount of ink (liquid) to a print object is used. Ink is supplied to this liquid ejection head from an ink cartridge (liquid storage container) storing the ink through a predetermined supply passage. Conventionally, a liquid ejection device is known in which a liquid supply unit (valve unit) including a pressure chamber for setting a discharge hole of a liquid ejection head to a negative pressure is arranged in a supply passage in the case of supplying ink from an ink cartridge to the liquid ejection head by a water head difference. By disposing the liquid supply unit for generating the negative pressure, unlimited dripping of the ink from the discharge hole is suppressed even if the ink is supplied by the water head difference.

In the above liquid ejection device, the ink is supplied to the liquid ejection head via the pressure chamber for generating a negative pressure. Accordingly, a predetermined amount of the ink needs to be initially filled into the pressure chamber during initial usage, after maintenance and the like. At this time, it is necessary to vent air in the pressure chamber. Further, the ink stored in the pressure chamber may generate air bubbles by heating or the like associated with the operation of the liquid ejection device. Also in this case, air in the pressure chamber needs to be vented.

SUMMARY

A liquid ejection device according to one aspect of the present disclosure includes a liquid ejection head configured to inject liquid and a liquid supply unit configured to supply the liquid from a liquid storage container storing the liquid to the liquid ejection head.

The liquid ejection head includes a plurality of liquid discharge holes, individual passages configured to individually supply the liquid to the respective liquid discharge holes, and a common passage configured to supply the liquid to the individual passages. The liquid supply unit includes a pressure chamber capable of storing the liquid, an exhaust valve configured to release or close the pressure chamber to or from outside air, a liquid passage, valve bodies, a pump mechanism and a controller.

The liquid passage includes a first supply passage allowing communication between the liquid storage container and the pressure chamber, a second supply passage allowing communication between an upstream side of the common passage and the pressure chamber, a return passage allowing communication between a downstream side of the common passage and the pressure chamber, and a short-circuit passage configured to short-circuit the second supply passage and the return passage. One end of the short-circuit passage is connected to the return passage to form a first branch portion and the other end is connected to the second supply passage to form a second branch portion. The valve bodies include a first valve body configured to open and close the first supply passage, a second valve body configured to open and close the second supply passage on a side closer to the common passage than the second branch portion, a third valve body configured to open and close the return passage on a side closer to the pressure chamber than the first branch portion and a fourth valve body configured to open and close the short-circuit passage. The pump mechanism is capable of feeding the liquid to the second supply passage. The controller controls operations of the valve bodies and the pump mechanism.

The controller executes an ejection control, a first circulation control and a second circulation control. The ejection control is a control for supplying the liquid from the pressure chamber to the liquid ejection head through the second supply passage by closing the third and fourth valve bodies while opening the first and second valve bodies, and setting the pump mechanism in a non-operative state with the exhaust valve closed. The first circulation control is a control for circulating the liquid through the second supply passage, the common passage and the return passage by opening the second and third valve bodies while closing the first and fourth valve bodies, and operating the pump mechanism with the exhaust valve closed. The second circulation control is a control for circulating the liquid through the second supply passage, the short-circuit passage and the return passage by closing the second valve body while opening the first, third and fourth valve bodies, and operating the pump mechanism with the exhaust valve opened.

BRIEF DESCRIPTION OF THE DRAWINGS

FIGS. 2A and 2B are diagrams schematically showing a cross-section of the head unit in a front-rear direction, wherein FIG. 2A shows a state where ink is being discharged from a head unit and FIG. 2B shows a state where the ink is being circulated through the head unit, FIGS. 8A and 8B are perspective views of the liquid supply unit, wherein FIG. 8A is a perspective view viewed from the side of a first chamber and FIG. 8B is a perspective view viewed from the side of a second chamber.

DETAILED DESCRIPTION

Hereinafter, one embodiment of the present disclosure is described with reference to the drawings. A liquid ejection device according to the present disclosure can be applied to apparatuses for various uses. For example, the device according to the present disclosure can be applied to apparatuses for ejecting or spraying water, chemical, aqueous solution, fuel or the like. Above all, this device can be suitably applied to an ink jet printer. Thus, a liquid supply device for supplying ink to an ink ejection head of an ink jet type and a liquid ejection device using the same are illustrated in this embodiment.

[External Configuration of Liquid Ejection Device]

Figure 1:
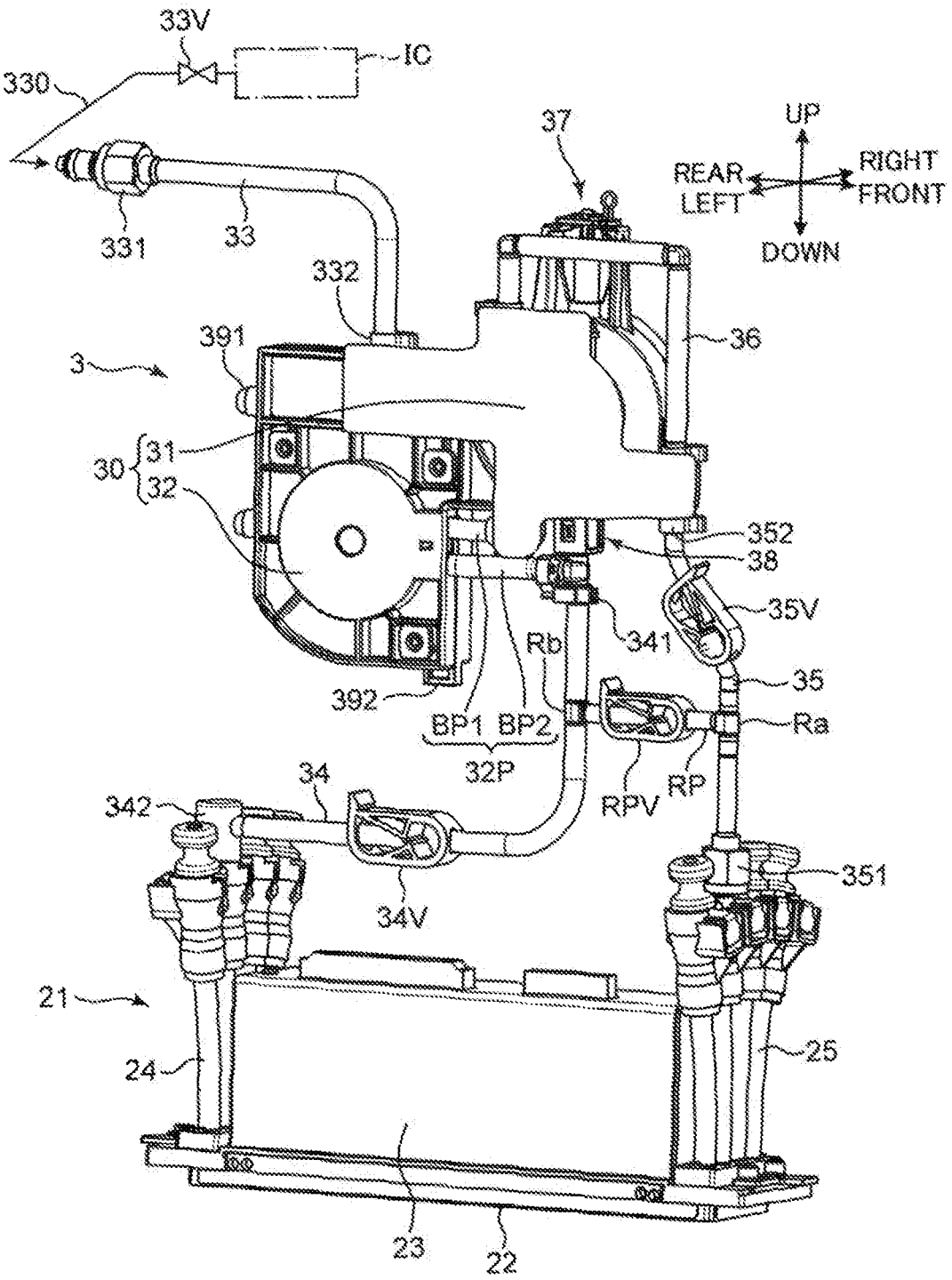
FIG. 1 is a perspective view showing an overall configuration of a liquid ejection device according to one embodiment of the present disclosure.

FIG. 1 is a perspective view showing an overall configuration of a liquid ejection device 1 according to a first embodiment of the present disclosure. The liquid ejection device 1 includes a head unit 21 (liquid ejection head) for ejecting ink (liquid) to various works such as paper sheets and resin sheets of various sizes and cloth fabric, and liquid supply units 3 each for supplying the ink from an ink cartridge IC storing the ink to the head unit 21. The head unit 21 and the liquid supply units 3 are mounted on an unillustrated carriage and move in a main scanning direction of the works. Four liquid supply units 3 are equipped for each head unit 21 to supply respective inks of cyan, magenta, yellow and black. In FIG. 1, out of four liquid supply units 3, only one is shown to simplify graphical representation.

The liquid supply unit 3 includes a body portion 30 with a tank portion 31 and a pump portion 32. Further, the liquid supply unit 3 includes an upstream pipe 33 (part of a first supply passage) arranged on an upstream side of the body portion 30 in an ink supply direction (liquid supply direction), a downstream pipe 34 (part of a second supply passage) arranged on a downstream side of the body portion 30, a return pipe 35 (return passage) serving as a path for returning the ink from the side of the head unit 21 to the side of the liquid supply unit 3, a short-circuit pipe RP (short-circuit passage) short-circuiting the downstream pipe 34 and the return pipe 35, a monitor pipe 36 and a bypass pipe 32P (bypass supply passage).

The tank portion 31 is a region forming a space for temporarily storing the ink to be supplied to the head unit 21 under a negative pressure environment. The pump portion 32 is a region for housing a pump 9 (pump mechanism; FIGS. 3 to 7 and 19) to be operated at the time of the discharge of a preservation solution filled in the head unit 21 during initial usage, a decompression process for forming the negative pressure environment, a pressurized purge process for cleaning the head unit 21 (ink ejecting portion 22), the circulation of the ink between the head unit 21 and the liquid supply unit 3 and the circulation of the ink in a short-circuit manner using the short-circuit pipe RP and the return pipe 35.

The upstream pipe 33 is a supply pipe allowing communication between the tank portion 31 (second chamber 42) and an ink cartridge IC (liquid storage container). An upstream end 331 of the upstream pipe 33 is connected to a terminal end part of a tube 330 (part of the first supply passage) extending from the ink cartridge IC, and a downstream end 332 is connected to an inlet part of the tank portion 31. A first valve body 33V functioning to open and close the upstream pipe 33 is mounted in the tube 330. If the first valve body 33V is opened, the ink can be supplied from the ink cartridge IC to the tank portion 31. If the first valve body 33V is closed, the supply cannot be made.

The downstream pipe 34 is a supply pipe allowing communication between the tank portion 31 (second chamber 42) and the head unit 21 (upstream side of a common passage 27 to be described later). An upstream end 341 of the downstream pipe 34 is connected to an outlet part of the tank portion 31 via a backflow prevention mechanism 38 to be described later and a downstream end 342 is connected to the head unit 21. A second valve body 34V for opening and closing the downstream pipe 34 is mounted in this downstream pipe 34.

The return pipe 35 is a pipe allowing communication between the head unit 21 (downstream side of the common passage 27 to be described later) and the tank portion 31 (second chamber 42). An upstream end 351 of the return pipe 35 is connected to the head unit 21, and a downstream end 352 is connected to the tank portion 31. A third valve body 35V for opening and closing the return pipe 35 is mounted in this return pipe 35.

The short-circuit pipe RP is a pipe short-circuiting the head unit 21 and the downstream pipe 34. The short-circuit pipe RP allows communication between a part of the downstream pipe 34 upstream of an arrangement position of the second valve body 34V and a part of the return pipe 35 upstream of (below) an arrangement position of the third valve body 35V. One end side of the short-circuit pipe RP is connected to the return pipe 35 to form a first T-branch portion Ra (first branch portion), and the other end side is connected to the downstream pipe 34 to form a second T-branch portion Rb (second branch portion). A fourth valve body RPV for opening and closing the short-circuit pipe RP is mounted in this short-circuit pipe RP. Note that the second valve body 34V is arranged in the downstream pipe 34 on a side closer to the head unit 21 (side of the common passage 27 to be described later) than the second T-branch portion Rb. Further, the third valve body 35V is arranged in the return pipe 35 on a side closer to the tank portion 31 (side of the second chamber 42) than the first T-branch portion Ra.

Further, the third valve body 35V may be arranged in the return pipe 35 on a side closer to the head unit 21 than the first T-branch portion Ra. A second embodiment having such an arrangement can be basically used similarly to the first embodiment. The embodiments are basically described for the first embodiment and the description of the embodiment is limited to the second embodiment for points of difference of the second embodiment from the first embodiment.

The monitor pipe 36 is a pipe for indicating an ink level in the tank portion 31. The bypass pipe 32P is a conduit for feeding the ink to the downstream pipe 34 without via the negative pressure environment (second chamber 42) of the tank portion 31. The bypass pipe 32P includes an upstream bypass pipe BP1 arranged upstream of the pump portion 32 and a downstream bypass pipe BP2 arranged downstream of the pump portion 32.

The head unit 21 includes the ink ejecting portion 22, a control unit 23, an end tube 24 and a recovery tube 25. The ink ejecting portion 22 is a nozzle part for discharging ink droplets toward a work W. A piezo method using a piezo element, a thermal method using a heating element or the like can be adopted as a method for discharging ink droplets in the ink ejecting portion 22. The control unit 23 includes a control board for controlling the piezo element or the heating element provided in the ink ejecting portion 22 and controls an operation of discharging ink droplets from the ink ejecting portion 22.

The end tube 24 is a tube linking the downstream end 342 of the downstream pipe 34 and the ink ejecting portion 22. The downstream end 342 is a cap-type socket and attachable to an upper end fitting part of the end tube 24 in a single operation. The recovery tube 25 is a tube linking the ink ejecting portion 22 and the upstream end 351 of the return pipe 35. Note that the recovery tube 25 is used also to discharge the preservation solution sealed in the liquid supply unit 3 during initial usage. Specifically, the recovery tube 25 constitutes a part of a return path for returning the ink from the side of the head unit 21 to the side of the liquid supply unit 3.

Figure 2A:
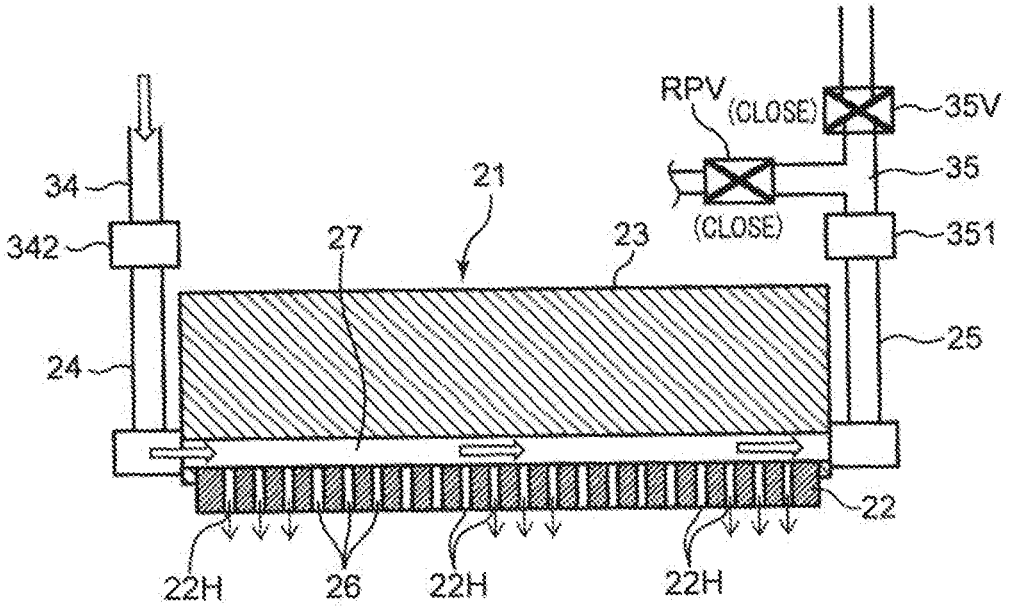
Figure 2B:
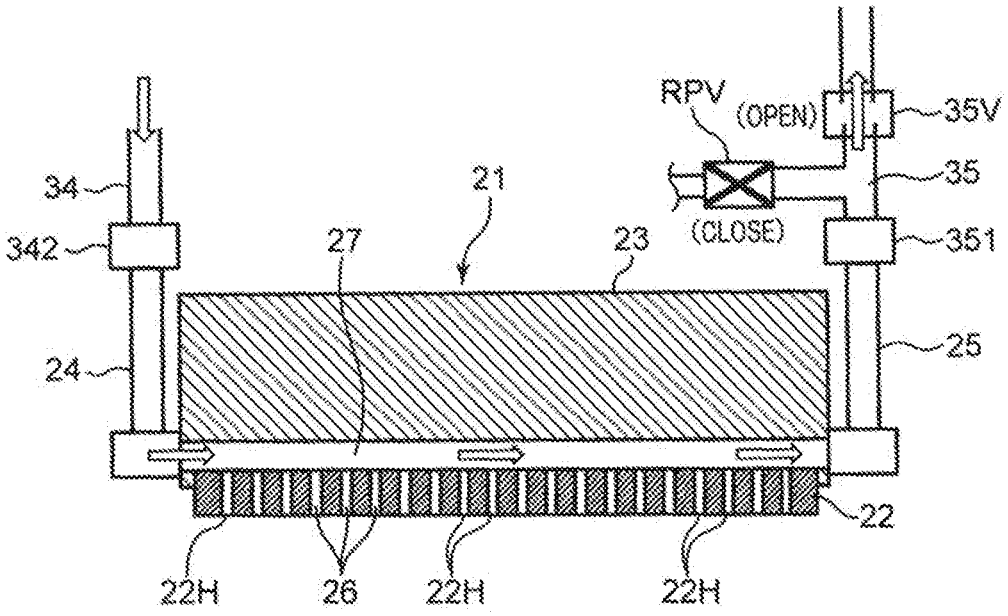

FIGS. 2A and 2B are views schematically showing a cross-section of the head unit 21 in a front-rear direction, wherein FIG. 2A shows a state where the third and fourth valve bodies 35V, RPV are closed (print mode to be described later) and FIG. 2B shows a state where the third valve body 35V is opened and the fourth valve body RPV is closed (first circulation mode). Note that the second valve body 34V is open in either state. The ink ejecting portion 22 includes a plurality of ink discharge holes 22H (liquid discharge holes) for discharging the ink toward the work W. Individual passages 26 for individually supplying the ink to the ink discharge holes 22H and the common passage 27 for supplying the ink to these individual passages 26 are provided inside the head unit 21. Note that the preservation solution for preventing air from being trapped in these passages is filled in the individual passages 26 and the common passage 27 before the head unit 21 is actually used.

The common passage 27 is an ink passage extending in a horizontal direction. An upstream end of each individual passage 26 communicates with the common passage 27. The downstream end 342 of the downstream pipe 34 communicates with an upstream side of the common passage 27 via the end tube 24. The upstream end 351 of the return pipe 35 communicates with a downstream side of the common passage 27 via the recovery tube 25. In other words, the upstream side and the downstream side of the common passage 27 communicate with the tank portion 31 (second chamber 42) respectively through the downstream pipe 34 and through the return pipe 35.

If the ink is supplied from the downstream pipe 34 to the head unit 21 with the return pipe 35 closed by the third valve body 35V as shown in FIG. 2A, the ink is ejected from the ink discharge holes 22H by way of the common passage 27 and the respective individual passages 26. On the other hand, if the ink is supplied from the downstream pipe 34 to the head unit 21 with the third valve body 35V released to open the return pipe 35 as shown in FIG. 2B, the ink returns to the tank portion 31 exclusively through the return pipe 35. In this case, if the return pipe 35 is set to a negative pressure, the ink does not leak from the ink discharge holes 22H.

[Summary of Liquid Supply System]

In this embodiment, the device is configured such that the ink cartridge IC is arranged above the head unit 21 and the ink is supplied to the head unit 21 by a water head difference. In the case of supplying the ink by the water head difference, the ink is constantly ejected from the ink ejecting portion 22 of the head unit 21 if the ink is supplied at normal pressure. Thus, it is necessary to dispose a negative pressure generating portion for generating a negative pressure environment in the ink supply passage and set the ink ejecting portion 22 to a suitable negative pressure. The tank portion 31 of the liquid supply unit 3 functions as the above negative pressure generating portion.

Figure 3:
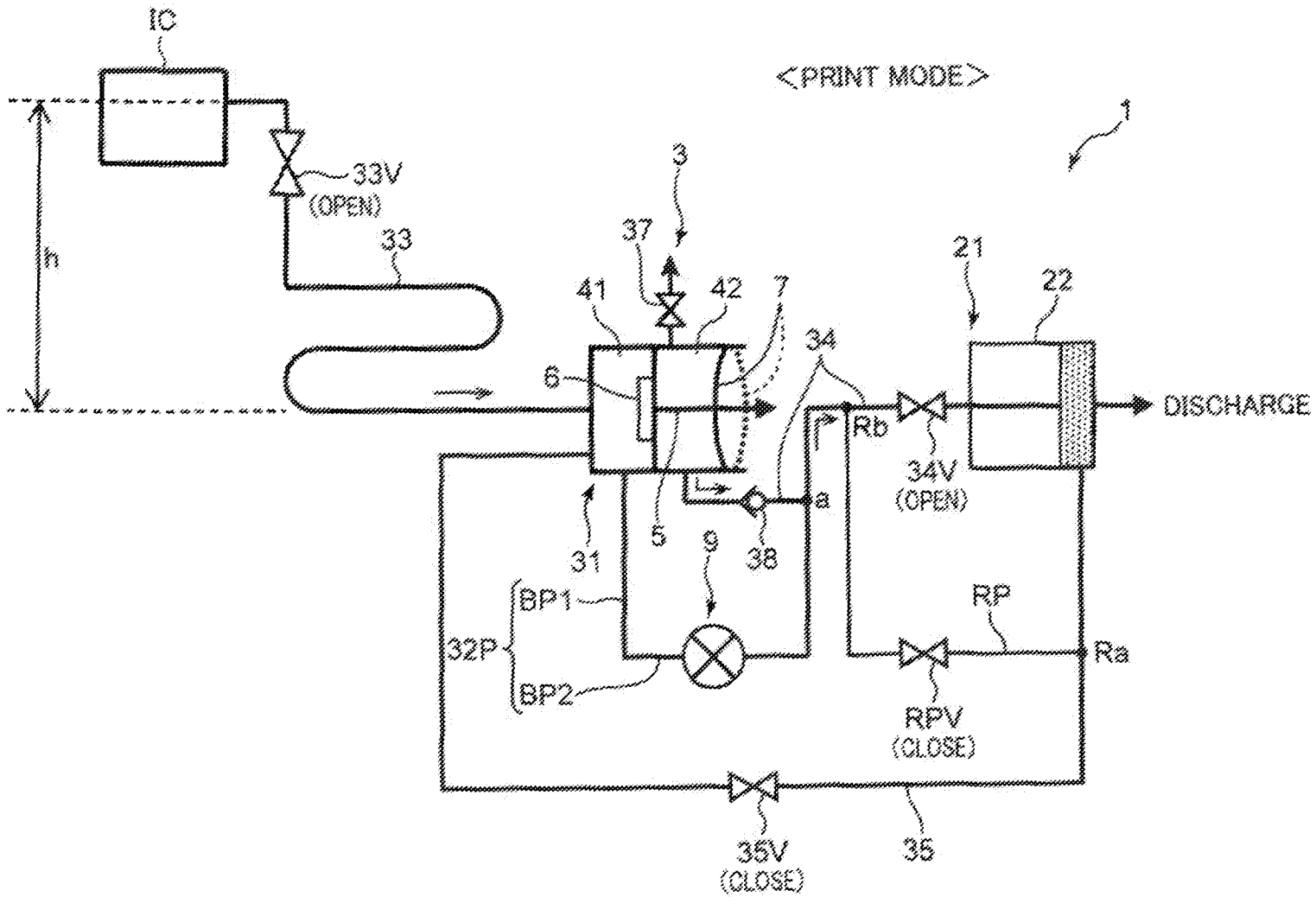
FIG. 3 is a block diagram of a liquid supply system using the liquid ejection device of the embodiment showing a state where a print mode is being performed.

FIG. 3 is a block diagram schematically showing a liquid supply system using the liquid ejection device 1 of this embodiment. The ink cartridge IC is arranged at a position higher than the ink ejecting portion 22 by a height h. This height h serves as a water head difference and the ink in the ink cartridge IC is supplied to the head unit 21 by this water head difference. The liquid supply unit 3 is incorporated at an intermediate position of the ink supply passage between the ink cartridge IC and the head unit 21.

The tank portion 31 of the liquid supply unit 3 includes a first chamber 41 (upstream chamber/part of first supply passage) set to a pressure higher than an atmospheric pressure by receiving the water head difference and the second chamber 42 (pressure chamber) arranged downstream of the first chamber 41 in the ink supply direction and set to a negative pressure. The second chamber 42 is a chamber capable of storing the ink. The first chamber 41 is a chamber in which a negative pressure operation is not performed and to which a pressure P by the water head difference is applied in addition to the atmospheric pressure.

This pressure P is expressed by P=ρgh [Pa] when p denotes water density (ink can be handled equivalent to water in density), g denotes a gravitational acceleration and h denotes the water head difference. The first chamber 41 communicates with the ink cartridge IC via the upstream pipe 33. The second chamber 42 communicates with the ink ejecting portion 22 via the downstream pipe 34.

An on-off valve 6 (opening/closing member) coupled to a pressing member 5 is arranged on a wall member partitioning between the first chamber 41 and the second chamber 42. Further, a wall portion defining the second chamber 42 is constituted by an atmospheric pressure detection film 7 (flexible film member). When a pressure in the second chamber 42 reaches a negative pressure exceeding a predetermined threshold value, the atmospheric pressure detection film 7 detects the atmospheric pressure to be displaced. This displacement force is applied to the pressing member 5, a posture of the coupled on-off valve 6 changes from a closing posture to an opening posture, and the first chamber 41 and the second chamber 42 are allowed to communicate. An ink supply route during a normal printing process is a route passing through the upstream pipe 33, the first chamber 41, the second chamber 42 and the downstream pipe 34.

In addition to the above route, the liquid supply unit 3 includes the bypass pipe 32P short-circuiting the first chamber 41 and the downstream pipe 34 without via the second chamber 42. The upstream end of the bypass pipe 32P is connected to the upstream pipe 33 via the first chamber 41 and the downstream end joins the downstream pipe 34 (joint part a) on a side closer to the tank portion 31 (second chamber 42) than the second T-branch portion Rb. The pump 9 capable of rotating in forward and reverse directions is arranged in the bypass pipe 32P. The pump 9 can forcibly feed the ink to the downstream pipe 34. Further, the liquid supply unit 3 includes the return pipe 35 allowing communication between the ink ejecting portion 22 and the first chamber 41 (communicating also with the second chamber 42 via the on-off valve 6) and including the third valve body 35V, and the short-circuit pipe RP allowing communication between the downstream pipe 34 and the return pipe 35 and including the fourth valve body RPV.

FIG. 3 is also a diagram showing a state where the liquid supply system is performing the print mode (ejection control) for performing the printing process. In the print mode, the ink is supplied from the second chamber 42 to the head unit 21 through the downstream pipe 34. In this print mode, the first valve body 33V of the upstream pipe 33 and the second valve body 34V of the downstream pipe 34 are opened, whereas the third valve body 35V of the return pipe 35 and the fourth valve body RPV of the short-circuit pipe RP are closed. Further, in the print mode, a predetermined mount of the ink is filled in the first chamber 41 and the second chamber 42 and the second chamber 42 is set to a predetermined negative pressure. The pressure in the first chamber 41 is an atmospheric pressure+ρgh [Pa] by the water head difference as described above, so that the ink can be supplied from the ink cartridge IC by the water head difference any time. As basic settings of the print mode, the on-off valve 6 for setting the second chamber 42 to a negative pressure is set in the closing posture to separate the first and second chambers 41, 42. The pump 9 is set in a stopped state. The pump 9 is a tube pump and thus the bypass pipe 32P is closed when the pump 9 is stopped. Thus, the downstream pipe 34 and the ink ejecting portion 22 are also maintained at a negative pressure.

To smoothly fill the ink into the second chamber 42, an air vent mechanism 37 (exhaust valve) is attached to the second chamber 42. The air vent mechanism 37 functions as an exhaust valve for releasing or closing the second chamber 42, which is a pressure chamber, to and from outside air. Of course, the air vent mechanism 37 is closed when the above print mode is performed. A predetermined amount of the ink needs to be initially filled into the second chamber 42 during initial usage, after maintenance and the like. The air vent mechanism 37 promotes the initial filling by allowing the second chamber 42 set in the negative pressure environment to temporarily communicate with the atmosphere (by venting air in the second chamber 42). Further, the ink stored in the second chamber 42 may generate air bubbles by heating. The air vent mechanism 37 is also used in removing air based on the air bubbles from the second chamber 42.

When the head unit 21 operates and the ink ejecting portion 22 discharges ink droplets, the ink in the second chamber 42 is consumed and, accordingly, a degree of the negative pressure in the second chamber 42 progresses. That is, the ink ejecting portion 22 sucks the ink from the second chamber 42 in a state separated from the atmosphere and enhances a negative pressure degree of the second chamber 42 every time discharging ink droplets. When the pressure in the second chamber 42 reaches a negative pressure exceeding the predetermined threshold value as the ink in the second chamber 42 decreases, the atmospheric pressure detection film 7 detects the atmospheric pressure to be displaced as described above. By this displacement force, the posture of the on-off valve 6 changes from the closing posture to the opening posture through the pressing member 5 and the first and second chambers 41, 42 communicate. Thus, the ink flows from the first chamber 41 into the second chamber 42 due to a pressure difference between the both chambers.

As the ink flows into the second chamber 42, the negative pressure degree of the second chamber 42 is gradually alleviated and approaches the atmospheric pressure. Simultaneously, the displacement force applied to the pressing member 5 from the atmospheric pressure detection film 7 also becomes gradually smaller. When the pressure in the second chamber 42 reaches a negative pressure below the predetermined threshold value, the posture of the on-off valve 6 returns to the closing posture and the first and second chambers 41, 42 are separated again. At this time, the ink is replenished into the first chamber 41 from the ink cartridge IC by the water head difference by an amount flowed into the second chamber 42 from the first chamber 41. In the print mode, such an operation is repeated.

In the second embodiment, the print mode in which the ink flows as in the first embodiment is set by opening the first and second valve bodies 33V, 34V and closing the third and fourth valve bodies 35V, RPV.

In the second embodiment, the print mode may be set by opening the first, second and fourth valve bodies 33V, 34V and RPV and closing the third valve body 35V. In this case, the ink is supplied from the second chamber 42 to the head unit 21 through the downstream pipe 34, and also passes from the tank portion 31 to the return pipe 35 until the first T-branch portion Ra and passes through the short-circuit pipe RP and is supplied to the head unit 21 from the second T-branch portion Rb through the downstream pipe 34. However, in this case, it is necessary to also provide the second chamber 42, the on-off valve 6, the atmospheric pressure detection film 7 and the pressing member 5 between the tank portion 31 and the return pipe 35 and enable the ink to be supplied while keeping the head unit 21 at a negative pressure. If the print mode in which the fourth valve body RPV is closed is set, it is not necessary to provide such additional structures. Thus, it is better to set the print mode by opening the first and second valve bodies 33V, 34V and closing the third and fourth valve bodies 35V, RPV in the second embodiment.

The liquid ejection device 1 of this embodiment is capable of performing the first circulation mode, a second circulation mode, a pressurized purge mode and a decompression mode in addition to the above print mode. The first circulation mode is a mode for recovering air trapped in the ink passage (individual passages 26, common passage 27) in the head unit 21 into the liquid supply unit 3 by circulating the ink using the return pipe 35. The second circulation mode is a mode for discharging the air recovered into the liquid supply unit 3 to outside from the air vent mechanism 37 by circulating the ink without passing through the head unit 21 using the short-circuit pipe RP and the return pipe 35. The pressurized purge mode is a mode for supplying high-pressure ink to the ink ejecting portion 22 and causing the ink ejecting portion 22 to discharge the ink in order to remove or prevent ink clogging in the ink ejecting portion 22. The decompression mode is a mode for setting the second chamber 42 at a constant pressure to the predetermined negative pressure during initial usage, after maintenance and the like.

Figure 4:
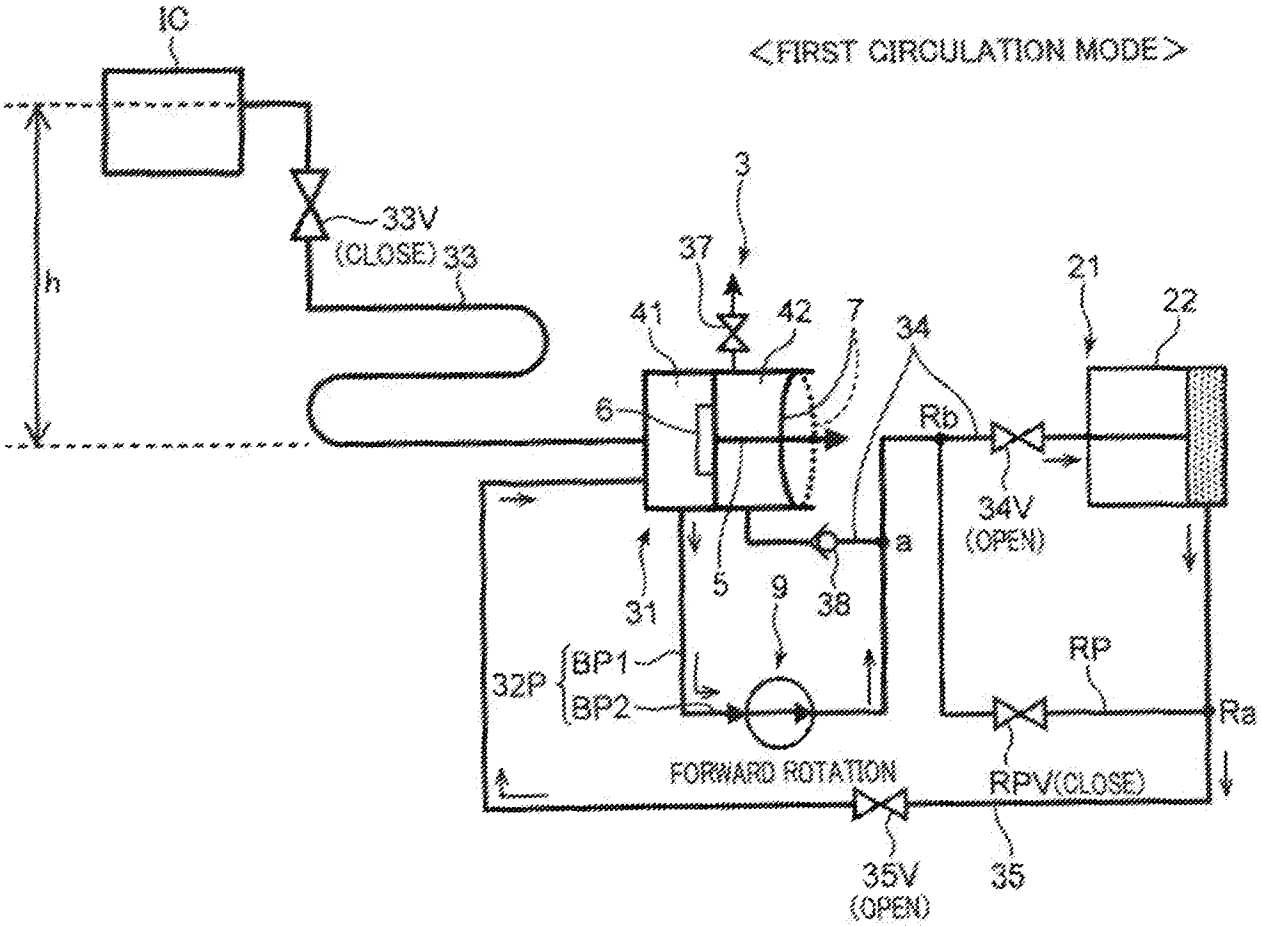
FIG. 4 is a block diagram showing a state where a first circulation mode is being performed.

FIG. 4 is a block diagram showing a state where the first circulation mode (first circulation control) is being performed. In the first circulation mode, the upstream pipe 33 and the short-circuit pipe RP are closed by closing the first and fourth valve bodies 33V, RPV, whereas the downstream pipe 34 and the return pipe 35 are released by opening the second and third valve bodies 34V, 35V. The air vent mechanism 37 is closed and the second chamber 42 is maintained at the negative pressure. Further, the pump 9 arranged in the bypass pipe 32P is driven in the forward rotation direction. As shown in FIG. 2B, the upstream end 351 of the return pipe 35 communicates with the downstream end of the common passage 27 in the head unit 21. On the other hand, the downstream end 352 of the return pipe 35 communicates with the second chamber 42 via the first chamber 41 directly communicating therewith and the on-off valve 6.

If the pump 9 is driven in the forward rotation direction in the first circulation mode, the ink is circulated through a circulation path composed of the downstream bypass pipe BP2, a part of the downstream pipe 34 downstream of the joint part a, the common passage 27 in the head unit 21, the return pipe 35 and the upstream bypass pipe BP1. At this time, since the first valve body 33V is closed, the return pipe 35 and the common passage 27 are set to a negative pressure by an ink sucking operation of the pump 9. Accordingly, the ink does not leak from the ink discharge holes 22H. By performing the first circulation mode, air taken into the head unit 21 can be recovered into the liquid supply unit 3 (first chamber 41). In this way, air can be prevented from staying in the individual passages 26 and the ink discharge holes 22H and an ink discharge failure can be suppressed.

Also in the second embodiment, the first circulation mode in which the ink flows as in the first embodiment is set by opening the second and third valve bodies 34V, 35V while closing the first and fourth valve bodies 33V, RPV as in the first embodiment.

Figure 5:
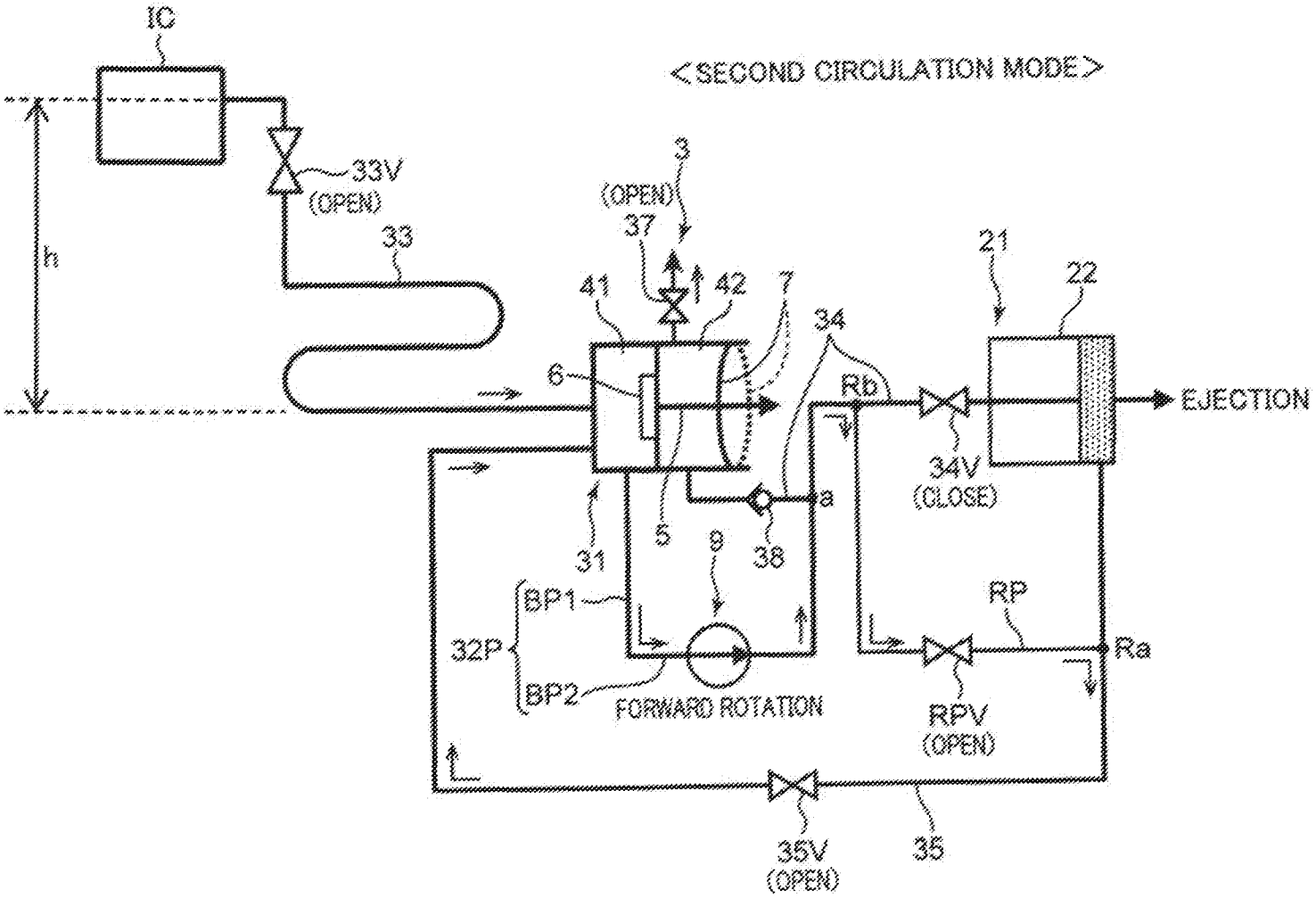
FIG. 5 is a block diagram showing a state where a second circulation mode is being performed.

FIG. 5 is a block diagram showing a state where the second circulation mode (first circulation control) is being performed. In the second circulation mode, the first, third and fourth valve bodies 33V, 35V and RPV are opened, whereas the second valve body 34V is closed. In this way, a part of the downstream pipe 34 downstream of the second T-branch portion Rb is closed, whereas the ink can be supplied from the ink cartridge IC and the short-circuit pipe RP and the return pipe 35 are opened. Further, the air vent mechanism 37 is released, the pressure in the second chamber 42 is set to the atmospheric pressure, the on-off valve 6 is set in the opening posture by a mechanism (FIG. 18) to be described later, and the first and second chambers 41, 42 communicate.

If the pump 9 is driven in the forward rotation direction in the second circulation mode, the ink is circulated through a circulation path composed of the downstream bypass pipe BP2, the part of the downstream pipe 34 downstream of the joint part a, the short-circuit pipe RP, the return pipe 35 and the upstream bypass pipe BP1. Accordingly, the ink can be circulated through the first and second chambers 41, 42 communicating with the atmosphere in the circulation path not passing through the head unit 21 while being supplied from the ink cartridge IC to the first chamber 41. By this circulation, the second chamber 42 is gradually filled with the ink by the inflow of the ink from the first chamber 41, and the air recovered into the first chamber 41 in the first circulation mode can be expelled to outside through the air vent mechanism 37 in the released state. Specifically, the air having entered the head unit 21 and the liquid supply unit 3 can be easily and reliably discharged without being accompanied by the removal of the supply passage.

In the second embodiment, the second circulation mode is set by closing the second valve body 34V while opening the first and fourth valve bodies 33V, RPV. In the second circulation mode of the second embodiment, the third valve body 35V may be open or may be closed.

In the second circulation mode of the second embodiment, the ink flows as in the second circulation mode of the first embodiment in the case of opening the third valve body 35V.

In the case of closing the third valve body 35V, the second circulation mode of the second embodiment differs from the second circulation mode of the first embodiment in that the ink does not flow from the first T-branch portion Ra to the head unit 21 since the third valve body 35V is closed. Also in the second circulation mode of the first embodiment, since the ink more easily flows toward the second chamber 42 than toward the head unit 21, the ink basically does not flow to the head unit 21. Since the ink is stopped at the third valve body 35V in the case of closing the third valve body 35V in the second circulation mode of the second embodiment, there is no likelihood that the ink flows to the head unit 21 and ink droplets leak down from the ink ejecting portion 22, for example, even if the ink is excessively supplied from the pump 9.

Figure 6:
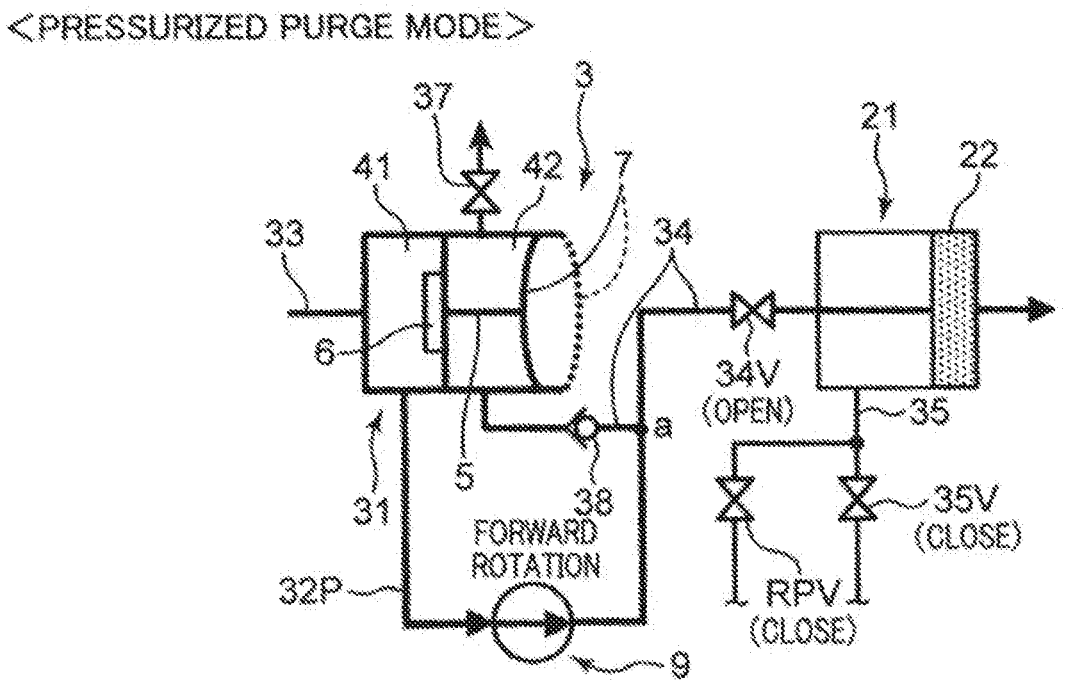
FIG. 6 is a block diagram showing a state where a pressurized purge mode is being performed.

FIG. 6 is a diagram showing a state where the pressurized purge mode is being performed. In the pressurized purge mode, the pump 9 is driven in the forward rotation direction. The first and second valve bodies 33V, 34V are opened, whereas the third and fourth valve bodies 35V, RPV are closed. By the forward drive of the pump 9, the ink directly moves from the upstream pipe 33 toward the downstream pipe 34 via the first chamber 41 and the bypass pipe 32P while bypassing the second chamber 42. That is, the ink pressurized in the pump 9 is supplied to the ink ejecting portion 22. In this way, the ink is forcibly ejected from the ink ejecting portion 22 to clean the ink ejecting portion 22.

The backflow prevention mechanism 38 is provided to prevent the pressurized ink from flowing back to the second chamber 42 through the downstream pipe 34 when the pressurized purge mode is performed. The backflow prevention mechanism 38 is arranged in the downstream pipe 34 on a side upstream of the joint part a of the downstream pipe 34 and the downstream end of the bypass pipe 32P. Since the side of the downstream pipe 34 upstream of the joint part a is closed by the backflow prevention mechanism 38, all the high-pressure ink generated in the bypass pipe 32P flows toward the ink ejecting portion 22. Thus, the breakage of the atmospheric pressure detection film 7 defining the second chamber 42 is prevented.

Also in the second embodiment, the pressurized purge mode in which the ink flows as in the first embodiment is set by closing the third and fourth valve bodies 35V, RPV while opening the first and second valve bodies 33V, 34V as in the first embodiment.

Figure 7:
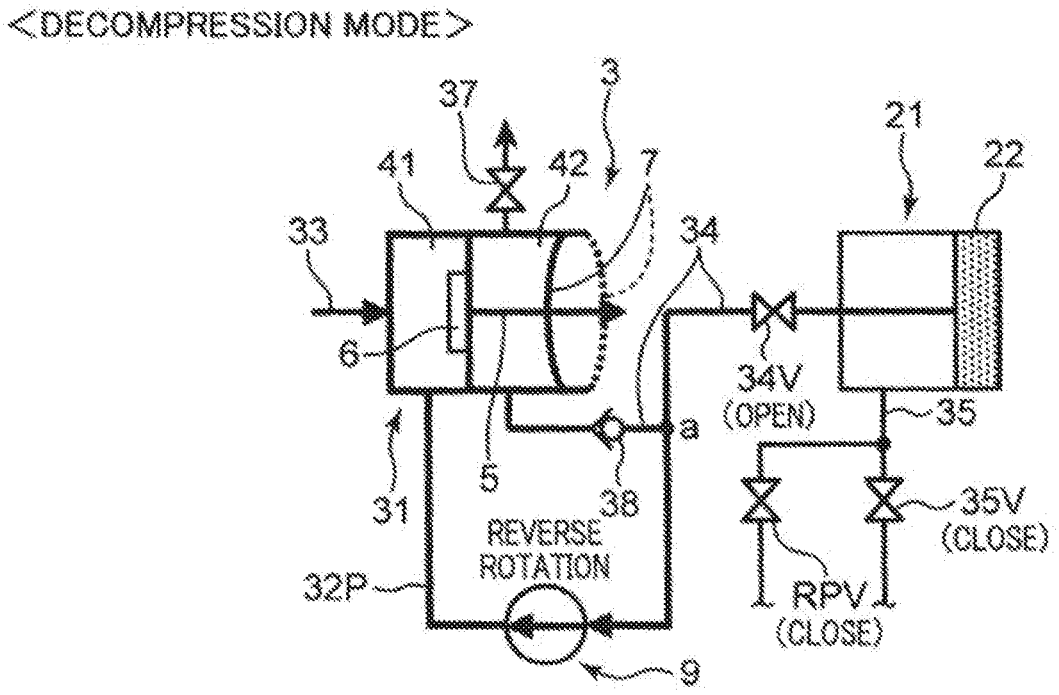
FIG. 7 is a block diagram showing a state where a decompression mode is being performed.

FIG. 7 is a diagram showing a state where the decompression mode is being performed. In the decompression mode, the pump 9 is driven in the reverse rotation direction. The second valve body 34V is opened, whereas the first, third and fourth valve bodies 33V, 35V and RPV are closed. If the pump 9 is driven in the reverse rotation direction, the ink ejecting portion 22 and the second chamber 42 are decompressed through the downstream pipe 34 and the bypass pipe 32P. The ink ejecting portion 22 and the second chamber 42 are set to a predetermined negative pressure, i.e. a negative pressure at which ink droplets do not leak down from the ink ejecting portion 22 even if the ink is supplied by the water head difference, by this decompression mode. Note that if the ink ejecting portion 22 is set to an excessive negative pressure, ink discharge by the drive of the piezo element or the like in the ink ejecting portion 22 may be impeded. Thus, the ink ejecting portion 22 and the second chamber 42 are desirably set, for example, to a weak negative pressure of about −0.2 to −0.7 kPa.

Also in the second embodiment, the decompression mode in which the ink flows as in the first embodiment is set by closing the first, third and fourth valve bodies 33V, 35V and RPV while opening the second valve body 34V as in the first embodiment.

[Overall Structure of Liquid Supply Unit]

Figure 8A:
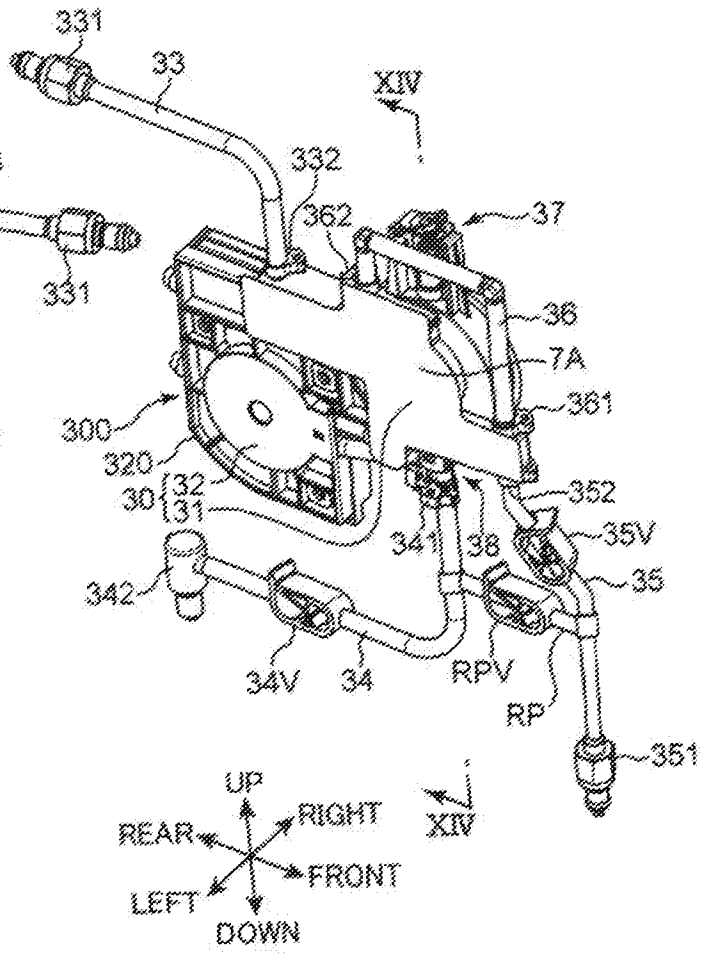
Figure 8B:
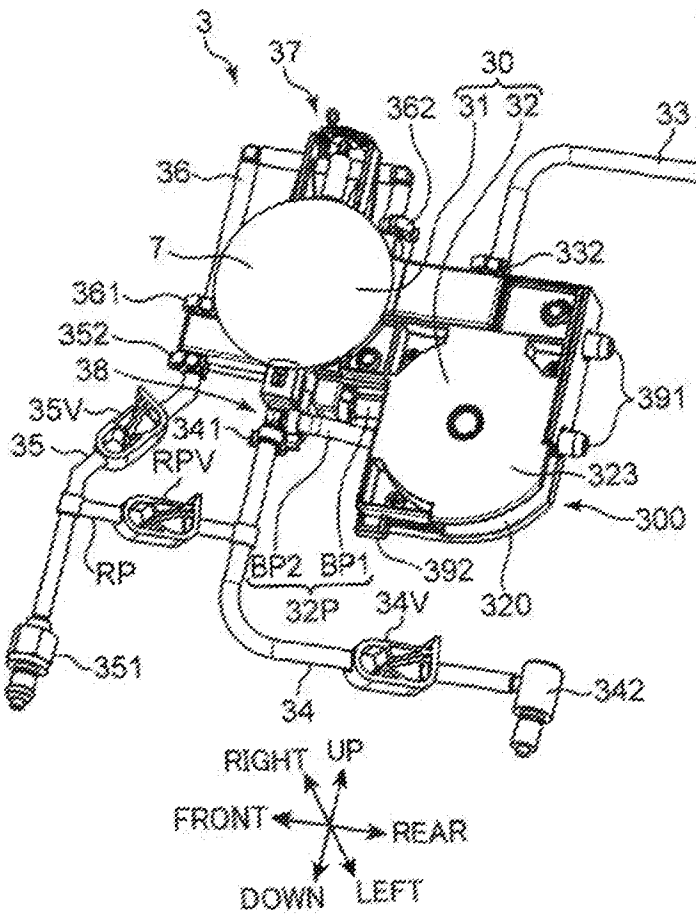
Figure 9:
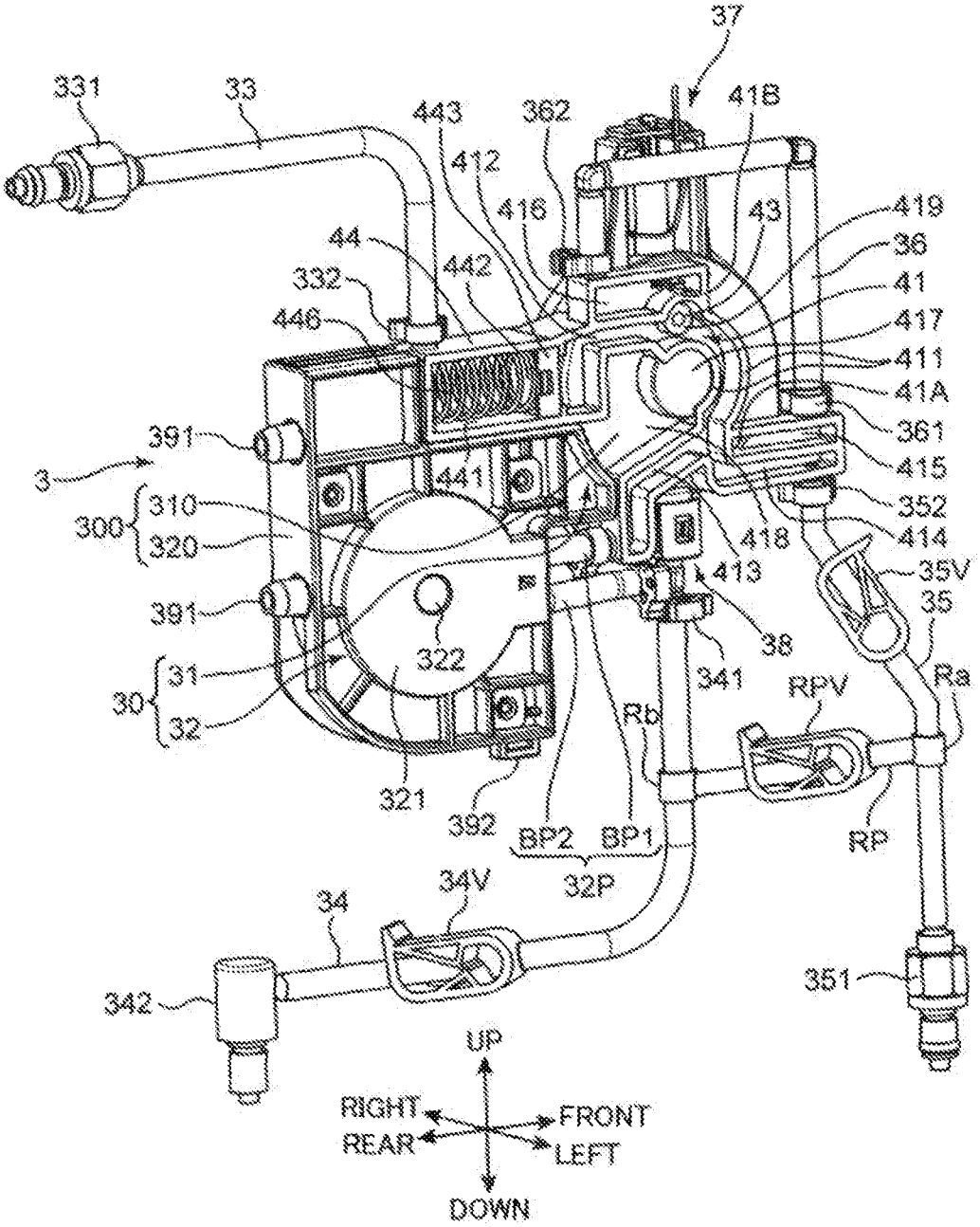
FIG. 9 is a perspective view of the liquid supply unit with a sealing film on the side of the first chamber removed.
Figure 10B:
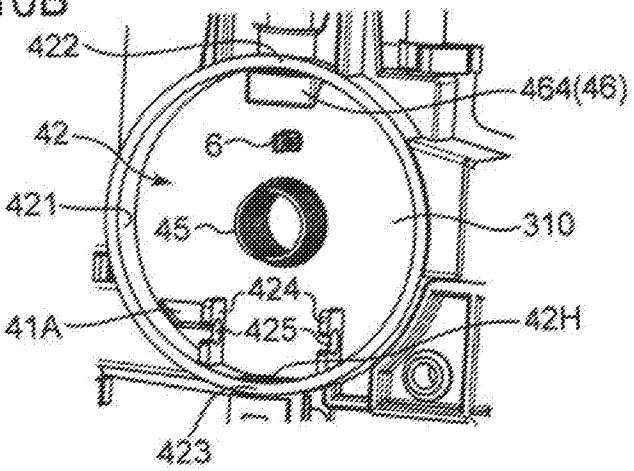
FIG. 10A to 10C are perspective views of the liquid supply unit with an atmospheric pressure detection film on the side of the second chamber removed.
Figure 10C:
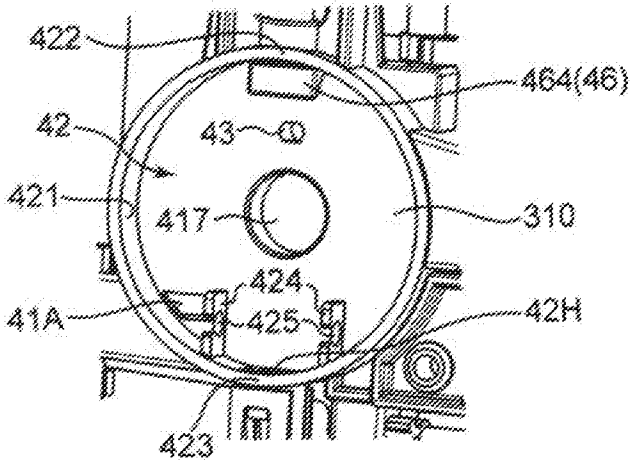
Figure 10A:
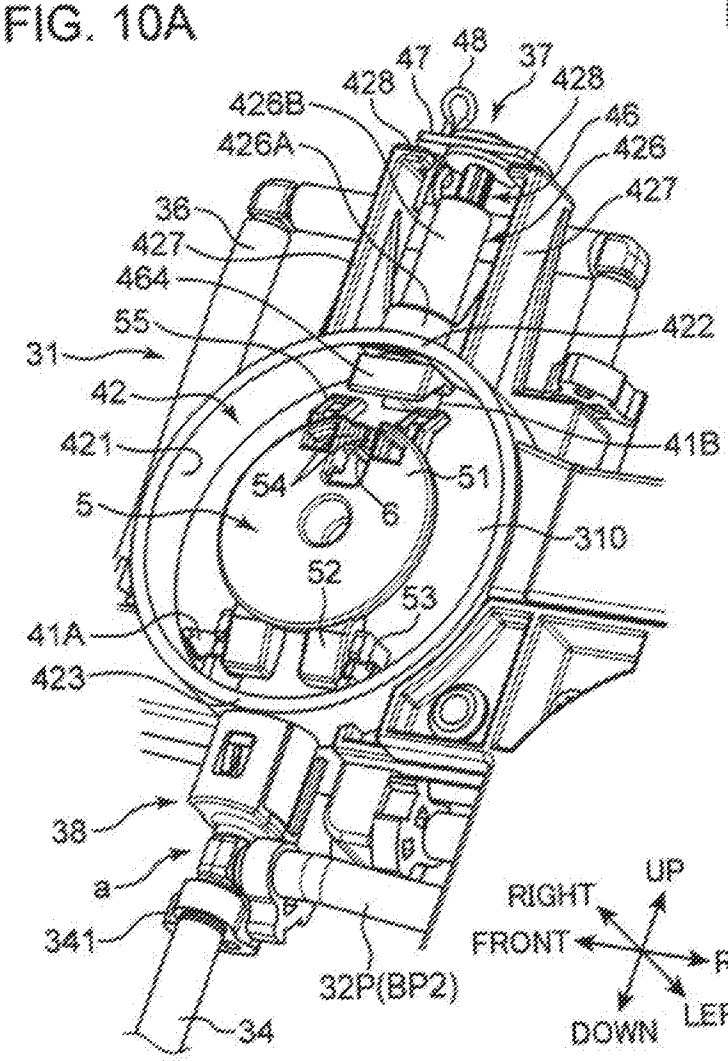
Figure 11:
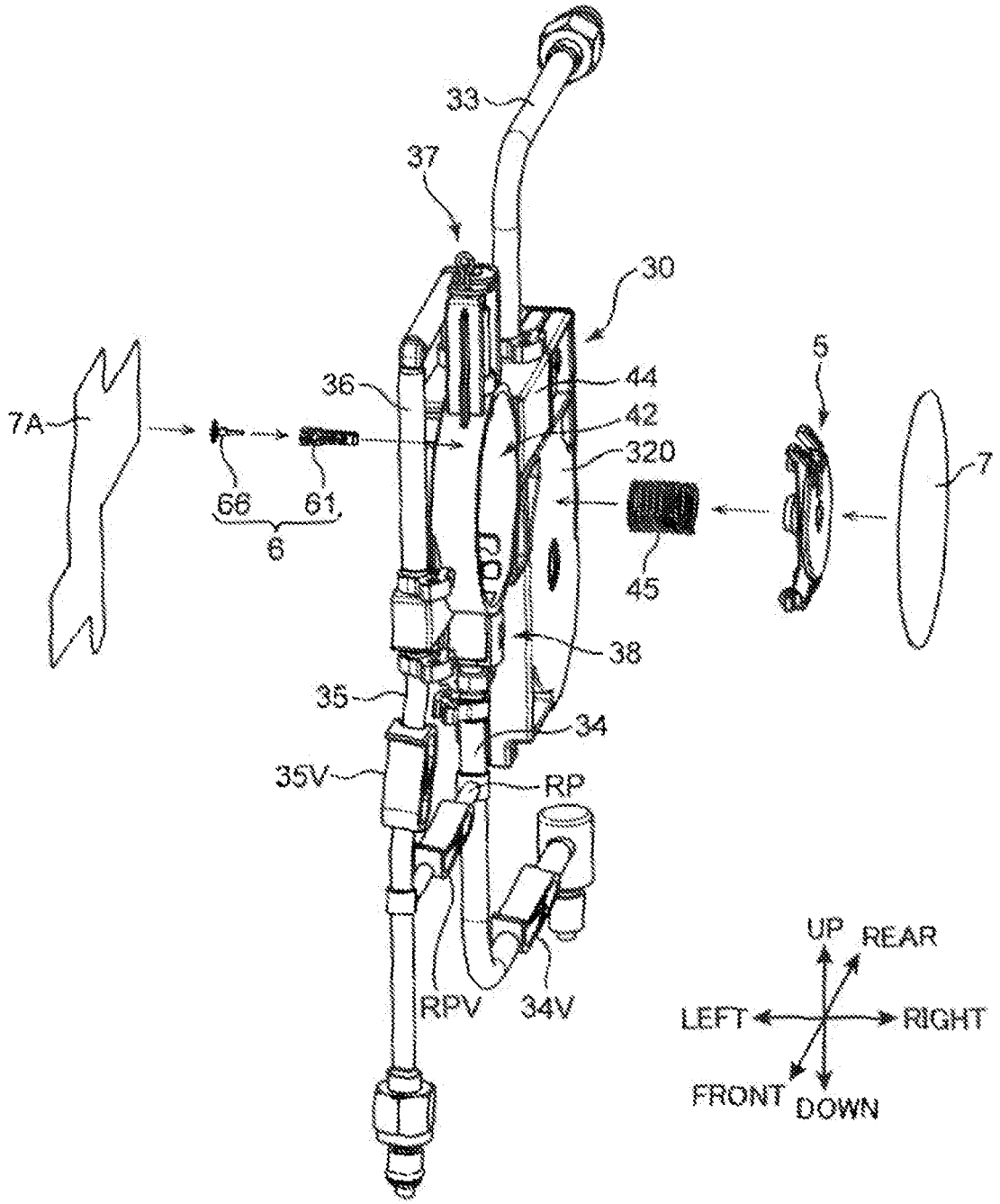
FIG. 11 is an exploded perspective view of the liquid supply unit.

Next, the structure of the liquid supply unit 3 according to this embodiment that enables the execution of each mode of the liquid ejection device 1 described above is described in detail. FIGS. 8A and 8B are perspective views of the liquid supply unit 3, wherein FIG. 8A is a perspective view viewed from the side of the first chamber 41 and FIG. 8B is a perspective view viewed from the side of the second chamber 42. FIG. 9 is a perspective view of the liquid supply unit 3 with a sealing film 7A on the side of the first chamber 41 removed, and FIG. 10A to 10C are perspective views of the liquid supply unit 3 with the atmospheric pressure detection film 7 on the side of the second chamber 42 removed. FIG. 11 is an exploded perspective view of the liquid supply unit 3.

As preliminarily described on the basis of FIGS. 3 to 7, the liquid supply unit 3 includes the body portion 30 having the tank portion 31 and the pump portion 32, the upstream pipe 33, the downstream pipe 34, the return pipe 35, the bypass pipe 32P, the short-circuit pipe RP, the air vent mechanism 37, the backflow prevention mechanism 38, the pressing member 5, the on-off valve 6 and the atmospheric pressure detection film 7. Besides these, the liquid supply unit 3 includes the monitor pipe 36 for monitoring an ink liquid surface of the second chamber 42 and the sealing film 7A constituting a part of a wall surface defining the first chamber 41.

The body portion 30 includes a base board 300 formed of a flat plate extending in the front-rear direction. A front side of the base board 300 is a tank portion base plate 310 (wall member) serving as a board of the tank portion 31 and a rear side thereof is a pump portion housing 320 forming a housing structure in the pump portion 32. The first chamber 41 is arranged on a left surface side of the tank portion base plate 310, and the second chamber 42 is arranged on a right surface side thereof. The first and second chambers 41, 42 are spaces capable of storing the ink. The tank portion base plate 310 is perforated to form a communication opening 43 allowing communication between the first chamber 41 and the second chamber 42. The aforementioned on-off valve 6 is arranged in this communication opening 43.

As shown in FIG. 9, the first chamber 41 is a narrow space roughly U-shaped when viewed from left. The first chamber 41 is defined by a first partition wall 411 projecting leftward from the tank portion base plate 310. The first partition wall 411 is composed of a pair of wall pieces facing each other at a predetermined distance. An inflow portion 412, which is an upstream side of the first chamber 41, communicates with a filter chamber 44. The ink supplied from the upstream pipe 33 to the tank portion 31 flows into the first chamber 41 from the inflow portion 412 via the filter chamber 44.

The first chamber 41 is shaped to extend forward in the horizontal direction from the inflow portion 412 and be then curved downward. A bypass communication chamber 413 and a return communication chamber 414 are Y-branched and connected to a downstream end of the first chamber 41. The bypass communication chamber 413 is a section for linking the first chamber 41 and the upstream bypass pipe BP1. An upstream end of the upstream bypass pipe BP1 is connected to a wall portion defining near the lower end of the bypass communication chamber 413. The return communication chamber 414 is a section for linking the first chamber 41 and the return pipe 35. The downstream end 352 of the return pipe 35 is connected to a wall portion defining near the front end of the return communication chamber 414. Note that the return communication chamber 414 is shown as a part of the return pipe 35 in FIGS. 3 to 5.

A lower monitor communication chamber 415 is arranged above the return communication chamber 414, and an upper monitor communication chamber 416 is arranged above a horizontal part of the first chamber 41. An upstream end 361 of the monitor pipe 36 communicates with the lower monitor communication chamber 415, and a downstream end 362 of the monitor pipe 36 communicates with the upper monitor communication chamber 416. Also with reference to FIG. 10, the tank portion base plate 310 is perforated with a lower communication hole 41A and an upper communication hole 41B arranged above the lower communication hole 41A. The lower monitor communication chamber 415 communicates with the second chamber 42 via the lower communication hole 41A, and the upper monitor communication chamber 416 communicates with the second chamber 42 via the upper communication hole 41B. That is, the monitor pipe 36 communicates with an upper end side and a lower end side of the second chamber 42, and an ink level in the monitor pipe 36 is linked with an ink level in the second chamber 42.

The monitor pipe 36 is formed of a transparent resin tube. Accordingly, a user can know the ink level in the second chamber 42 by visually confirming the monitor pipe 36. In this embodiment, the monitor pipe 36 stands on a front side of the liquid supply unit 3. Thus, the user can know the ink level in each second chamber 42 by visually confirming the monitor pipe 36 of each liquid supply unit 3 from a side forward of the unillustrated carriage on which the plurality of liquid supply units 3 are arranged in parallel in the lateral direction.

A spring seat 417 formed of a cylindrical cavity projects leftward near a vertical center of the first chamber 41. The spring seat 417 is a cavity for housing a biasing spring 45 to be described later, and open toward the second chamber 42. The first chamber 41 is set to surround a substantially half of an outer peripheral wall of this spring seat 417. A spacer chamber 418 is provided behind the spring seat 417. The spacer chamber 418 is provided to make a volume of the first chamber 41 as small as possible. If the volume of the first chamber 41 increases, the amount of the stored ink increases. A swinging force is applied to the liquid supply unit 3 when the carriage carrying this liquid supply unit 3 moves. If the weight of the ink increases, the atmospheric pressure detection film 7 and the sealing film 7A may be peeled or broken by an inertial force. Note that if there is no such concern, the spacer chamber 418 may be omitted and, for example, the first chamber 41 may surround the spring seat 417.

The communication opening 43 is arranged at a position above the spring seat 417 in the first chamber 41. A hollow cylindrical boss portion 419 projects leftward from the tank portion base plate 310 in the first chamber 41. The communication opening 43 is provided to penetrate through this boss portion 419 in the lateral direction. The first chamber 41 is a chamber in which a decompression process and the like are not performed and to which the pressure $P=\rho gh$ by the water head difference is applied in addition to the atmospheric pressure. If the ink flows into the first chamber 41 from the inflow portion 412, the ink starts being successively pooled in the bypass communication chamber 413 and the return communication chamber 414. If the ink level exceeds the communication opening 43, the ink can be supplied to the second chamber 42 through the communication opening 43. Further, if the pump 9 is operated, the ink stored in the first chamber 41 is sucked through the upstream bypass pipe BP1 and the high-pressure ink is supplied toward the head unit 21 through the downstream bypass pipe BP2 and the downstream pipe 34.

Mainly with reference to FIGS. 10A to 10C and 11, the second chamber 42 has a circular shape when viewed from right. The pressing member 5 and the on-off valve 6 described above and the biasing spring 45 and a lever member 46 (operating member) to be described later are assembled with this second chamber 42. FIG. 10A shows a state where these four members are assembled with the second chamber 42, FIG. 10B is a state where the pressing member 5 is removed, and FIG. 10C shows a state where the on-off valve 6 and the biasing spring 45 are further removed.

The second chamber 42 is defined by a second partition wall 421 projecting rightward from the tank portion base plate 310. The second partition wall 421 is a wall having a hollow cylindrical shape. The second chamber 42 is in such a positional relationship as to face the first chamber 41 located on the left side across the tank portion base plate 310. The aforementioned spring seat 417 is provided by recessing the tank portion base plate 310 at a center position of a region surrounded by the hollow cylindrical second partition wall 421, i.e. at a position concentric with the second partition wall 421. The biasing spring 45 is housed in a recess of this spring seat 417. The communication opening 43 is arranged on the spring seat 417 on a vertical line passing through a center point of the spring seat 417.

The lever member 46 for venting air in the second chamber 42 is arranged on an upper end part 422 of the second chamber 42. The second partition wall 421 is perforated with a supply hole 42H in a lower end part 423 (lowermost part of the second chamber 42). The upstream end 341 of the downstream pipe 34 communicates with this supply hole 42H via the backflow prevention mechanism 38. The second chamber 42, the backflow prevention mechanism 38 and the downstream pipe 34 are so arranged in the vertical direction that the backflow prevention mechanism 38 is located below the second chamber 42 to correspond to the supply hole 42H and the joint part a of the downstream pipe 34 and the downstream end of the bypass pipe 32P (downstream bypass pipe BP2) is located below the backflow prevention mechanism 38. The ink stored in the second chamber 42 is supplied to the downstream pipe 34 through the supply hole 42H and the backflow prevention mechanism 38 while being sucked by the ink ejecting portion 22. The backflow prevention mechanism 38 is described in detail later.

A pair of front and rear supporting plates 424 project rightward from the tank portion base plate 310 near the lower end part 423. Each of the pair of supporting plates 424 includes a pivotally supporting portion 425 for pivotally supporting the pressing member 5 to be described later. The aforementioned lower communication hole 41A is perforated in the tank portion base plate 310 at a position in front of and adjacent to the front supporting plate 424. Further, the upper communication hole 41B is perforated in the tank portion base plate 310 near the upper end part 422.

A boss portion 426 and holding frames 427 project upward on the upper end part 422 of the second chamber 42. The boss portion 426 is a tubular body extending vertically upward and internally provided with a boss hole 42A (FIG. 18), which is an opening allowing the second chamber 42 to communicate with the atmosphere. The holding frames 427 are composed of a pair of frame pieces arranged to sandwich the boss portion 426 in the front-rear direction. Locking claws 428 bent in directions to face each other are provided on the upper ends of the respective holding frames 427. The boss portion 426 and the holding frames 427 constitute a part of the air vent mechanism 37, and the lever member 46 (FIG. 16) to be described in detail later is assembled with these.

With reference to FIG. 9, the filter chamber 44 is arranged on a side upstream of the first chamber 41 in the ink supply direction. The filter chamber 44 constitutes a path for supplying the ink from the ink cartridge IC to the first chamber 41 together with the upstream pipe 33. The filter chamber 44 has an inner wall surface 441 defining a rectangular tubular space having a rectangular cross-section in the lateral direction and extending in the ink supply direction. The filter chamber 44 houses a filter member 442 for removing foreign substances in the ink, a holding member 443 for holding this filter member 442 and a coil spring 446 for fixing the filter member 442. An inflow opening for the ink is perforated in a ceiling wall of the filter chamber 44. The downstream end 332 of the upstream pipe 33 is connected to a receiving plug standing on the ceiling wall to correspond to this inflow opening. The ink flows into the filter chamber 44 and, after having foreign substances removed by the filter member 442, flows into the first chamber 41 through the inflow portion 412.

With reference to FIGS. 8 and 11, an opening in a left surface side of the first chamber 41 is sealed by the sealing film 7A made of resin. The sealing film 7A has an outer shape capable of covering not only the first chamber 41, but also the bypass communication chamber 413, the return communication chamber 414, the lower monitor communication chamber 415, the upper monitor communication chamber 416 and the filter chamber 44. A peripheral edge part of the sealing film 7A is welded or bonded to opening end surfaces of the first partition wall 411 and other walls, whereby the sealing film 7A seals the openings of the respective chambers.

An opening in a right surface side of the second chamber 42 is sealed by the atmospheric pressure detection film 7 formed of a film member made of flexible resin. The atmospheric pressure detection film 7 has a circular outer shape matching a wall shape of the second partition wall 421 of the second chamber 42 when viewed from right. A peripheral edge part of the atmospheric pressure detection film 7 is welded or bonded to an opening end surface of the second partition wall 421 to seal the opening of the second chamber 42. Note that the atmospheric pressure detection film 7 is welded or bonded without particular tension being applied thereto.

The pump portion 32 is arranged behind, oblique below and adjacent to the tank portion 31 and includes a pump cavity 321 for housing the pump 9 and a cam shaft insertion hole 322 into which an unillustrated cam shaft for pivotally supporting an eccentric cam 91 (FIG. 19) of the pump 9 is inserted. The pump cavity 321 is a hollow cylindrical cavity arranged in the pump portion housing 320. The cam shaft insertion hole 322 is a boss hole provided at a position concentric with the pump cavity 321. An opening in a right surface side of the pump cavity 321 is sealed by a pump cover 323 as shown in FIG. 8B. Two positioning pins 391 project on the rear surface of the pump portion housing 320 and a rib 392 projects on the lower surface thereof. These positioning pins 391 and rib 392 function as a positioning member in mounting the liquid supply unit 3 on the carriage.

The liquid supply unit 3 of this embodiment is integrally formed with the tank portion 31 and the pump portion 32. Specifically, the tank portion base plate 310 serving as the board of the tank portion 31 and the pump portion housing 320 with the pump cavity 321 are integrated, and the pump 9 for pressurized purging is mounted in the liquid supply unit 3 itself. In this way, the device configuration of the carriage can be made compact and simple.

[Details of Negative Pressure Supply Mechanism]

Next, a negative pressure supply mechanism for supplying the ink from the first chamber 41 to the second chamber 42 as the ink in the second chamber 42 decreases is described in detail. The negative pressure supply mechanism includes the pressing member 5, the on-off valve 6 and the atmospheric pressure detection film 7, whose operations were outlined on the basis of FIG. 3 above, and further includes the biasing spring 45 (biasing member). The on-off valve 6 is arranged in the communication opening 43 and the posture thereof changes between the closing posture for closing the communication opening 43 and the opening posture for opening the communication opening 43. The biasing spring 45 biases the on-off valve 6 in a direction toward the closing posture. The pressing member 5 can press the on-off valve 6 in a direction toward the opening posture. The atmospheric pressure detection film 7 is displaced based on a negative pressure generated as the ink in the second chamber 42 decreases, and transmits a displacement force thereof to the pressing member 5.

<Pressing Member>

Figure 12A:
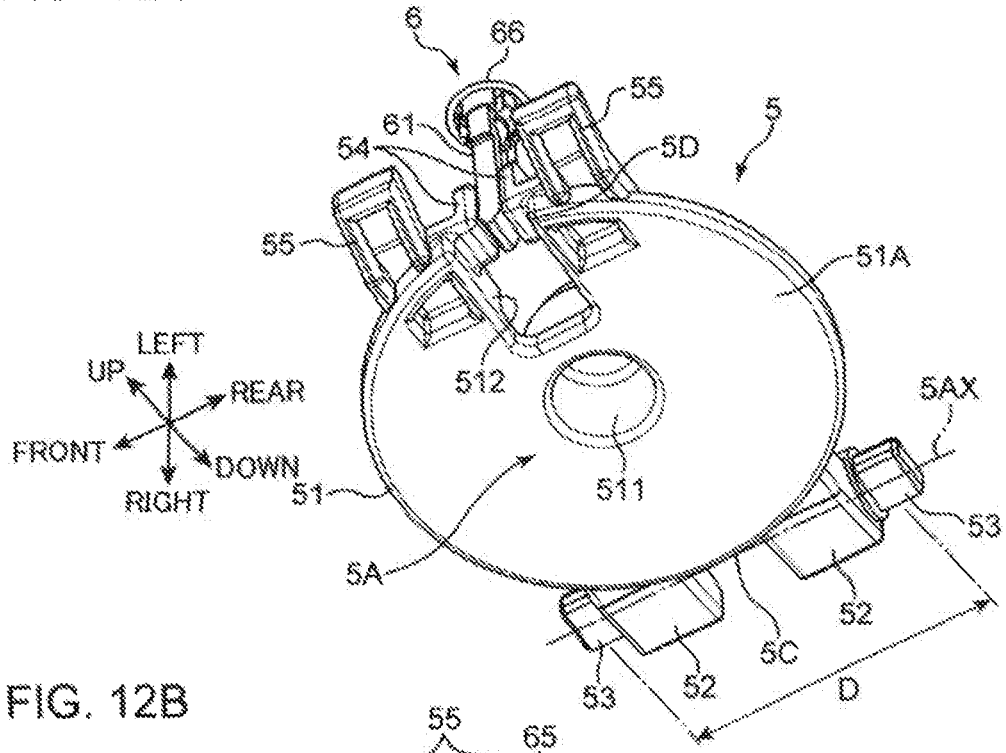
FIG. 12A is a perspective view of a pressing member and FIG. 12B is a perspective view of the pressing member viewed in a different direction.
Figure 12B:
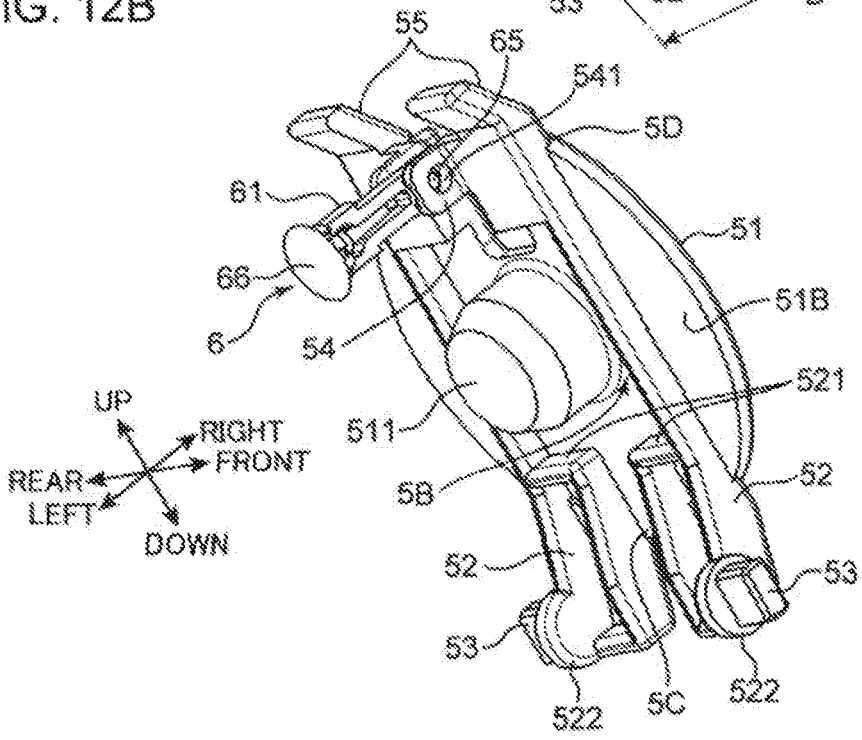

FIGS. 12A and 12B are perspective views of the pressing member 5 viewed in different directions, and the on-off valve 6 is also shown therein. The pressing member 5 is a member rotatably arranged in the second chamber 42. The pressing member 5 includes a disk portion 51 (flat plate portion) formed of a circular flat plate, a pair of arm portions 52 extending downward from a lower end side 5C of the disk portion 51, pivot portions 53 provided on extending end parts of the respective arm portions 52, a pair of link bosses 54 (pressing portion) arranged on an upper end side 5D of the disk portion 51 and receiving slopes 55 (operated portion) configured to interfere with the lever member 46 and receive an operating pressing force. The pair of pivot portions 53 are pivotally supported on the pivotally supporting portions 425 (FIG. 10) of the pair of supporting plates 424 arranged in the second chamber 42. In this way, the disk portion 51 is rotatable about axes of the pivot portions 53.

The disk portion 51 is a disk having a diameter, which is about ½ of an inner diameter of the hollow cylindrical second partition wall 421 defining the second chamber 42. The disk portion 51 pivotally supported by the pivotally supporting portions 425 is arranged to be substantially concentric with the second partition wall 421. The disk portion 51 has a first surface 51A facing the atmospheric pressure detection film 7 and a second surface 51B facing the on-off valve 6 (facing the tank portion base plate 310). A spring fitting projection 511 is provided to project from the second surface 51B in a radial center of the disk portion 51. A right end part of the biasing spring 45 formed of a coil spring is fit to a part of the spring fitting projection 511 on the side of the second surface 51B. Note that a region of the spring fitting projection 511 is a cylindrical recess on the side of the first surface 51A.

The disk portion 51 includes a pressure receiving portion 5A for receiving a displacement force from the atmospheric pressure detection film 7 and a biased portion 5B for receiving a biasing force from the biasing spring 45. The pressure receiving portion 5A is set at a predetermined position of the first surface 51A of the disk portion 51. In this embodiment, the pressure receiving portion 5A is a region of a peripheral edge part of the spring fitting projection 511 on the first surface 51A. The biased portion 5B is a region of the spring fitting projection 511, to which the biasing spring 45 is fit, on the side of the second surface 51B. Specifically, the biased portion 5B is set at a position corresponding to the pressure receiving portion 5A.

If the pressure receiving portion 5A receives no displacement force from the atmospheric pressure detection film 7, the disk portion 51 is in a state close to an upright state. However, the right end of the biasing spring 45 is in contact with the biased portion 5B and the first surface 51A is in contact with the inner surface of the atmospheric pressure detection film 7 by a biasing force of the biasing spring 45. On the other hand, if the pressure receiving portion 5A receives a displacement force equal to or larger than the biasing force of the biasing spring 45 from the atmospheric pressure detection film 7, the disk portion 51 rotates leftward about the axes of the pivot portions 53 to be inclined leftward from the upright state.

The pair of arm portions 52 are arranged apart from each other in the front-rear direction on the lower end side 5C of the disk portion 51. Upper end parts 521 of the pair of arm portions 52 extend further upward than the lower end side 5C of the disk portion 51 and are located below both side parts of the spring fitting projection 511. Tip parts 522 of the pair of arm portions 52 respectively extend straight downward from the lower end side 5C. The pivot portions 53 respectively project from the tip parts 522 in the front-rear direction. In particular, the pivot portion 53 projects forward from the front surface of the front tip part 522 and the pivot portion 53 projects from the rear surface of the rear tip part 523, i.e. the pivot portions 53 project in directions separating from each other. The pivot portions 53 are fit into the pivotally supporting portions 425 of the supporting plates 424. The provision of the pivot portions 53 on the tip parts 522 of the arm portions 52 contributes to an increase of a swing width of the upper end side 5D of the disk portion 51 when the pressing member 5 rotates about the pivot portions 53.

The pair of pivot portions 53 are arranged on an axis of rotation 5AX extending in the front-rear direction. The front pivot portion 53 and the rear pivot portion 53 are arranged at a predetermined distance D from each other. That is, the pair of pivot portions 53 are arranged apart from each other across a part corresponding to a central region of the disk portion 51 in a plane direction. The distance D can be set to about 40% to 90% of the diameter of the disk portion 51. In this way, pivot fulcrums formed by the pair of pivot portions 53 are spaced widely from each other across the central region of the disk portion 51. Thus, the disk portion 51 rotating about the pivot fulcrums is unlikely to be twisted about an axis perpendicular to the axis of rotation 5AX. Therefore, a rotational movement of the disk portion 51 can be stabilized.

The pair of link bosses 54 project leftward from the second surface 51B near the upper end side 5D of the disk portion 51. In particular, the disk portion 51 is provided with a cutout 512 extending radially inward with the upper end side 5D serving as an opening edge. The link bosses 54 formed of rectangular flat plates respectively stand on front and rear end edges facing a space of the cutout 512. Each link boss 54 includes a link hole 541. This link hole 541 is used to link the pressing member 5 and the on-off valve 6. By this linkage, an opening/closing operation of the on-off valve 6 is linked with a rotational movement of the pressing member 5.

In other words, the link bosses 54 serve as pressing member for pressing the on-off valve 6 to move in the lateral direction according to a rotational movement of the pressing member 5 rotating about the pivot portions 53. The pair of link bosses 54 are arranged on the upper end side 5D separated from the pair of pivot portions 53 arranged on the lower end side 5C by a predetermined distance. That is, the link bosses 54 serving as the pressing member are arranged at counter positions on the disk portion 51 with respect to the pivot portions 53 forming the pivot fulcrums. Thus, movement amounts of the link bosses 54 during the rotation of the pressing member 5 and a movement amount of the on-off valve 6 linked to the link bosses 54 can be increased.

In a relationship of the pressure receiving portion 5A or the biased portion 5B (point of force) and the pivot portions 53 (fulcrum), the link bosses 54 (point of action) are arranged at positions more distant from the pivot portions 53 than the pressure receiving portion 5A and the biased portion 5B. In other words, the link bosses 54 are arranged on the upper end side 5D of the disk portion 51 to face the pivot portions 53 across the pressure receiving portion 5A and the biased portion 5B. By adopting such an arrangement, a movement force received by the pressure receiving portion 5A or the biased portion 5B can be given to the link bosses 54 while being amplified by a separating distance from these.

<On-Off Valve>

Next, the on-off valve 6 is described. The on-off valve 6 is arranged in the communication opening 43 allowing communication between the first and second chambers 41, 42. The on-off valve 6 opens or closes the communication opening 43 by moving in the lateral direction in the communication opening 43, following a rotational movement of the pressing member 5 about the pivot portions 53. To follow the rotational movement, the on-off valve 6 is linked to the link bosses 54 of the disk portion 51.

Figure 13A:
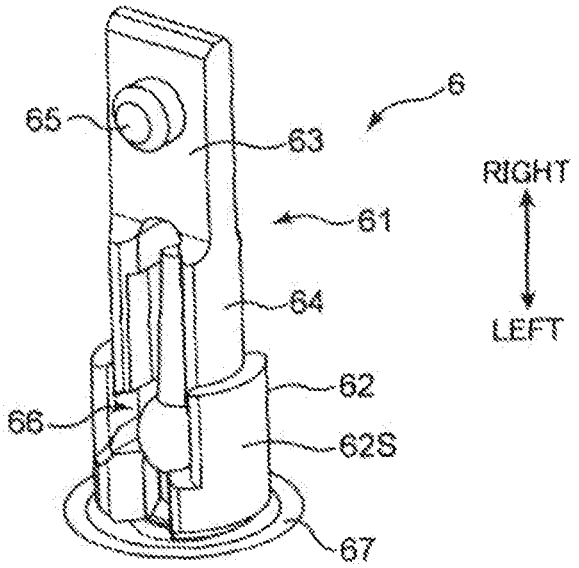
FIG. 13A is a perspective view of an on-off valve and FIG. 13B is an exploded perspective view of the on-off valve.
Figure 13B:
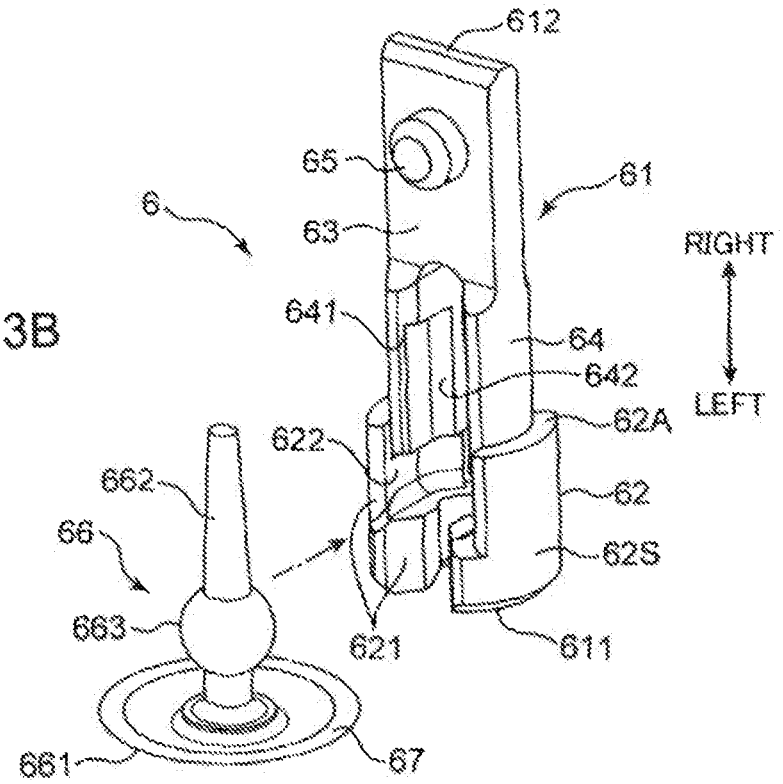
Figure 14A:
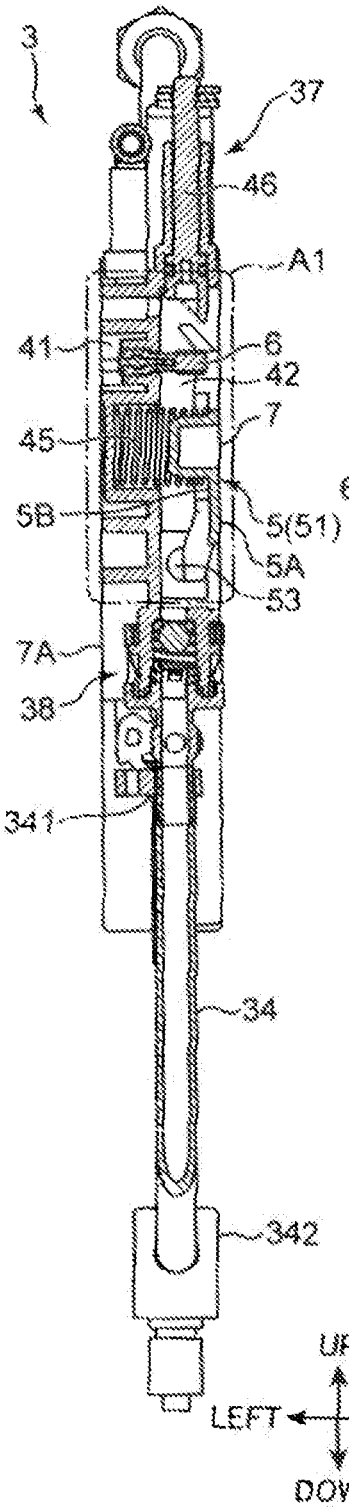
FIG. 14A is a sectional view along line XIV-XIV of FIG. 8A showing a state where the on-off valve is in a closing posture and FIG. 14B is an enlarged view of a part A1 of FIG. 14A.
Figure 14B:
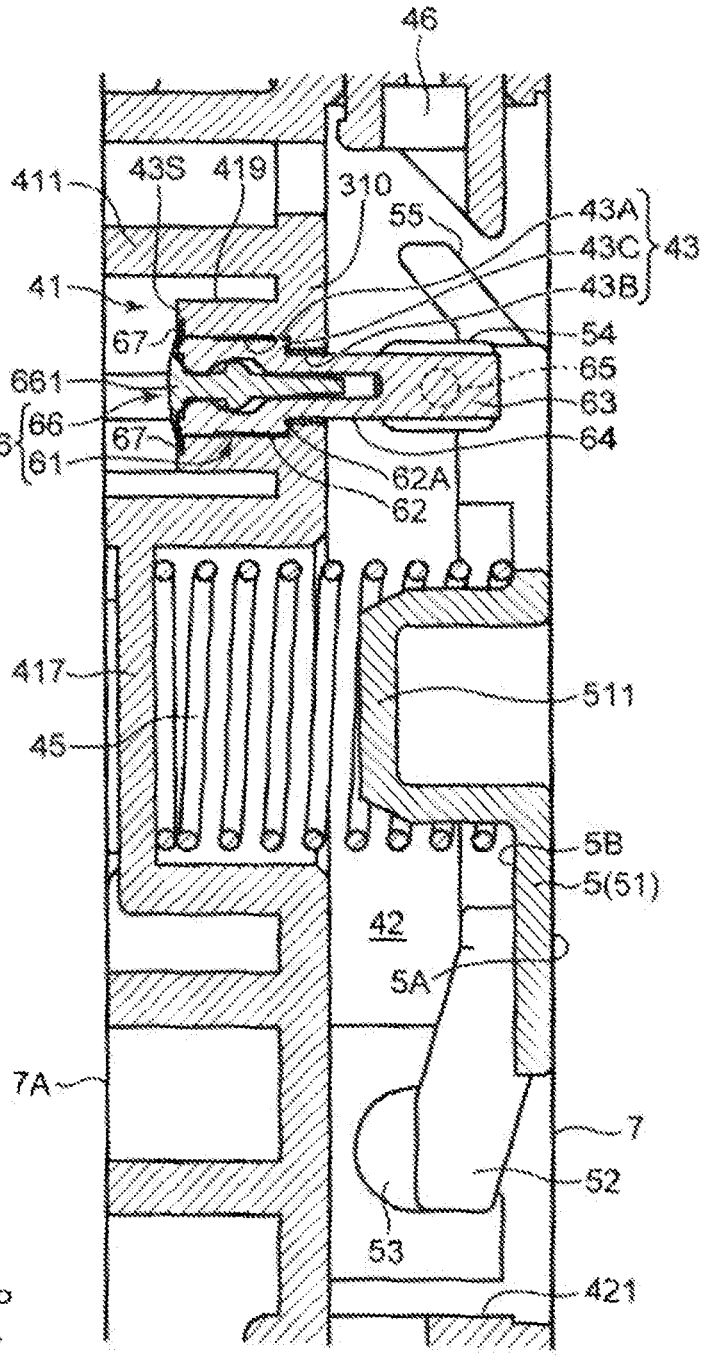

FIG. 13A is a perspective view of the on-off valve 6 and FIG. 13B is an exploded perspective view of the on-off valve 6. FIG. 14A is a sectional view along line XIV-XIV of FIG. 8A and FIG. 14B is an enlarged view of a part A1 of FIG. 14A. The on-off valve 6 is an assembly composed of a valve holder 61 and an umbrella valve 66 held by this valve holder 61. The communication opening 43 is a cylindrical hole penetrating through the tank portion base plate 310 and the boss portion 419 and includes a large-diameter portion 43A, a small-diameter portion 43B having a smaller inner diameter than the large-diameter portion 43A and a step portion 43C based on a diameter difference between the both.

The valve holder 61 is a semi-cylindrical member with a first end part 611 located on the side of the first chamber 41 (left side) and a second end part 612 located on the side of the second chamber 42 (right side) in a state mounted in the communication opening 43. The valve holder 61 includes a tubular portion 62 on the side of the first end part 611, a flat plate portion 63 on the side of the second end part 612, an intermediate portion 64 located between the tubular portion 62 and the flat plate portion 63 and link pins 65 disposed on the flat plate portion 63. The umbrella valve 66 is held on the side of the first end part 611 of the valve holder 61.

The tubular portion 62 is a tubular part having a largest outer diameter in the valve holder 61. The tubular portion 62 includes a guide surface 62S, which is an outer peripheral surface of the tubular portion 62, a flow passage cutout 621 formed by cutting a part of the tubular portion 62 in a circumferential direction, and a holding groove 622 annularly recessed in the inner periphery of the tubular portion 62. The tubular portion 62 is housed in the large-diameter portion 43A of the communication opening 43 and the guide surface 62S is guided by the inner surface of the large-diameter portion 43A when the on-off valve 6 moves in the lateral direction. The flow passage cutout 621 serves as a flow passage in which the ink flows when the on-off valve 6 is in the opening posture. The holding groove 622 is a groove for locking a locking sphere portion 663 of the umbrella valve 66.

The intermediate portion 64 is a tubular part having a smaller outer diameter than the tubular portion 62. The intermediate portion 64 includes a releasing portion 641, which is a releasing part connected to the flow passage cutout 621, and a pin housing portion 642 for housing a pin portion 662 of the umbrella valve 66. The intermediate portion 64 is housed in the small-diameter portion 43B of the communication opening 43, and the outer peripheral surface thereof is guided by the inner surface of the small-diameter portion 43B. An annular contact portion 62A formed by a step based on an outer diameter difference between the tubular portion 62 and the intermediate portion 64 is present on a boundary part between the tubular portion 62 and the intermediate portion 64. The annular contact portion 62A faces and comes into contact with the step portion 43C of the communication opening 43.

The flat plate portion 63 is a part projecting rightward from the communication opening 43 with the on-off valve 6 mounted in the communication opening 43. The flat plate portion 63 has a pair of front and back flat surfaces extending in the lateral direction. The link pins 65 respectively project from the pair of flat surfaces. As shown in FIG. 12B, the link pins 65 are fit into the link holes 541 provided in the link bosses 54 of the pressing member 5. By this fitting, the pressing member 5 and the on-off valve 6 are linked, and a rotational motion of the pressing member 5 about the pivot portions 53 can be translated into a linear motion of the on-off valve 6.

The umbrella valve 66 is an article made of rubber and includes an umbrella portion 661, the pin portion 662 extending rightward from the umbrella portion 661 and the locking sphere portion 663 integrally provided to the pin portion 662. The umbrella portion 661 has an umbrella diameter larger than the inner diameter of the large-diameter portion 43A of the communication opening 43. A peripheral edge part on an inner side (right surface side) of the umbrella portion 661 is a sealing surface 67. The sealing surface 67 can seal the communication opening 43 by coming into contact with a sealing wall surface 43S, which is a peripheral wall surface of the communication opening 43 and a projecting end surface of the boss portion 419 (closing posture). On the other hand, if the sealing surface 67 is separated from the sealing wall surface 43S, the sealed state is released (opening posture). Note that the umbrella shape of the umbrella portion 661 is inverted if a predetermined pressure is applied to the right surface side (FIG. 23).

The pin portion 662 is a rod-like part extending in the lateral direction and serving as a support column of the umbrella portion 661. The pin portion 662 is inserted into the tubular portion 62 of the valve holder 61 and the pin housing portion 642 of the intermediate portion 64. That is, the umbrella portion 661 comes into contact with the first end part 611 of the valve holder 61, whereas the pin portion 662 can be fit into an inner tubular portion of the valve holder 61. The locking sphere portion 663 is a spherically bulging part near the left end of the pin portion 662 and to be fit into the holding groove 622. By fitting the locking sphere portion 663 into the holding groove 622, the umbrella valve 66 is held in the valve holder 61 with a lateral movement restricted. Specifically, the umbrella valve 66 moves integrally with the valve holder 61 in the lateral direction.

<Biasing Spring>

The biasing spring 45 is a coil spring disposed between the second surface 51B of the disk portion 51 and the tank portion base plate 310 and configured to support (bias) the second surface 51B. In particular, as shown in FIG. 14B, a right end side of the biasing spring 45 is fit to the spring fitting projection 511 of the disk portion 51 and a left end side is housed in the spring seat 417 recessed on the tank portion base plate 310. When the pressure receiving portion 5A of the disk portion 51 receives a leftward displacement force against a rightward biasing force of the biasing spring 45, the disk portion 51 rotates leftward about the pivot portions 53. If the displacement force is not received, the disk portion 51 is maintained in an upright posture by the biasing force.

<Operation of On-Off Valve>

Next, an opening/closing operation of the on-off valve 6 is described. FIGS. 14A and 14B show a state where the on-off valve 6 is in the closing posture. In this state, the atmospheric pressure detection film 7 does not generate such a displacement force as to rotate the pressing member 5 (disk portion 51), i.e. the sum of a spring force (biasing force) of the biasing spring 45 and an internal pressure of the second chamber 42 exceeds the atmospheric pressure. Although the second chamber 42 is at a negative pressure, the biasing spring 45 biases the biased portion 5B of the disk portion 51 rightward with a biasing force exceeding a displacement force of the atmospheric pressure detection film 7 by the negative pressure. Thus, the disk portion 51 does not rotate about the pivot portions 53 and is maintained in the aforementioned upright posture.

In this case, the on-off valve 6 linked to the pressing member 5 at the link bosses 54 is in the closing posture to be located on a rightmost side. Specifically, the valve holder 61 is pulled rightward via the link bosses 54 by the biasing force of the biasing spring 45. Thus, the annular contact portion 62A of the valve holder 61 butts against the step portion 43C of the communication opening 43 and the sealing surface 67 of the umbrella valve 66 comes into contact with the sealing wall surface 43S. Thus, the communication opening 43 is sealed by the umbrella valve 66. The biasing spring 45 can be said to indirectly bias the on-off valve 6 in the direction toward the closing posture by biasing the disk portion 51 rightward.

Figure 15A:
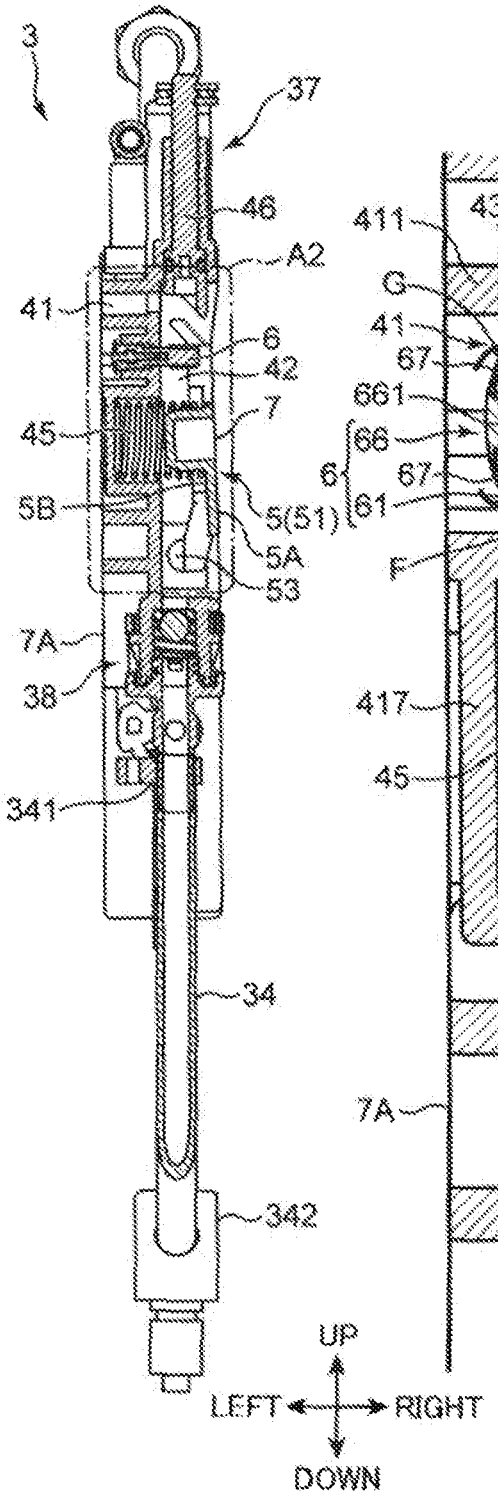
FIG. 15A is a sectional view, corresponding to FIG. 14A, showing a state where the on-off valve is in an opening posture
Figure 15B:
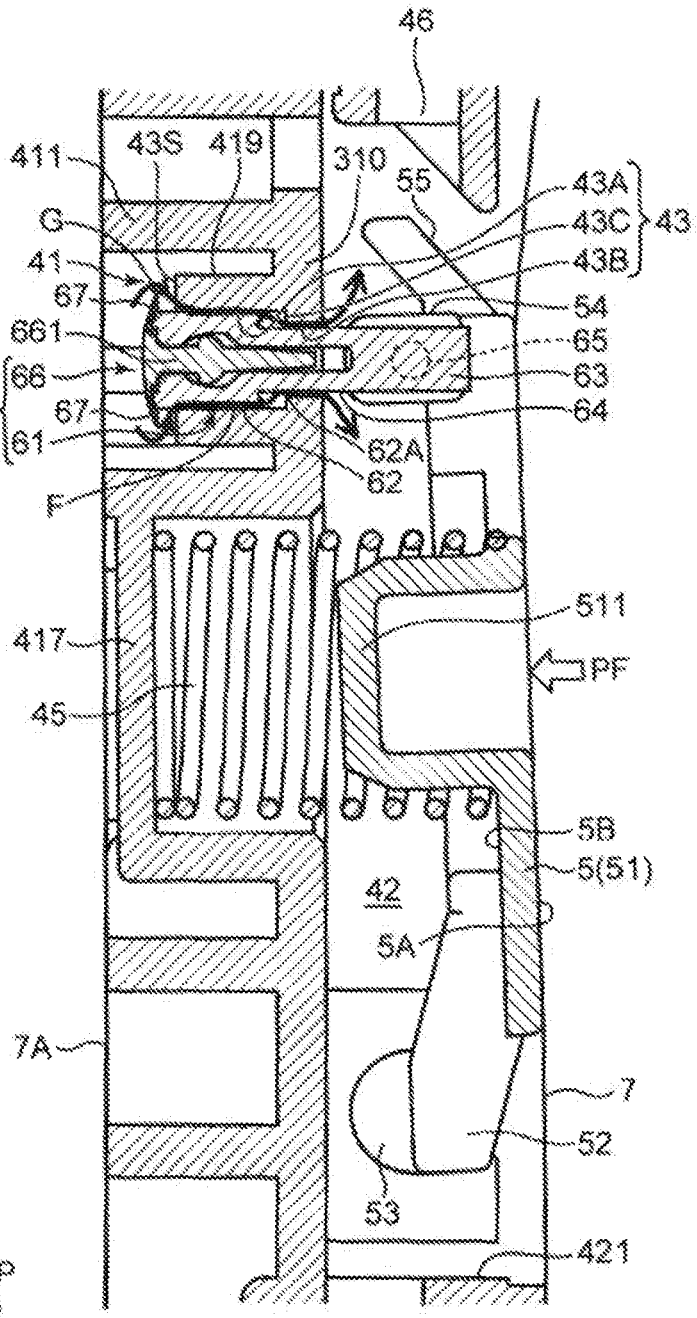
FIG. 15B is an enlarged view of a part A2 of FIG. 15A, FIGS. 16A and 16B are perspective views of a lever member

FIG. 15A is a sectional view, corresponding to FIG. 14A, showing a state where the on-off valve 6 is in the opening posture, and FIG. 15B is an enlarged view of a part A2 of FIG. 15A. If the ink ejecting portion 22 continues an ink droplet ejecting operation from the state of FIG. 14, a negative pressure degree of the second chamber 42, which is a sealed space, gradually increases as the ink decreases. If the pressure in the second chamber 42 eventually reaches a negative pressure exceeding a predetermined threshold value, the atmospheric pressure detection film 7 comes to apply a pressing force acting against the biasing force of the biasing spring 45 (pressing force exceeding the biasing force) to the pressure receiving portion 5A of the disk portion 51. Specifically, the sum of the spring pressure of the biasing spring 45 and the internal pressure of the second chamber 42 becomes lower than the atmospheric pressure.

In this case, the disk portion 51 rotates leftward about the pivot portions 53 against the biasing force of the biasing spring 45. By this rotation, the link bosses 54 generate a pressing force PF for moving the on-off valve 6 leftward, thereby changing the posture of the on-off valve 6 to the opening posture. That is, the pressing force is transmitted from the link holes 541 of the link bosses 54 to the link pins 65 of the valve holder 61, and the valve holder 61 linearly moves leftward while the guide surface 62S is guided by the inner surface of the communication opening 43. According to this movement, the umbrella valve 66 also moves leftward and the sealing surface 67 thereof is separated from the sealing wall surface 43S. That is, a gap G is formed between the sealing surface 67 and the sealing wall surface 43S. Thus, the sealing of the communication opening 43 by the umbrella valve 66 is released.

If the on-off valve 6 is set in the opening posture, the ink flows into the second chamber 42 from the first chamber 41 due to a pressure difference between the first chamber 41 having a pressure, which is the sum of the atmospheric pressure and ρgh, and the second chamber 42 having the advanced negative pressure degree as indicated by arrows F in FIG. 15B. Specifically, the ink flows into the second chamber 42 through a flow passage composed of the gap G between the sealing surface 67 of the umbrella valve 66 and the sealing wall surface 43S, the flow passage cutout 621 prepared in the tubular portion 62 of the valve holder 61 and the releasing portion 641 prepared in the intermediate portion 64.

If the ink further flows into the second chamber 42, the negative pressure degree of the second chamber 42 is gradually mitigated. If the sum of the spring pressure of the biasing spring 45 and the internal pressure of the second chamber 42 eventually becomes larger than the atmospheric pressure, the disk portion 51 is pushed back rightward by the biasing force of the biasing spring 45. Specifically, if the pressure in the second chamber 42 reaches a negative pressure below the predetermined threshold value, the disk portion 51 is pressed by the biasing force of the biasing spring 45 and rotates rightward about the pivot portions 53. In this way, the on-off valve 6 also linearly moves rightward by being pulled by the link bosses 54. At a certain stage, the annular contact portion 62A of the valve holder 61 butts against the step portion 43C of the communication opening 43 and the sealing surface 67 of the umbrella valve 66 comes into contact with the sealing wall surface 43S. Thus, the on-off valve 6 returns to the closing posture.

[Air Vent Mechanism for Second Chamber]

Figure 16A:
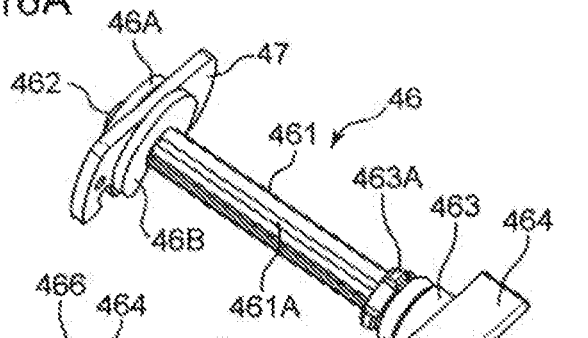
FIG. 16C is an exploded perspective view of the lever member.
Figure 16B:
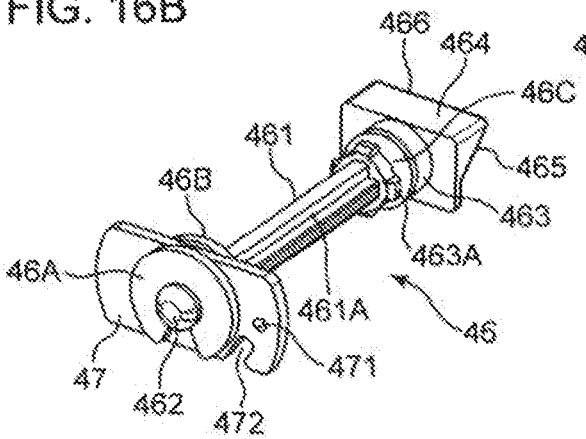
Figure 16C:
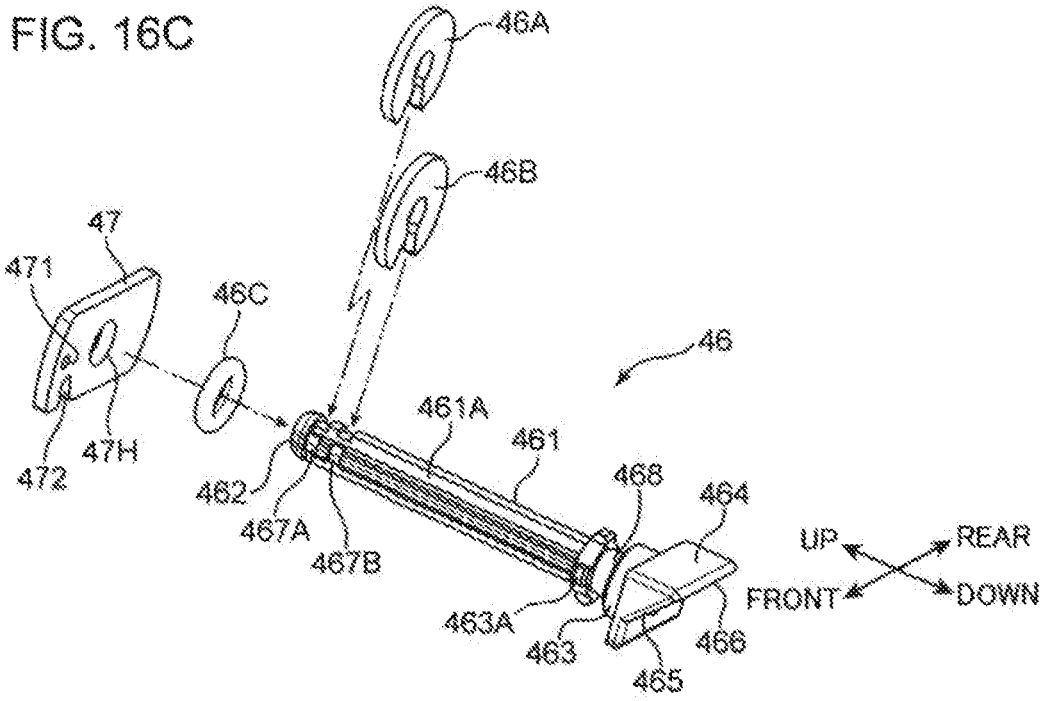
Figure 17A:
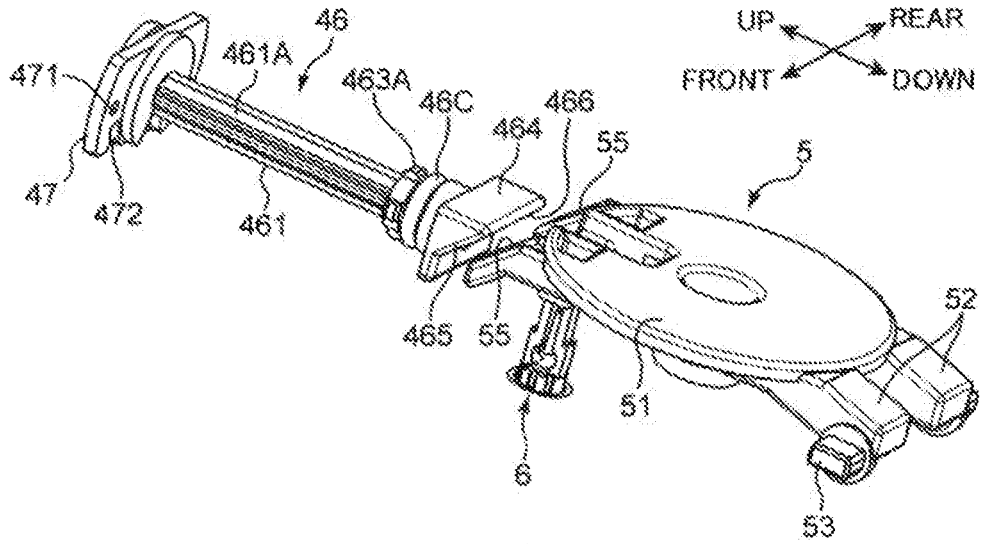
FIGS. 17A and 17B are perspective views of the pressing member, the on-off valve and the lever member.
Figure 17B:
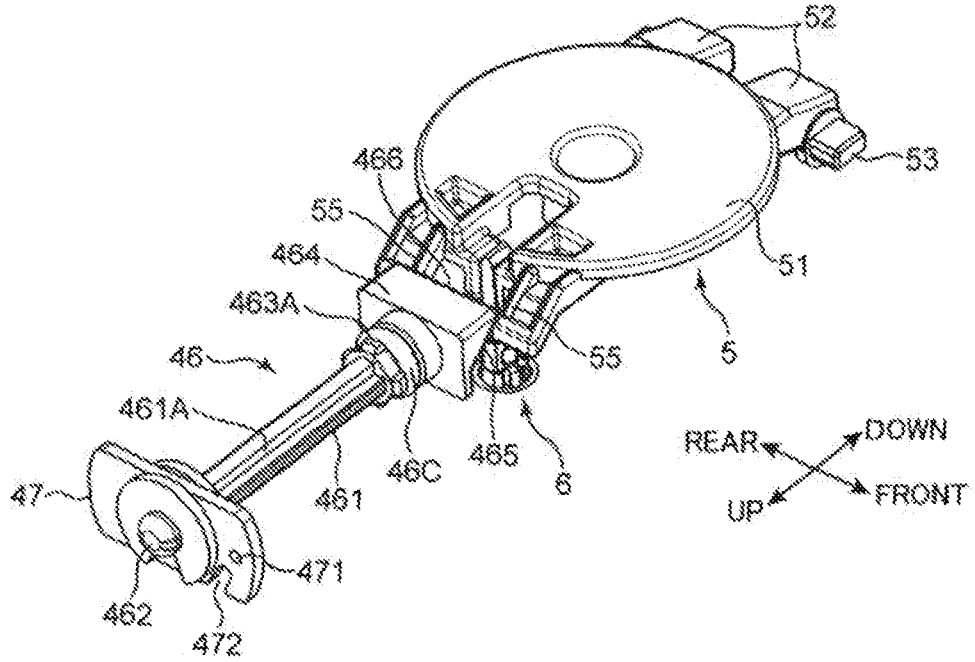
Figure 18A:
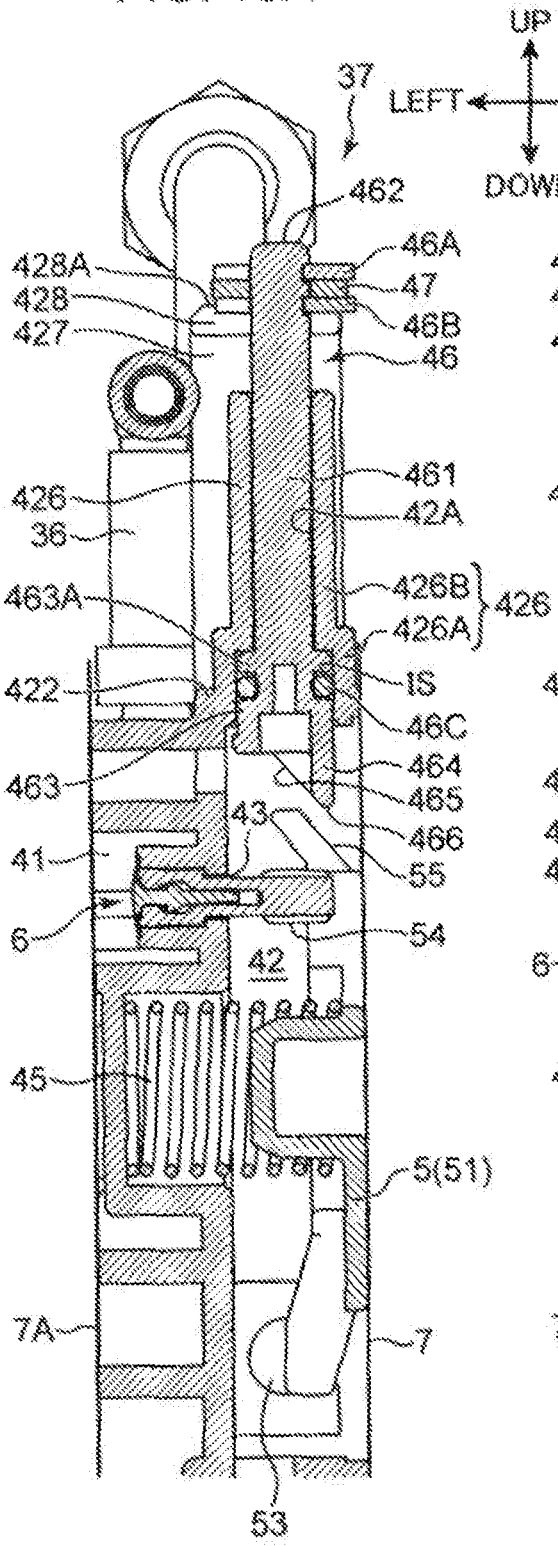
FIG. 18A is a sectional view showing a state before the lever member is operated and FIG. 18B is a sectional view showing a state where air is vented by the operation of the lever member.
Figure 18B:
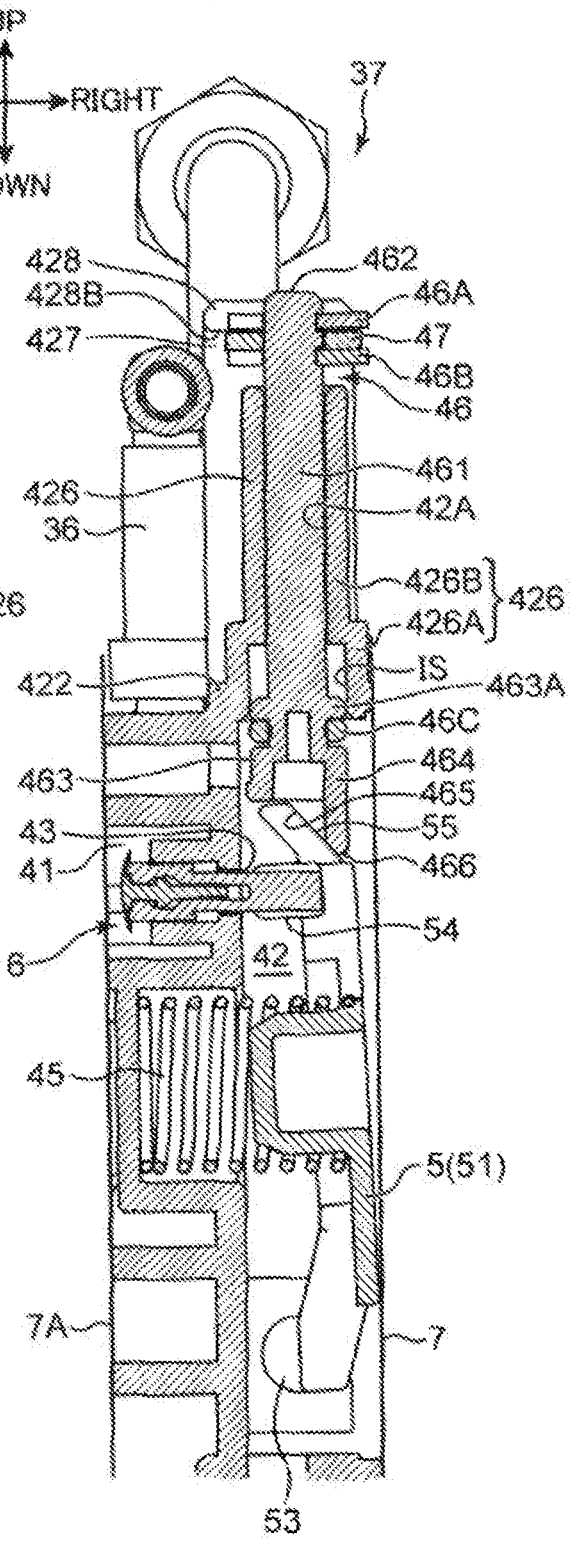

Next, the air vent mechanism 37 attached to the second chamber 42 is described with reference to FIGS. 16A to 18B in addition to FIG. 10A already described. FIGS. 16A and 16B are perspective views of the lever member 46 constituting the air vent mechanism 37 and FIG. 16C is an exploded perspective view of the lever member 46. FIGS. 17A and 17B are perspective views showing a positional relationship of the pressing member 5, the on-off valve 6 and the lever member 46. FIGS. 18A and 18B are sectional views showing the same cross-section as FIG. 14A and explaining an air vent operation of the lever member 46. As described above, the air vent mechanism 37 is used to vent air in initially filling the ink into the second chamber 42 and to remove air bubbles generated from the ink (during the execution of the second circulation mode) during initial usage, after maintenance and the like.

The air vent mechanism 37 includes the lever member 46, a seal ring 46C and a stopper 47 in addition to the already described boss portion 426 projecting on the upper end part 422 of the second chamber 42. The boss portion 426 projects from the uppermost end of the second partition wall 421 defining the second chamber 42 as shown in FIG. 10A and includes an opening allowing communication between the second chamber 42 and the atmosphere, i.e. the boss hole 42A having a circular cross-section and serving as an air vent hole. By providing the boss hole 42A at an uppermost position of the second chamber 42, the air in the second chamber 42 can be reliably vented. The boss portion 426 includes a large-diameter portion 426A located right above the upper end part 422 and a small-diameter portion 426B connected to and above the large-diameter portion 426A. An inner diameter of the boss hole 42A is larger in the large-diameter portion 426A than in the small-diameter portion 426B.

As shown in FIG. 16C, the lever member 46 has a shovel-like shape with a rod-like member 461 to be partially inserted into the boss hole 42A and a pressing piece 464 connected to and below the rod-like member 461. The lever member 46 is one type of a valve member whose posture is changed between a sealing posture for sealing the boss hole 42A and a releasing posture for releasing the boss hole 42A. In this embodiment, the lever member 46 is configured such that a posture changing operation thereof is linked with the posture changing operation of the on-off valve 6 via the pressing member 5. Specifically, with the lever member 46 held in the sealing posture, the on-off valve 6 is allowed to be set in the closing posture. With the lever member 46 held in the releasing posture, the posture of the on-off valve 6 is changed from the closing posture to the opening posture.

The rod-like member 461 of the lever member 46 is a cylindrical body having an outer diameter smaller than a hole diameter of the boss hole 42A and has an upper end part 462 and a lower end part 463. The upper end part 462 serves as an input portion for receiving an operating pressing force for pressing the lever member 46 downward from a user. The lower end part 463 is linked to the pressing piece 464. As shown in FIGS. 17A and 17B, the pressing piece 464 functions as a transmitting portion for transmitting the operating pressing force given to the upper end part 462 to the receiving slopes 55 of the pressing member 5. An intermittent projection portion 463A including a plurality of small projections annularly arranged in a circumferential direction of the rod-like member 461 is provided at a position somewhat above the lower end part 463.

The pressing piece 464 has a pressing slope 465 inclined with respect to an axis of the rod-like member 461 and a lower end edge 466 extending in the front-rear direction on a lowermost end. The pressing slope 465 is a slope extending upward with the lower end edge 466 as a start point. The pressing slope 465 and the lower end edge 466 serve as parts which interfere with the pair of front and rear receiving slopes 55 of the pressing member 5 when the lever member 46 receives the operating pressing force. A width of the pressing slope 465 in the front-rear direction is set longer than an interval between the pair of receiving slopes 55. The pressing slope 465 and the lower end edge 466 come into contact with the receiving slopes 55 to transmit the operating pressing force to the pressing member 5, whereby the pressing member 5 rotates leftward about the pivot portions 53 and changes the posture of the on-off valve 6 from the closing posture to the opening posture.

An upper engaging groove 467A and a lower engaging groove 467B arranged at a distance in the vertical direction are formed near the upper end part 462 of the rod-like member 461. An upper washer 46A is fit into the upper engaging groove 467A, and a lower washer 46B is fit into the lower engaging groove 467B. Further, a sealing groove 468 is provided near the lower end part 463. An outer diameter of the lower end part 463 is set larger than those of other parts of the rod-like member 461, and a space between the lower end part 463 and the intermittent projection portion 463A serves as the sealing groove 468. Further, air vent longitudinal grooves 461A formed by recessed grooves are provided over the entire length of the rod-like member 461 in the front-rear direction. The positions of these air vent longitudinal grooves 461A are aligned with those of valley parts of the intermittent projection portion 463A in the circumferential direction.

The seal ring 46C and the stopper 47 are mounted on the rod-like member 461. The seal ring 46C is an O-ring having an inner diameter somewhat larger than the diameter of the rod-like member 461. The seal ring 46C is fit on the rod-like member 461 and fit into the sealing groove 468. The outer peripheral surface of the seal ring 46C slides in contact with an inner peripheral surface IS of the large-diameter portion 426A of the boss portion 426 with the seal ring 46C mounted in the sealing groove 468. The stopper 47 is a substantially rectangular plate member and includes a rotation hole 47H into which the rod-like member 461 is inserted. The stopper 47 is mounted at a position near the upper end part 462 and between the upper and lower engaging grooves 467A and 467B. The upper and lower washers 46A, 46B are respectively fit into the upper and lower engaging grooves 467A, 467B to sandwich the stopper 47 and restrict a movement of the stopper 47 in an axial direction.

The stopper 47 is rotatable about the axis of the rod-like member 461 while being sandwiched by the upper and lower washers 46A, 46B. The stopper 47 is a member planned to come into contact with upper surfaces 428A or lower surfaces 428B (FIGS. 18A and 18B) of the pair of locking claws 428 of the holding frames 427 according to a vertical movement of the lever member 46. During the above vertical movement, the stopper 47 is so rotated that a longitudinal direction is aligned with the lateral direction and passes through a clearance between the pair of locking claws 428. The stopper 47 is formed with a pin hole 471 and a locking recess 472. At least when the stopper 47 comes into contact with the upper surfaces 428A, a pin member 48 in the form of a split pin is fit into the pin hole 471 and the locking recess 472 as shown in FIG. 10A, the rotation of the stopper 47 is stopped and the stopper 47 is retained, i.e. the stopper 47 is fixed. The stopper 47, the pin member 48 and the pair of locking claws 428 function as a fixing mechanism for fixing the posture of the lever member 46.

Next, the operation of the lever member 46 is described. FIG. 18A is a sectional view showing a state before the lever member 46 is operated and FIG. 18B is a sectional view showing a state where the air in the second chamber 42 is vented by the operation of the lever member 46. FIG. 18A shows a state where the upper end part 462 of the lever member 46 is receiving no operating pressing force, i.e. a state where the lever member 46 is in the sealing posture for sealing the boss hole 42A. On the other hand, FIG. 18B shows a state where the upper end part 462 is pressed downward to apply an operating pressing force, i.e. a state where the lever member 46 is in the releasing posture for releasing the boss hole 42A.

The sealing posture is set by fixing the stopper 47 and the locking claws 428 by the pin member 48 with the stopper 47 held in contact with the upper surfaces 428A of the locking claws 428. By this fixing, the lever member 46 is lifted upward. In this state, the intermittent projection portion 463A and the lower end part 463 of the rod-like member 461 are housed in the large-diameter portion 426A of the boss portion 426. That is, the outer peripheral surface of the sealing ring 46C is in contact with the inner peripheral surface IS of the large-diameter portion 426A. Thus, the boss hole 42A is sealed. The pressing piece 464 (pressing slope 465 and lower end edge 466) of the lever member 46 are separated from the receiving slopes 55 of the pressing member 5 and is not applying any force to the pressing member 5. Thus, the on-off valve 6 is maintained in the closing posture.

On the other hand, if the lever member 46 is lowered by receiving the operating pressing force and set in the opening posture, the seal ring 46C is separated from the inner peripheral surface IS as the intermittent projection portion 463A and the lower end part 463 are also lowered. In this way, air passages formed by the valley parts of the intermittent projection portion 463A and the air vent longitudinal grooves 461A of the rod-like member 461 communicate with the space in the second chamber 42. That is, the boss hole 42A is released and the second chamber 42 communicates with outside air. Thus, the air staying in the second chamber 42 can be exhausted to outside through the boss hole 42A.

Further, if the lever member 46 is set in the releasing posture, the operating pressing force is transmitted to the pressing member 5. As shown in FIG. 18B, the pressing slope 465 and the lower end edge 466 press the receiving slopes 55. If the receiving slopes 55 are pressed, the pressing member 5 (disk portion 51) rotates leftward about the axes of the pivot portions 53. As described above, if the pressing member 5 rotates leftward, the on-off valve 6 is pressed leftward via the link bosses 54 and the posture of the on-off valve 6 is changed from the closing posture to the opening posture. In this way, the sealing of the communication opening 43 is released and the first and second chambers 41, 42 communicate.

The releasing posture is set by the stopper 47 being pressed against the lower surfaces 428B of the locking claws 428. Specifically, in setting the releasing posture, the stopper 47 is pushed down to slip under the locking claws 428. Since the pressing member 5 is rotated against the biasing force of the biasing spring 45 by the pressing piece 464 pressing the receiving slopes 55, the biasing force of the biasing spring 45 is applied to the pressing piece 464. That is, a biasing force acts on the lever member 46 to lift the lever member 46 upward. The stopper 47 is pressed against the lower surfaces 428B of the locking claws 428 by this biasing force and the releasing posture is maintained.

As just described, if the lever member 46 is set in the releasing posture, an inlet for fluid (communication opening 43) and an outlet for fluid (boss hole 42A) for the second chamber 42 are secured. Accordingly, an operation of filling the ink into the second chamber 42 from the first chamber 41 through the communication opening 43 while the air in the second chamber 42 is vented through the boss hole 42A can be smoothly performed utilizing water head difference supply during initial usage. Further, if the amount of air in the second chamber 42 increases such as due to the generation of air bubbles from the ink (can be confirmed in the monitor pipe 36 due to a drop of the ink level in the second chamber 42), the air in the second chamber 42 can be easily vented by performing the ink circulation in the second circulation mode and setting the lever member 46 in the releasing posture.

In this embodiment, the posture of the on-off valve 6 is changed to the opening posture as the lever member 46 is set in the releasing posture, utilizing the pressing member 5 with the pressure receiving portion 5A for receiving a displacement force from the atmospheric pressure detection film 7 and the link bosses 54 for pressing the on-off valve 6 by the displacement force received by the pressure receiving portion 5A. That is, the inlet and outlet for fluid for the second chamber 42 can be secured by a one-touch operation of the lever member 46. Thus, the user can easily perform the air vent operation of the second chamber 42, for example, in the above second circulation mode.

[Backflow Prevention Mechanism]

Figure 19:
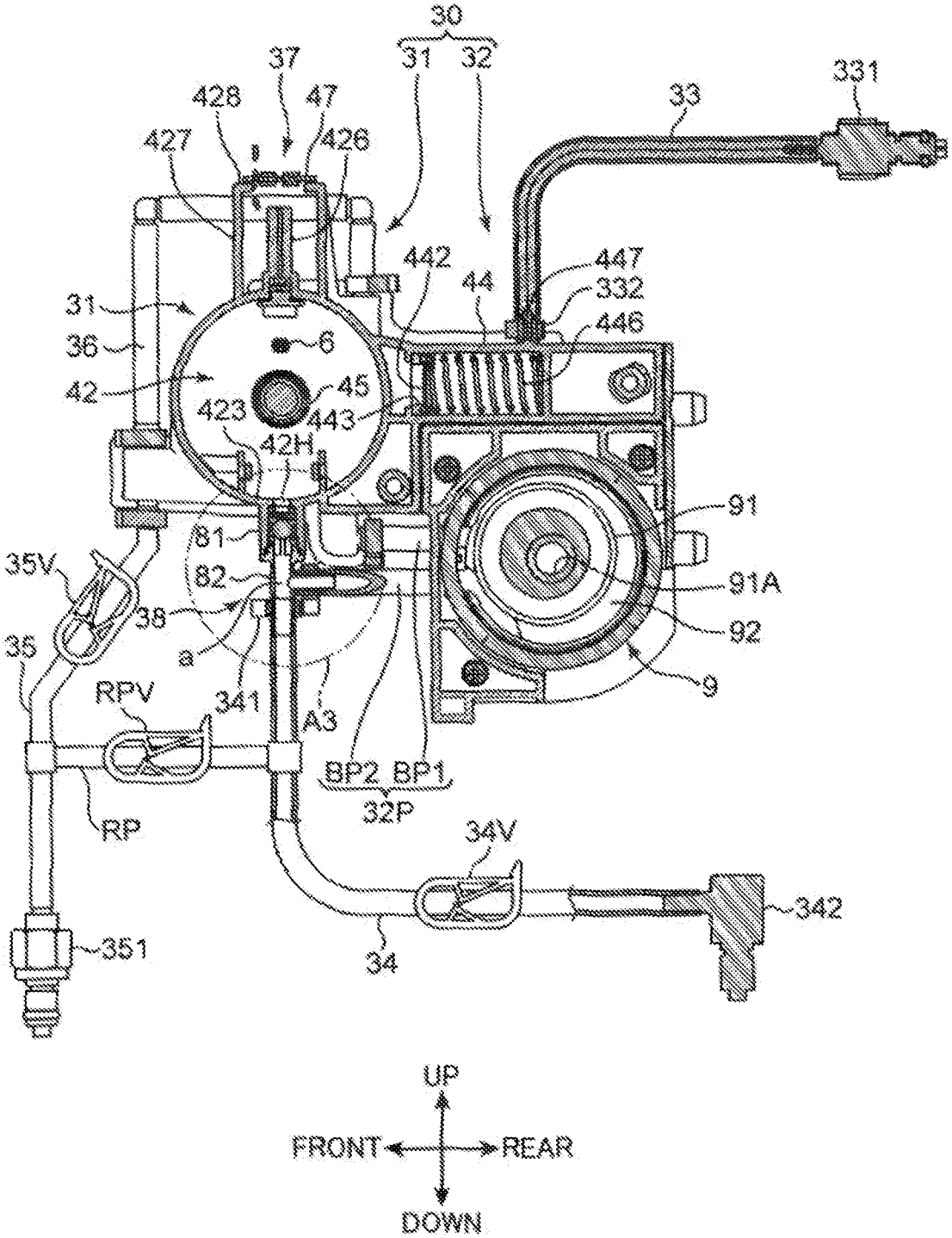
FIG. 19 is a sectional view of the liquid supply unit in the front-rear direction.
Figure 20:
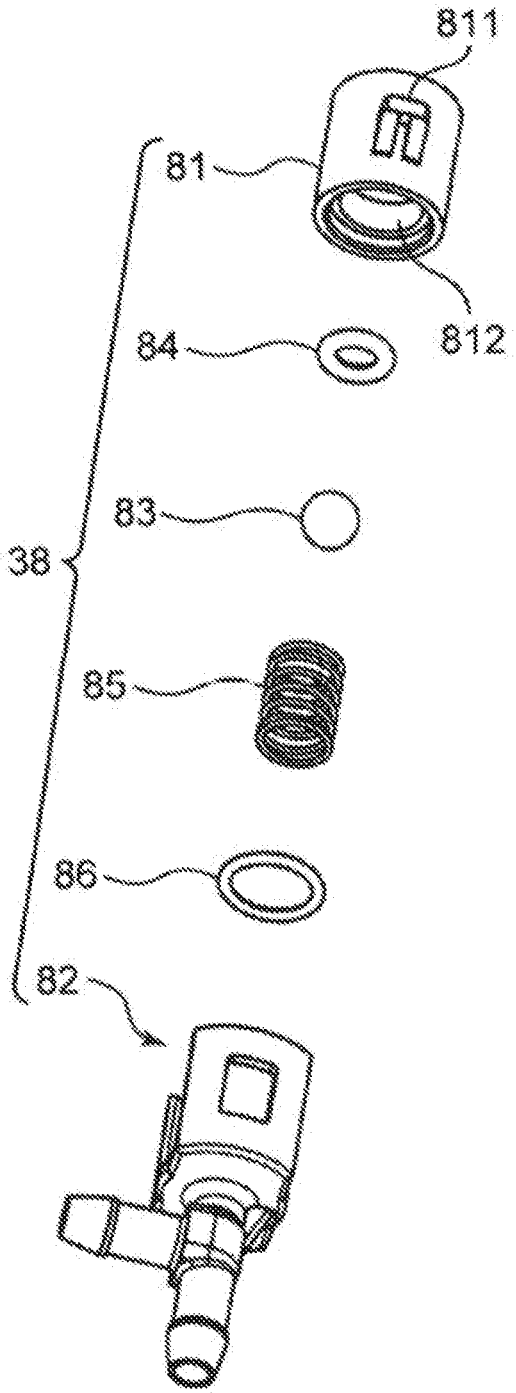
FIG. 20 is an exploded perspective view of a backflow prevention mechanism.
Figure 21C:
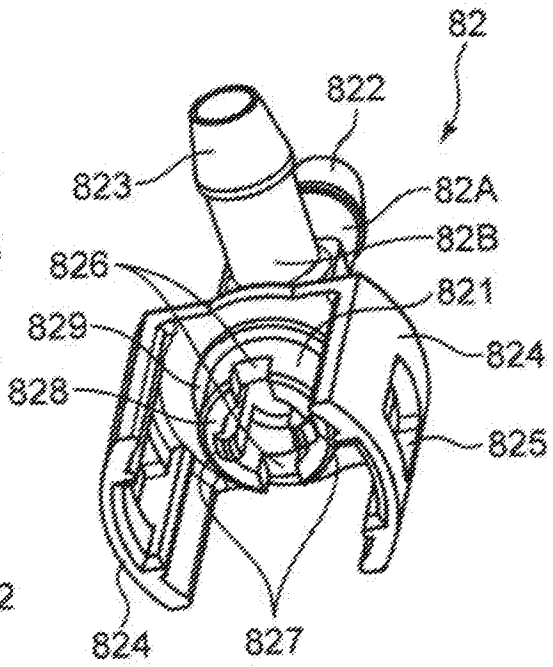
FIG. 21B is a view showing a state where the spherical body closes the valve conduit and FIG. 21C is a perspective view of a branched head portion.
Figure 21B:
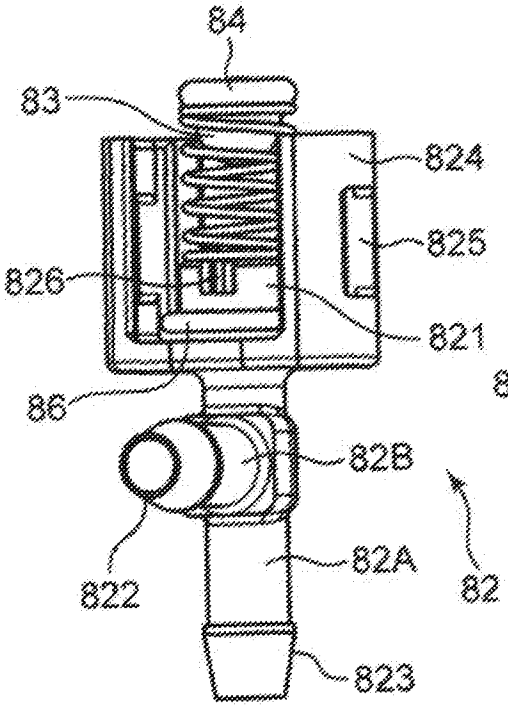
Figure 21A:
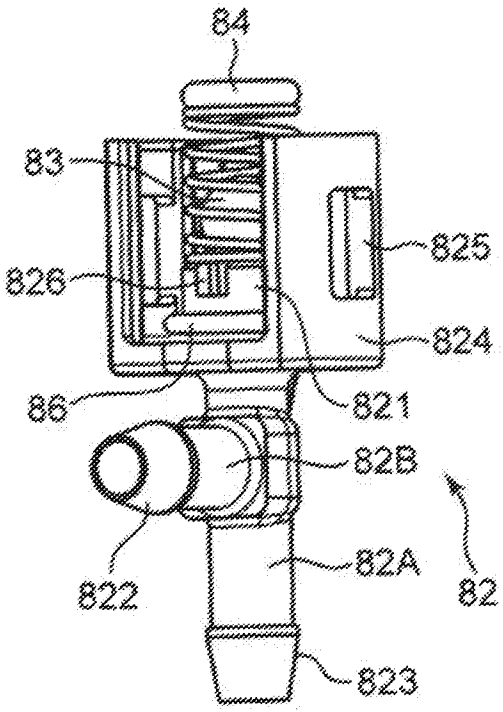
FIG. 21A is a perspective view of the backflow prevention mechanism showing a state where a spherical body opens a valve conduit.
Figure 22B:
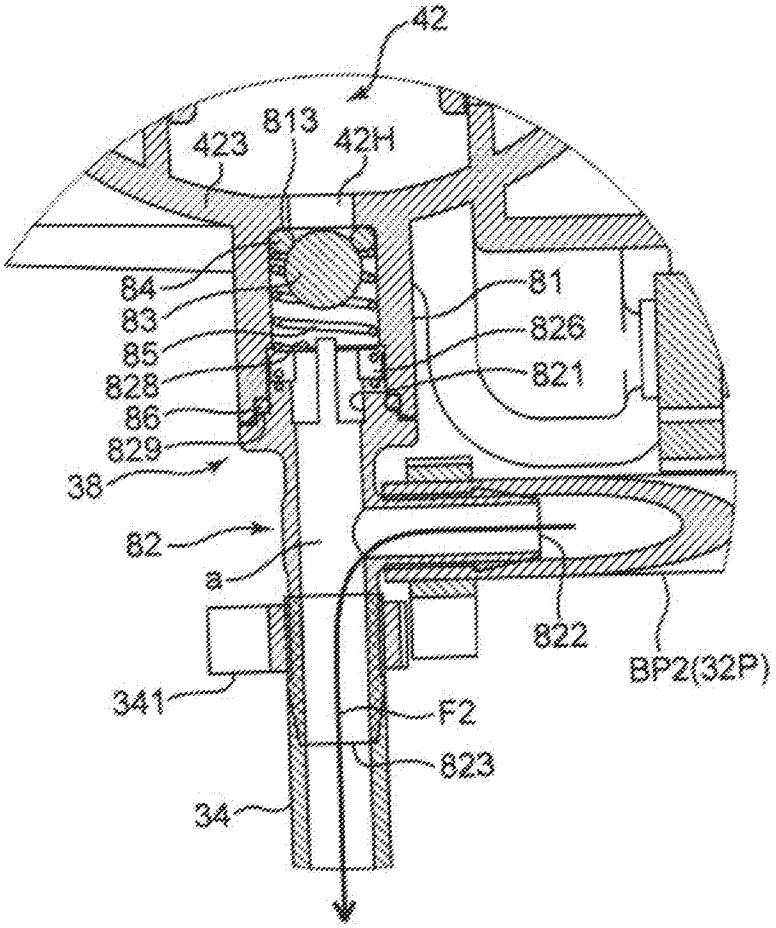
FIG. 22A is a sectional view showing a state of the backflow prevention mechanism in the print mode and FIG. 22B is a sectional view showing a state of the backflow prevention mechanism in the pressurized purge mode.
Figure 22A:
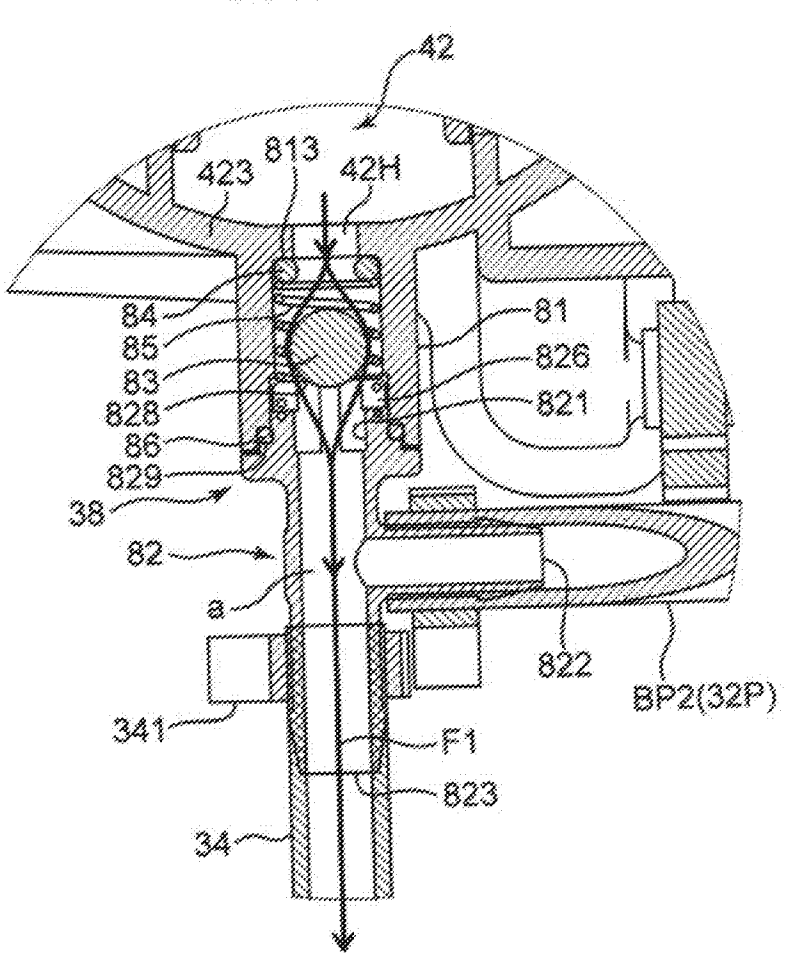

Next, the configuration of the backflow prevention mechanism 38 for preventing a backflow of the ink pressurized by the pump 9 to the second chamber 42 in performing the pressurized purge mode described on the basis of FIG. 6 is described. FIG. 19 is a sectional view of the liquid supply unit 3 in the front-rear direction including a cross-section of the backflow prevention mechanism 38, FIG. 20 is an exploded perspective view of the backflow prevention mechanism 38, and FIGS. 21A to 21C are perspective views of the backflow prevention mechanism 38. FIGS. 22A and 22B are enlarged views of a part A3 of FIG. 19, wherein FIG. 22A is a sectional view showing a state of the backflow prevention mechanism 38 in the print mode and FIG. 22B is a sectional view showing a state of the backflow prevention mechanism 38 in the pressurized purge mode.

The backflow prevention mechanism 38 includes a valve conduit 81, a branched head portion 82, a spherical body 83, a sealing member 84, a coil spring 85 and an O-ring 86. The valve conduit 81 is a member integral with the lower end part 423 of the second chamber 42 and the other components are assembled with the valve conduit 81. FIGS. 21A and 21B are perspective views of the backflow prevention mechanism 38 excluding the valve conduit 81, and FIG. 21C is a perspective view of the branched head portion 82 viewed from below.

The valve conduit 81 is a conduit extending vertically downward from the supply hole 42H perforated in the lower end part 423 of the second chamber 42, and integrated with the second partition wall 421. The valve conduit 81 provides an ink flow passage linking the second chamber 42 and the downstream pipe 34 and constitutes a part of the ink supply passage from the second chamber 42 to the ink ejecting portion 22. To lock the branched head portion 82, locking pieces 811 project on the outer peripheral surface of the valve conduit 81 and a fitting annular projection 812 projects on the inner peripheral surface thereof.

The branched head portion 82 is a member for forming the joint part a described above on the basis of FIGS. 3 to 7. The branched head portion 82 includes a first inlet port 821, a second inlet port 822, an outlet port 823, trunk portions 824, locking windows 825, cutouts 826 and fitting claws 827. The first inlet port 821 is a port connected to the second chamber 42 and, in this embodiment, communicates with the second chamber 42 via the valve conduit 81. The second inlet port 822 is a port connected to the downstream end of the bypass pipe 32P (downstream bypass pipe BP2). The outlet port 823 is a port connected to the upstream end 341 of the downstream pipe 34.

The branched head portion 82 is a T-shaped pipe including a vertical portion 82A extending vertically downward from a lower end side of the valve conduit 81 and a horizontal portion 82B joining an intermediate part of the vertical portion 82A in the horizontal direction. The upper end of the vertical portion 82A is the first inlet port 821, and a lower end side thereof is the outlet port 823. The tip of the horizontal portion 82B is the second inlet port 822. In the aforementioned print mode, the ink is supplied to the downstream pipe 34 through the first inlet port 821. On the other hand, in the pressurized purge mode, the ink is supplied to the downstream pipe 34 through the second inlet port 822.

The trunk portions 824 are composed of a pair of arcuate pieces arranged to face each other on an outer side of the first inlet port 821 facing downward. The valve conduit 81 is inserted into a clearance between the pair of trunk portions 824 and the first inlet port 821. The locking windows 825 are openings which are provided in the pair of trunk portions 824 and with which the locking pieces 811 of the valve conduit 81 are engaged. The cutouts 826 are parts formed by cutting parts of the peripheral wall of the tubular first inlet port 821 and securing the ink flow passage. The fitting claws 827 are hook-shaped parts projecting upward from the upper end of the first inlet port 821, and engaged with the fitting annular projection 812 of the valve conduit 81. That is, the branched head portion 82 is fixed to the valve conduit 81 by the engagement of the locking pieces 811 and the locking windows 825 on the inner periphery of the valve conduit 81 and the engagement of the fitting annular projection 812 and the fitting claws 827 on the outer periphery of the valve conduit 81. An upper end edge 828 of the first inlet port 821 serves as a sphere receiving portion for receiving the spherical body 83 to be described next.

The spherical body 83 is housed into the valve conduit 81 movably in the ink supply direction and works as a valve. An outer diameter of the spherical body 83 is smaller than an inner diameter of the valve conduit 81 and even smaller than an inner diameter of the coil spring 85. Various materials can be used as a material for forming the spherical body 83, but the spherical body 83 is preferably made of a material having a specific weight equal to or less than twice the specific weight of the ink, particularly in a range of 1.1-fold to 1.5-fold of the specific weight of the ink. If a material in this range is used, the specific weight of the spherical body 83 is larger than that of the ink. Thus, the spherical body 83 can easily descend by its own weight in the valve conduit 81, whereas the spherical body 83 can quickly ascend in the valve conduit 81 during pressurized purging since the specific weight of the spherical body 83 is close to that of the ink.

Generally, ink used in an ink jet printer is water-soluble solution and has a specific weight equal to or near 1. Thus, it is desirable to select a material having a specific weight less than 2 as the material of the spherical body 83. Further, the above material desirably has properties such as chemical resistance and wear resistance not to be deteriorated even if the material is constantly in contact with the ink. From these perspectives, it is particularly preferable to use polyacetal (specific weight=1.42), polybutylene terephthalate (specific weight=1.31 to 1.38), polyvinyl chloride (specific weight=1.35 to 1.45) or polyethylene terephthalate (specific weight=1.34 to 1.39) as the material of the spherical body 83.

The sealing member 84 is a ring-shaped sealing component to be seated on a seat portion 813 provided above the spherical body 83 and on an upper end side of the valve conduit 81 as shown in FIGS. 22A and 22B. A ring inner diameter (through hole) of the sealing member 84 is set smaller than the outer diameter of the spherical body 83. When the spherical body 83 is separated downward from this sealing member 84 as shown in FIG. 22A, the valve conduit 81 is opened. On the other hand, when the spherical body 83 contacts the sealing member 84 as shown in FIG. 22B, the valve conduit 81 is closed.

The coil spring 85 is a compression spring mounted in the valve conduit 81 such that an upper end part thereof comes into contact with the sealing member 84 and a lower end part comes into contact with the upper end edge 828 of the first inlet port 821 of the branched head portion 82. The coil spring 85 biases the sealing member 84 toward the seat portion 813, whereby the sealing member 84 is constantly pressed into contact with the seat portion 813. Further, the spherical body 83 is housed inside the coil spring 85 and the coil spring 85 also functions to guide a movement of the spherical body 83 in the ink supply direction. Thus, a loose movement of the spherical body 83 in the valve conduit 81 can be restricted and a valve structure realized by movements of the spherical body 83 toward and away from the sealing member 84 can be stabilized.

The O-ring 86 seals butting parts of the valve conduit 81 and the branched head portion 82. The O-ring 86 is fit on the outer peripheral surface of the first inlet port 821 and in contact with a projecting base portion 829 of the first inlet port 821.

FIG. 19 shows the pump 9 housed in the pump portion 32. The pump 9 is arranged in the bypass pipe 32P and pressurizes the ink flowing in the bypass pipe 32P. The pump 9 can feed the ink from the ink cartridge IC to the head unit 21 through the upstream pipe 33 and the downstream pipe 34. In this embodiment, a tube pump including the eccentric cam 91 and a squeeze tube 92 is illustrated as the pump 9. A rotational drive force is applied to this eccentric cam 91 through unillustrated drive gear and cam shaft. The squeeze tube 92 is arranged on the peripheral surface of the eccentric cam 91 and squeezed by the rotation of the eccentric cam 91 around a cam shaft 93 to feed the liquid (ink) in the tube from one end side toward the other end side. In this embodiment, the squeeze tube 92 is a tube integral with the bypass pipe 32P. Specifically, one end side of the squeeze tube 92 serves as the upstream bypass pipe BP1 communicating with the bypass communication chamber 413 of the first chamber 41, the other end side serves as the downstream bypass pipe BP2 communicating with the second inlet port 822 of the branched head portion 82, and a central part serves as a squeezing portion arranged on the peripheral surface of the eccentric cam 91.

As described above, the pump 9 is stopped in the print mode shown in FIG. 3. In this case, the eccentric cam 91 is stopped while squeezing the squeeze tube 92, wherefore the ink supply passage passing through the bypass pipe 32P is closed. On the other hand, the pump 9 is driven in the forward rotation direction in the first circulation mode shown in FIG. 4, the second circulation mode shown in FIG. 5 and the pressurized purge mode shown in FIG. 6. In FIG. 19, a forward rotation direction of the eccentric cam 91 is a counterclockwise direction. By this forward drive of the pump 9, the ink is sucked from the first chamber 41 through the upstream bypass pipe BP1 and flows toward the backflow prevention mechanism 38, which is the joint part a, from the downstream bypass pipe BP2. Note that if the pump 9 is driven in the reverse rotation direction, the second chamber 42 and the downstream pipe 34 are set to a negative pressure through the bypass pipe 32P and the branched head portion 82 as in the decompression mode shown in FIG. 7.

Next, the operation of the backflow prevention mechanism 38 is described. In the print mode, the ink is supplied to the head unit 21 from the second chamber 42 along a supply route passing through the backflow prevention mechanism 38 and the downstream pipe 34. In such a print mode, the spherical body 83 is separated downward from the sealing member 84 and seated on the upper end edge 828 of the branched head portion 82 as shown in FIG. 22A. This relies on the fact that the specific weight of the spherical body 83 is larger than that of the ink and the spherical body 83 descends by its own weight. Further, it also contributes to the spherical body 83 being kept seated on the upper end edge 828 that, in the print mode, the supply route from the second chamber 42 to the downstream pipe 34 is maintained at the negative pressure and the ink present in the supply route is sucked every time the ink ejecting portion 22 of the head unit 21 discharges ink droplets.

Since the spherical body 83 is separated from the sealing member 84, the supply hole 42H is opened. Further, since the upper end edge 828 of the first inlet port 821 on which the spherical body 83 is seated is provided with the cutouts 826, the ink passage is secured. Thus, the ink in the second chamber 42 can flow toward the downstream pipe 34 from the second chamber 42 through the branched head portion 82 as indicated by an arrow F1 in FIG. 22A.

FIG. 22B is a sectional view showing a state of the backflow prevention mechanism 38 in the pressurized purge mode (and the first and second circulation modes). In the pressurized purge mode, the ink pressurized through the bypass pipe 32P is supplied to the second inlet port 822 (joint part a) of the branched head portion 82 by the forward drive of the pump 9. Thus, the pressurized ink is present inside the bypass pipe 32P and a part of the downstream pipe 34 located downstream of the joint part a. In this case, the ink is pressurized to a high pressure exceeding 100 kPa. If such a high pressure is applied to the second chamber 42, the atmospheric pressure detection film 7 defining a part of the second chamber 42 may be torn or an attached part to the second partition wall 421 may be peeled.

However, in this embodiment, the spherical body 83 is pressed to ascend by a pressure force applied to the joint part a and comes to contact the sealing member 84. Specifically, the spherical body 83 is lifted up by being pressed, and fit into a ring of the sealing member 84. By the contact of the spherical body 83 with the sealing member 84 pressed against the seat portion 813 by the coil spring 85, the supply hole 42H is closed. Specifically, out of the ink supply passage in the print mode, a part located upstream of the joint part a and the second chamber 42 are blocked from pressurization by the pressurized ink. Thus, the breakage of the atmospheric pressure detection film 7 and the like can be prevented.

Further, this embodiment also has an advantage that the ink trapping air is less likely to be supplied to the head unit 21. If air dissolved into the ink and air mixed into the ink when the ink liquid is filled into the liquid supply unit 3 enter the head unit 21 while being trapped in the ink and further enter the individual passages 26 and the common passage 27 (FIG. 2), the air may not be easily vented and may not be eliminated even if pressurized purging is performed. In this case, the ejection of the ink from the ink discharge holes 22H is impeded. However, in this embodiment, the second chamber 42, the backflow prevention mechanism 38 and the downstream pipe 34 are successively arranged from top to down in this order. Thus, air generated from the ink stored in the second chamber 42 or air mixed into the second chamber 42 does not move toward the backflow prevention mechanism 38 and the downstream pipe 34 located below. Therefore, the ink trapping air can be prevented from flowing to the head unit 21 and an ejection failure of the head unit 21 can be prevented.

Further, even if air enters the branched head portion 82 or the downstream pipe 34, the air can be allowed to escape into the second chamber 42 from the vertical portion 82A through the valve conduit 81 and the supply hole 42H by the floating of air bubbles. Note that the above air can be discharged from the second chamber 42 by the air vent mechanism 37. Thus, it can be prevented that an internal volume of the second chamber 42 is excessively occupied by the air.

[Double Protection Mechanism by Umbrella Valve]

As described above, in this embodiment, a backflow of the pressurized ink to the second chamber 42 in the pressurized purge mode is prevented by providing the backflow prevention mechanism 38. However, a pressure force possibly acts on the second chamber 42 due to a certain trouble of the backflow prevention mechanism 38, e.g. an operation failure of the spherical body 83. In view of this point, a double protection mechanism, i.e. a mechanism for causing the on-off valve 6 to release a pressure, is provided in this embodiment. That is, the on-off valve 6 includes a pressure release mechanism for releasing the pressure from the second chamber 42 to the first chamber 41 if a pressure relationship that the second chamber 42 is at a negative pressure and the first chamber 41 is at an atmospheric pressure+ρgh at normal time is reversed and the pressure in the second chamber 42 becomes higher than that in the first chamber 41.

The umbrella valve 66 of the on-off valve 6 functions as the above pressure release mechanism. As described on the basis of FIGS. 14 to 15, the umbrella valve 66 is configured such that the sealing surface 67 comes into contact with the sealing wall surface 43S to seal the communication opening 43 if the second chamber 42 is at a negative pressure below the predetermined threshold value. In this way, the inflow of the ink from the first chamber 41 into the second chamber 42 is prohibited. On the other hand, if the pressure in the second chamber 42 reaches a negative pressure exceeding the predetermined threshold value, the umbrella valve 66 moves leftward together with the valve holder 61 linked to the pressing member 5 and the sealing surface 67 is separated from the sealing wall surface 43S to release the communication opening 43 (release of sealing). In this way, the inflow of the ink from the first chamber 41 to the second chamber 42 is allowed.

In addition to this, the umbrella valve 66 singly releases the communication opening 43 if the pressure relationship of the second chamber 42 and the first chamber 41 is reversed due to a factor such as the application of the pressure of the pressurized ink to the second chamber 42 in the pressurized purge mode. That is, the umbrella valve 66 releases the sealed state of the communication opening 43 and releases the pressure in the second chamber 42 to the first chamber 41 without any assistance of being pressed by the pressing member 5. Specifically, the umbrella shape of the umbrella portion 661 (sealing surface 67) of the umbrella valve 66 is inverted if a predetermined pressure is applied to the right surface side of the umbrella portion 661.

Figures 23A, 23B:
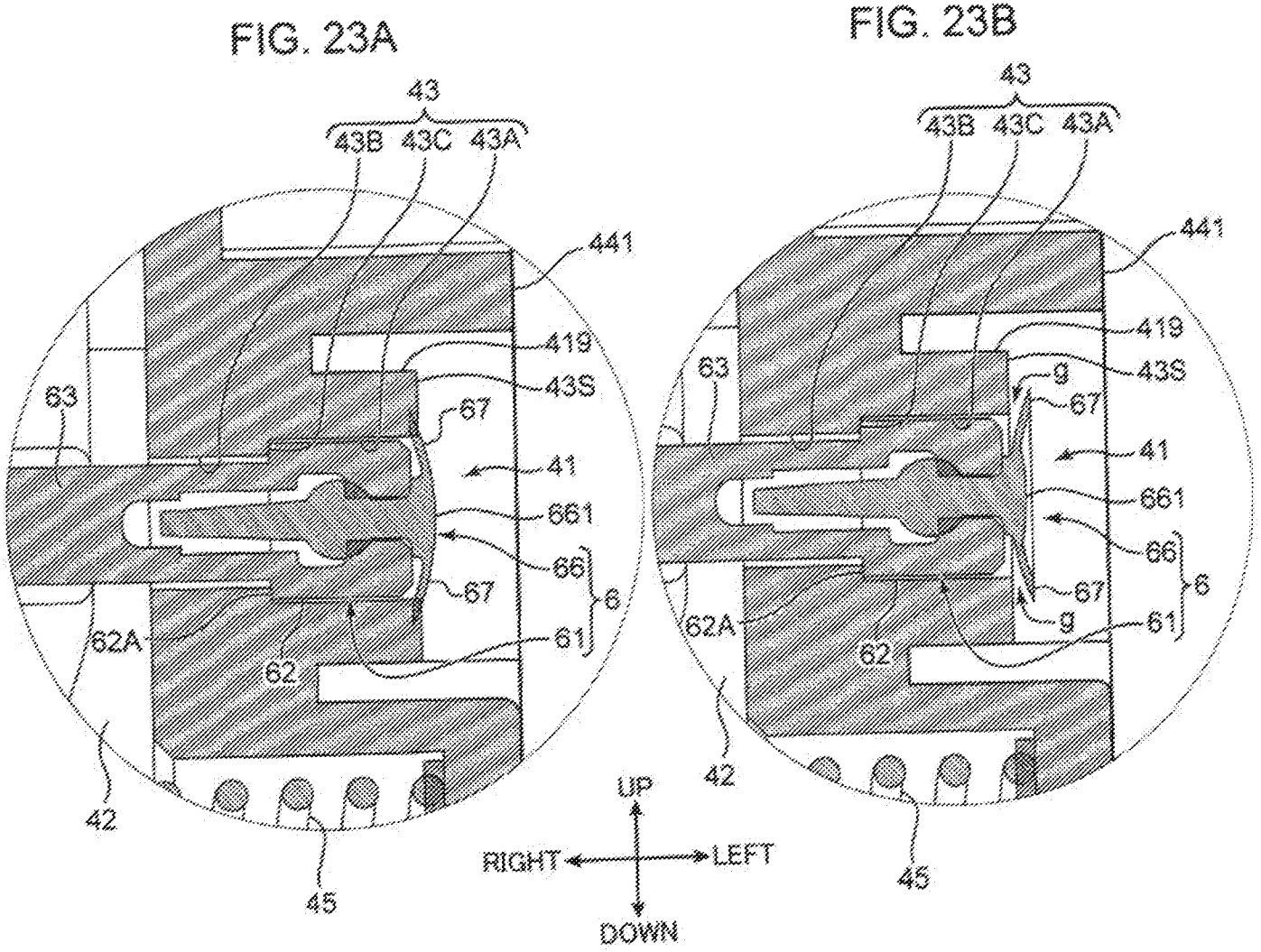
FIG. 23A is a sectional view showing a state where an umbrella valve seals a communication opening and FIG. 23B is a sectional view showing a state where the umbrella valve releases the communication opening.

FIG. 23A is a sectional view showing a state where the umbrella valve 66 seals the communication opening 43 and FIG. 23B is a sectional view showing a state where the umbrella valve 66 releases the communication opening 43. The state of FIG. 23A is equal to the state of FIG. 14B described above. The umbrella portion 661 has an umbrella shape convex leftward. Further, the valve holder 61 is located at a rightmost position by the biasing force of the biasing spring 45 and the annular contact portion 62A thereof is stopped in contact with the step portion 43C of the communication opening 43. Therefore, the sealing surface 67 is in contact with the sealing wall surface 43S.

The state of FIG. 23B shows a state where the umbrella shape of the umbrella portion 661 of the umbrella valve 66 is inverted by a pressure given from the side of the second chamber 42. That is, the umbrella portion 661 is deformed to have an umbrella shape convex rightward. This inverted state is reached when the pressure in the second chamber 42 becomes higher than the pressure in the first chamber 41 by a predetermined value. In this embodiment, a case is assumed in which a high positive pressure by pressurized purging is applied to the second chamber 42 and, as a result, the pressure in the second chamber 42 becomes higher than the pressure in the first chamber 41 having the atmospheric pressure+ρgh. The predetermined value depends on an inversion pressure of the umbrella portion 661. This inversion pressure is set at a value lower than burst strength of the atmospheric pressure detection film 7 or attachment strength of the atmospheric pressure detection film 7 to the second partition wall 421.

If the second chamber 42 is pressurized, the pressing member 5 does not rotate leftward. That is, the pressing member 5 does not generate a pressing force for pressing the on-off valve 6 leftward. This is because the atmospheric pressure detection film 7 is displaced to bulge rightward due to a high pressure in the second chamber 42 and does not give a displacement force to the pressure receiving portion 5A. Therefore, a state where the valve holder 61 is located at the rightmost position is maintained by the biasing force of the biasing spring 45.

However, even if the valve holder 61 does not move, the sealing surface 67 is separated from the sealing wall surface 43S and a gap g is formed between the both due to the inversion of the umbrella shape of the umbrella portion 661. Thus, the communication opening 43 is released. In this way, the pressurized ink (pressure) in the second chamber 42 is allowed to escape (released) toward the first chamber 41 through the communication opening 43. Therefore, it can be prevented that an excessive force acts on the atmospheric pressure detection film 7 itself or the attached part of the atmospheric pressure detection film 7, whereby the breakage of the atmospheric pressure detection film 7 can be prevented.

[Control Examples of Liquid Ejection Device]

Figure 24:
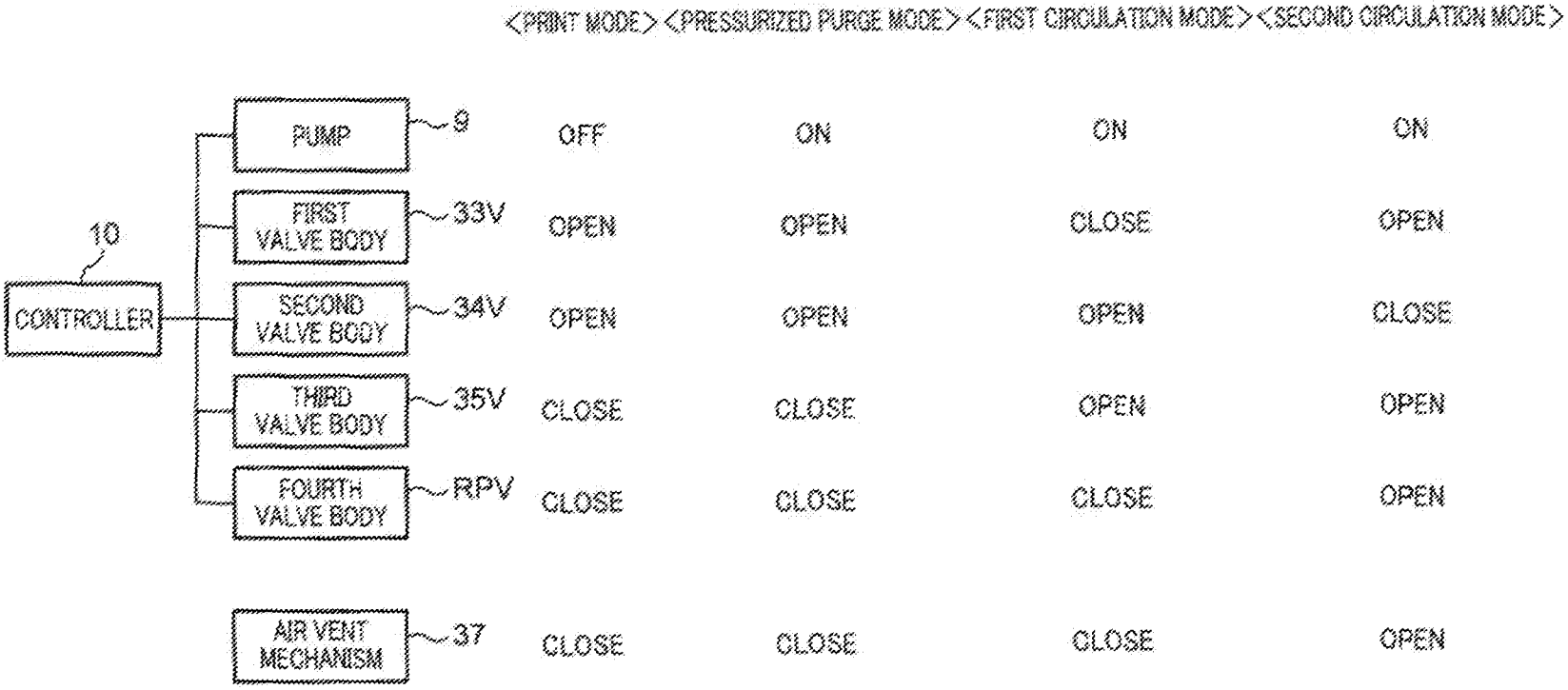
FIG. 24 is a block diagram showing an electrical configuration of the liquid ejection device.

FIG. 24 is a block diagram showing an electrical configuration of the liquid ejection device 1. The liquid ejection device 1 includes a controller 10 for integrally controlling the operation of this liquid ejection device 1. The controller 10 controls to drive (ON) and stop (OFF) the pump 9 and controls to open and close the first, second, third and fourth valve bodies 33V, 34V, 35V and RPV, which are, for example, constituted by electromagnetic valves.

The controller 10 operates the liquid ejection device 1 at least in the print mode, the pressurized purge mode, the first circulation mode and the second circulation mode. As described above, the print mode is a mode for applying the printing process to a predetermined work by causing the ink to be ejected from the ink ejecting portion 22 of the head unit 2. The pressurized purge mode is a mode for supplying the high-pressure ink to the ink ejecting portion 22 and causing the ink ejecting portion 22 to discharge the ink to remove or prevent ink clogging in the ink ejecting portion 22. The first circulation mode is a mode for circulating the ink between the head unit 21 and the liquid supply unit 3 and recovering the air on the side of the head unit 21 to the side of the liquid supply unit 3. The second circulation mode is a mode for circulating the ink using the short-circuit pipe RP to vent the air staying in the second chamber 42.

FIG. 24 shows an "ON" or "OFF" state of the pump 9 and the "open" or "closed" state of the first, second, third and fourth valve bodies 33V, 34V, 35V and RPV in each mode. A flow of the ink in each mode is described below. FIGS. 25, 26, 27 and 28 are perspective views respectively showing the flow of the ink in the print mode (ejection control), in the pressurized purge mode, in the first circulation mode (first circulation control) and in the second circulation mode (second circulation control).

<Print Mode>

In the print mode (FIG. 25), since the ink is supplied by the water head difference, the controller 10 sets the pump 9 in an non-operation state (OFF). Further, since the ink is not circulated using the return pipe 35 and the short-circuit pipe RP, the controller 10 sets the third and fourth valve bodies 35V, RPV in the "closed" state while setting the first valve body 33V (FIG. 3) and the second valve body 34V in the "open" state. Of course, the air vent mechanism 37 is set in the "closed" state and the second chamber 42 is separated from the atmosphere.

Figure 25:
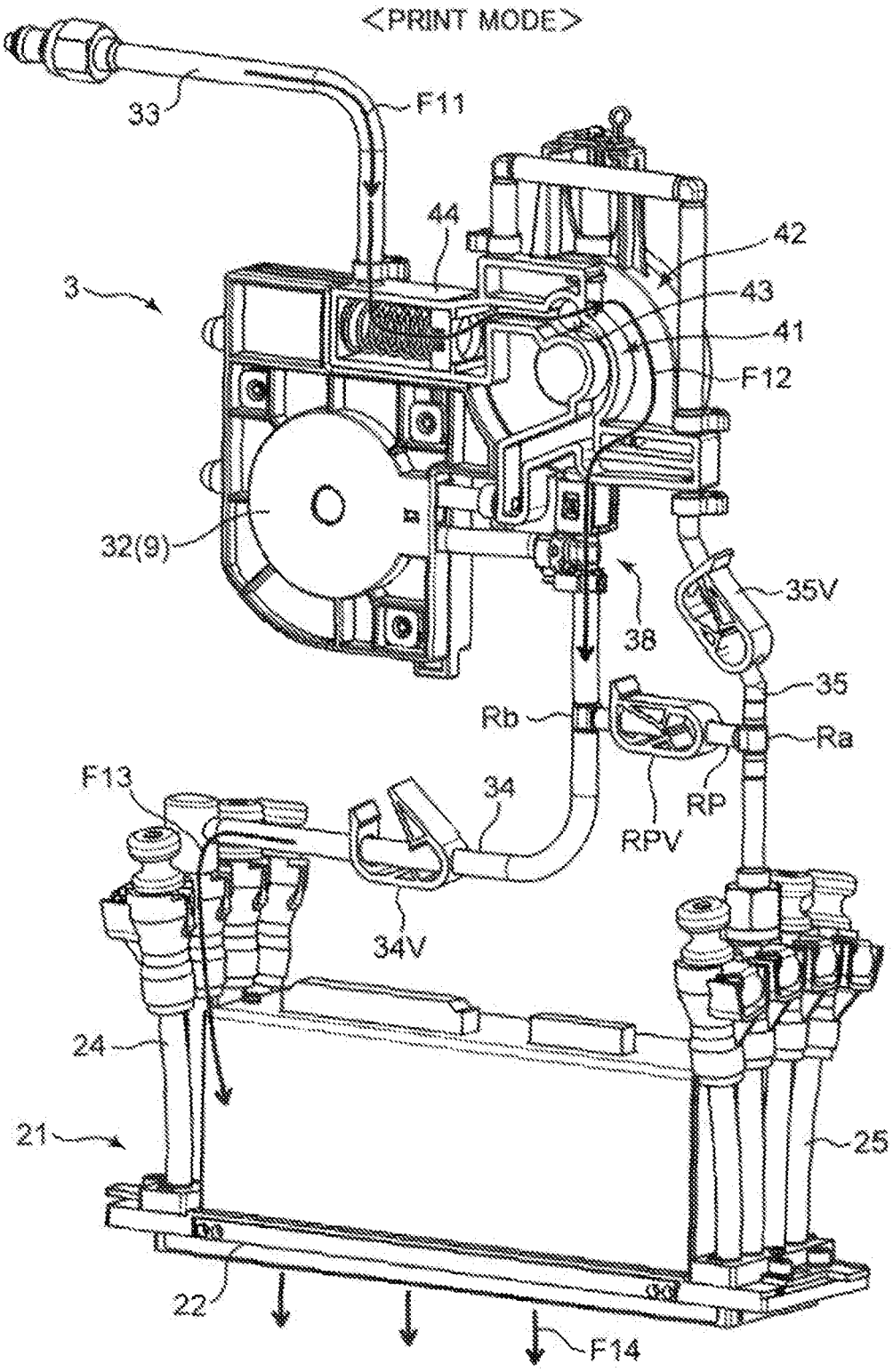
FIG. 25 is a perspective view showing a flow of the ink in the print mode.
Figure 26:
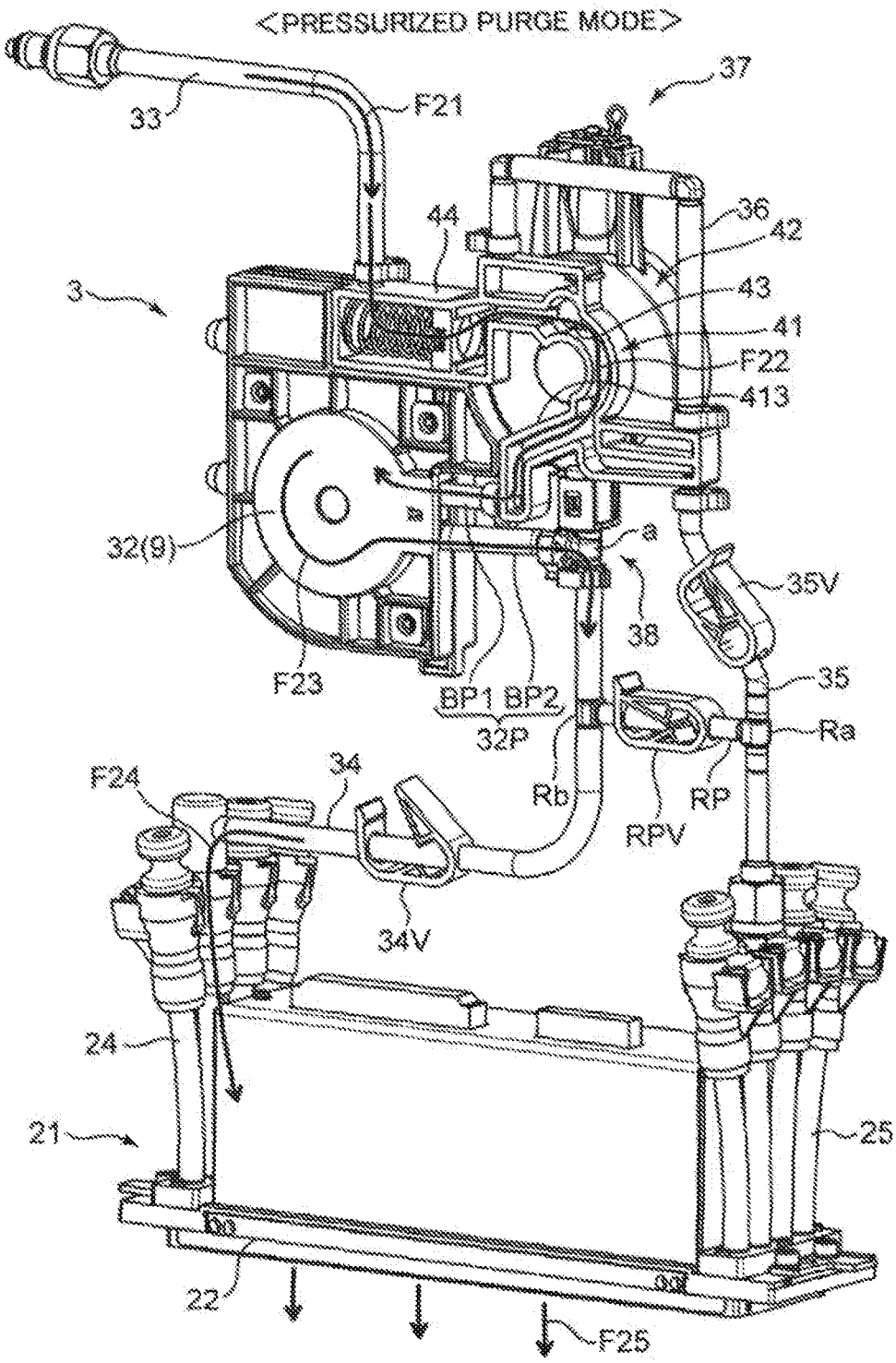
FIG. 26 is a perspective view showing a flow of the ink in the pressurized purge mode.
Figure 27:
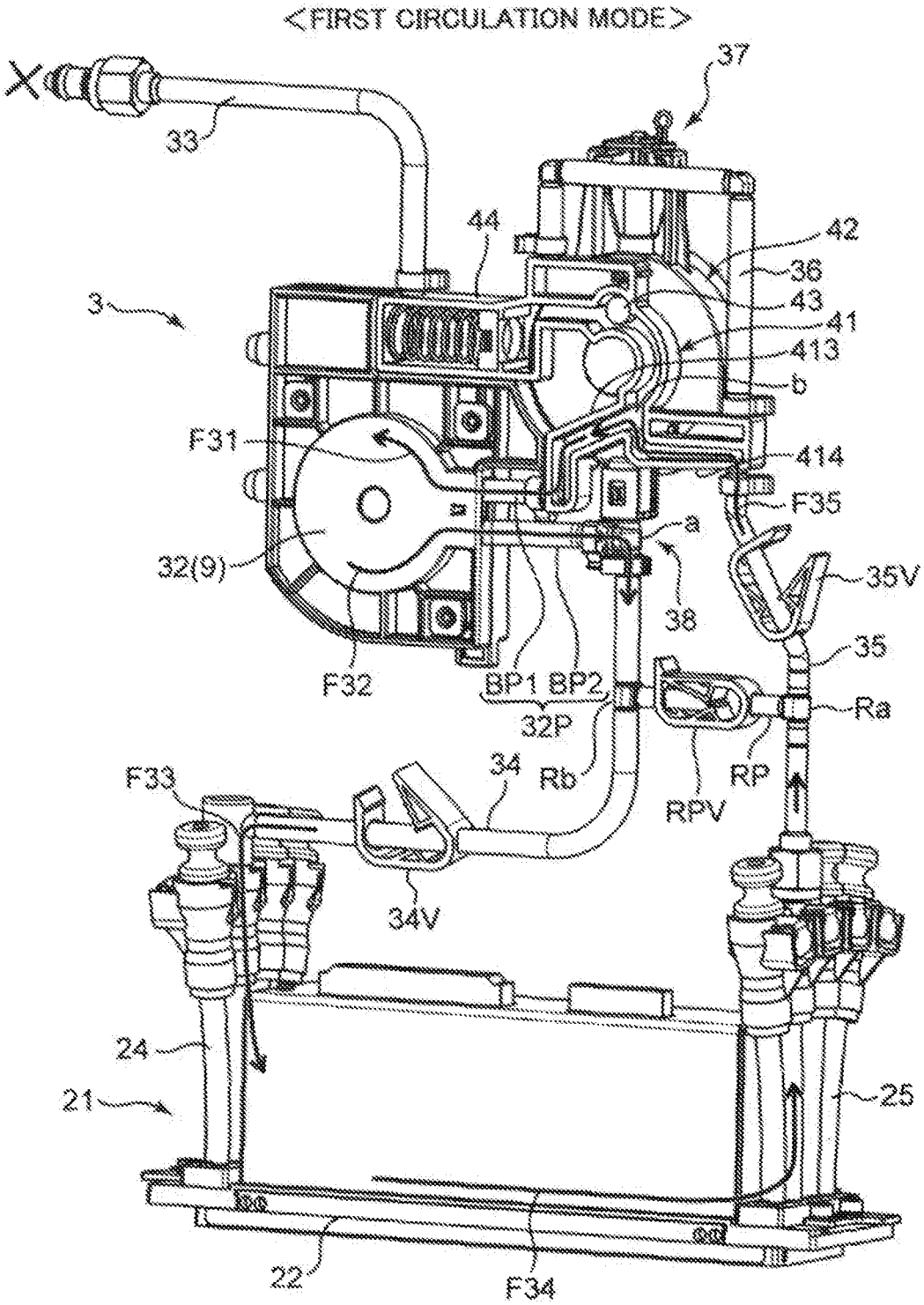
FIG. 27 is a perspective view showing a flow of the ink in the first circulation mode.
Figure 28:
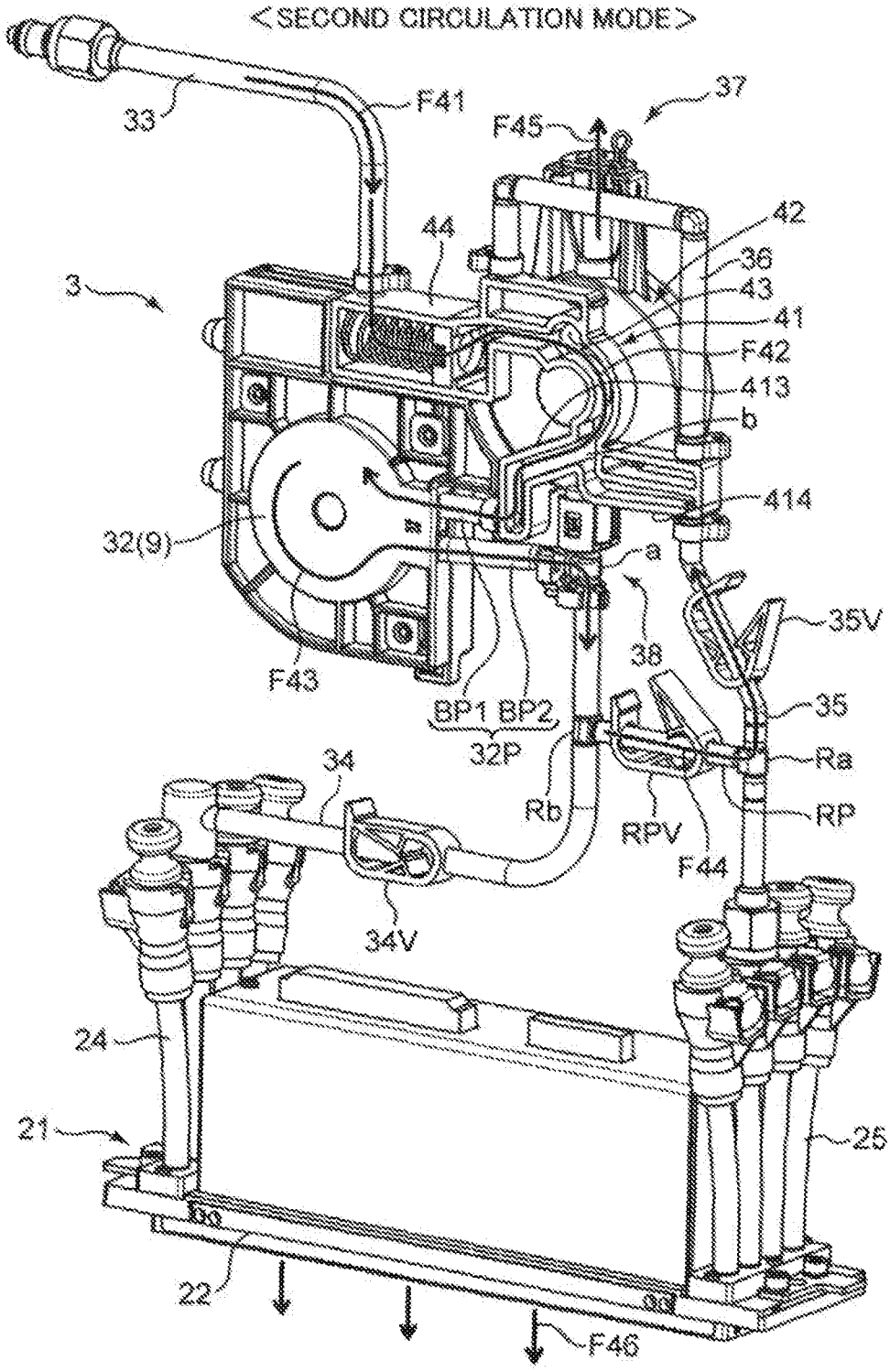
FIG. 28 is a perspective view showing a flow of the ink in the second circulation mode.

As indicated by an arrow F11 of FIG. 25, the ink discharged from the ink cartridge IC enters the filter chamber 44 through the upstream pipe 33 by the water head difference. Solid foreign substances contained in the ink are removed when passing through the filter member 442 (FIG. 9) in this filter chamber 44. Thereafter, the ink enters the first chamber 41.

If the on-off valve 6 is opened by the operation of the aforementioned negative pressure supply mechanism, directly by the operation of the pressing member 5, the ink is stored into the second chamber 42 from the first chamber 41 through the communication opening 43 as indicated by an arrow F12. The ink in the second chamber 42 is sucked and enters the downstream pipe 34 through the backflow prevention mechanism 38 by the ink discharging operation in the ink ejecting portion 22. Thereafter, the ink enters the common passage 27 (FIG. 2) of the head unit 21 by way of the end tube 24 as indicated by an arrow F13. Then, the ink is ejected from the respective ink discharge hole 22H through the individual passages 26 (arrows F14).

<Pressurized Purge Mode>

In the pressurized purge mode (FIG. 26), the pump 9 is set in a drive state (ON) since the ink is forcibly fed to the downstream pipe 34. As in the print mode, since the ink is not circulated using the return pipe 35 and the short-circuit pipe RP, the controller 10 sets the third and fourth valve bodies 35V, RPV in the "closed" state while setting the first and second valve bodies 33V, 34V in the "open" state. The air vent mechanism 37 is also set in the "closed" state.

In this pressurized purge mode, the pump 9 is operated in the forward rotation direction, and the ink is forcibly supplied to the head unit 21 without depending on the water head difference. If the pump 9 is operated, the ink in the first chamber 41 is consumed. Thus, the ink is discharged from the ink cartridge IC. As indicated by an arrow F21, the ink enters the filter chamber 44 through the upstream pipe 33 and further enters the first chamber 41. Then, as indicated by an arrow F22, the ink enters the upstream bypass pipe BP1 by way of the bypass communication chamber 413 without flowing toward the second chamber 42.

The ink is pressurized by the squeezing operation of the pump 9 and fed toward the downstream side. Specifically, as indicated by an arrow F23, the ink is fed from the downstream bypass pipe BP2 to the downstream pipe 34. As described above, since the backflow prevention mechanism 38 is provided in the joint part a of the downstream bypass pipe BP2 to the downstream pipe 34, the ink does not flow back toward the second chamber 42. Thereafter, as indicated by an arrow F24, the ink enters the common passage 27 (FIG. 2) of the head unit 21 by way of the end tube 24. Then, the ink is discharged at a high pressure from the respective ink discharge holes 22H through the individual passages 26 (arrow F25). In this way, foreign substances causing clogging in the ink ejecting portion 22, the air staying in the individual passages 26 and the like are removed.

<First Circulation Mode>

In the first circulation mode (FIG. 27), the controller 10 sets the pump 9 in a forward drive state (ON) since the ink is forcibly fed to the downstream pipe 34. Further, since the ink is circulated using the downstream pipe 34 and the return pipe 35, the controller 10 sets the fourth valve body RPV in the "closed" state to close the short-circuit pipe RP while setting the second and third valve bodies 34V, 35V in the "open" state. Further, since the ink is circulated between the liquid supply unit 3 and the head unit 21, the first valve body 33V is also set in the "closed" state. In this way, a closed ink circulation path composed of the bypass pipe 32P, the downstream pipe 34, the common passage 27 of the head unit 21, the return pipe 35 and the return communication chamber 414 and the bypass communication chamber 413 is formed. The air vent mechanism 37 is kept in the "closed" state.

If the pump 9 is operated, the circulation of the ink in the above ink circulation path is started. Specifically, by the operation of the pump 9, the ink is sucked into the upstream bypass pipe BP1 from the bypass communication chamber 413 as indicated by an arrow F31 and, subsequently, fed to the downstream bypass pipe BP2 as indicated by an arrow F32. Thereafter, the ink flows into the head unit 21 (arrow F33) by way of the joint part a, the downstream pipe 34 and the end tube 24, passes through the common passage 27 in the head unit 21 and enters the recovery tube 25 (arrow F34). Then, as indicated by an arrow F35, the ink returns from the recovery tube 25 to the bypass communication chamber 413 successively by way of the return pipe 35, the return communication chamber 414 and the joint part b. At this time, since the first valve body 33V is closed, the return pipe 35 and the common passage 27, from which the ink is sucked by the pump 9, are set to a negative pressure. Therefore, the ink does not leak from the ink discharge holes 22H during ink circulation.

If the first circulation mode is performed, the ink can be circulated in the ink circulation path as described above. In other words, the ink temporarily fed toward the head unit 21 can be returned toward the liquid supply unit 3 using the return pipe 35. Thus, even if air enters the head unit 21 such as due to the feed of the ink containing air, the air can be recovered into the liquid supply unit 3 together with the ink by the above circulation. The air (air bubbles) recovered into the liquid supply unit 3 enters the first chamber 41 located above from the return communication chamber 414 by buoyancy and stays near the communication opening 43 arranged near an uppermost part of the first chamber 41.

<Second Circulation Mode>

Also in the second circulation mode (FIG. 28), the controller 10 sets the pump 9 in the forward drive state (ON) since the ink is forcibly fed to the downstream pipe 34. Further, since the ink is circulated using the short-circuit pipe RP and a part of the return pipe 35 downstream of the first T-branch portion Ra, the controller 10 sets the second valve body 34V in the "closed" state to close the part of the downstream pipe 34 downstream of the first T-branch portion Ra while setting the third and fourth valve bodies 35V, RPV in the "open" state. Further, the first valve body 33V is set in the "open" state to expel the air from the second chamber 42 by filling the ink, and the ink can be supplied from the ink cartridge IC. The air vent mechanism 37 is set in the "open" state to set the second chamber 42 at a constant pressure.

By the above valve operation, an ink circulation path composed of the bypass pipe 32P, a part of the downstream pipe 34 upstream of the second T-branch portion Rb, the short-circuit pipe RP, the part of the return pipe 35 downstream of the first T-branch portion Ra, the return communication chamber 414 and the bypass communication chamber 413 is formed. The ink can flow into the first chamber 41 from the ink cartridge IC. Thus, if the pump 9 is operated, the ink is sucked into the first chamber 41 as indicated by an arrow F41 and flows into the upstream bypass pipe BP1 from the bypass communication chamber 413 (arrow F42). Subsequently, the ink is fed from the downstream bypass pipe BP2 to the downstream pipe 34 as indicated by an arrow F43. Then, the ink enters the short-circuit pipe RP from the second T-branch portion Rb, enters the return pipe 35 from the first T-branch portion Ra and returns to the bypass communication chamber 413 successively by way of the return communication chamber 414 and the joint part b as indicated by an arrow F44.

In the second circulation mode, the air vent mechanism 37 is set in the "open" state. That is, as shown in FIG. 18B, the lever member 46 is pushed down to forcibly operate the pressing member 5, the on-off valve 6 moves to reach the opening posture, and the first and second chambers 41, 42 communicate through the communication opening 43. By the operation of the pump 9, the ink is circulated by way of the short-circuit pipe RP while being supplied to the first chamber 41 from the ink cartridge IC. By this operation, the first chamber 41 is gradually filled with the ink and the air recovered into the first chamber 41 in the first circulation mode and the ink flow into the second chamber 42 through the communication opening 43. Eventually, the second chamber 42 is gradually filled with the ink by the above inflow, the recovered air is driven upwardly of the second chamber 42 and expelled to outside through the air vent mechanism 37 in the released state. That is, the air having entered the head unit 21 and the liquid supply unit 3 can be easily and reliably discharged without being accompanied by the removal of the supply passage.

As described above, the air can be prevented from staying near the individual passages 26 and the ink discharge holes 22H of the head unit 21 by the execution of the first and the second circulation modes. The air having entered the head unit 21 can be removed also by the pressurized purge mode. However, the air once having entered the head unit 21 is not easily vented and pressurized purging of discharging a considerable amount of the ink needs to be performed. Thus, there is a problem that a large amount of the ink is consumed only to vent air from the head unit 21. However, according to the first and second circulation modes, since air is recovered into the liquid supply unit 3 by circulating the ink, the ink is not consumed. Further, in the first and second circulation modes, it is sufficient to circulate the ink in the ink circulation path and the ink needs not be pressurized unlike in the pressurized purge mode. Thus, it is sufficient to operate the pump 9 at a low speed. Therefore, the application of a large pressure load to the liquid supply unit 3 can be avoided and the breakage of the atmospheric pressure detection film 7 and the sealing film 7A can be prevented.

Besides, the controller 10 performs a liquid extraction mode for discharging the preservation solution stored in the head unit 21 during initial usage. In this liquid extraction mode, the second and fourth valve bodies 34V, RPV are set in the "open" state to circulate the ink using the downstream pipe 34 and the short-circuit pipe RP. Since the preservation solution in the head unit 21 is pushed out by the ink, the first valve body 33V is also set in the "open" state. On the other hand, the third valve body 35V is set in the "closed" state. In this state, the pump 9 is operated and the ink is supplied to the head unit 21 in two routes of the downstream pipe 34 and the short-circuit pipe RP to successively push out the preservation solution in the head unit 21.

[Modifications]

Although the embodiments of the present disclosure have been described above, the present disclosure is not limited to these and various modifications can be employed. For example, in the above embodiments, the liquid supply unit 3 according to the present disclosure is illustrated to supply the ink to the head unit 21 of the ink jet printer. The liquid stored in and supplied by the liquid supply unit 3 is not limited to the ink, and various liquids can be used. For example, water, various types of solutions, chemicals, industrial chemical liquids and the like can be stored in and supplied by the liquid supply unit 3.

According to the present disclosure described above, it is possible to provide a liquid ejection device capable of easily and reliably venting air in a liquid supply unit.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A liquid ejection device, comprising:

a liquid ejection head configured to eject liquid; and a liquid supply unit configured to supply the liquid from a liquid storage container storing the liquid to the liquid ejection head;

wherein:

the liquid ejection head includes a plurality of liquid discharge holes, individual passages configured to individually supply the liquid to the respective liquid discharge holes, and a common passage configured to supply the liquid to the individual passages, the liquid supply unit includes:

a pressure chamber capable of storing the liquid;

an exhaust valve configured to release or close the pressure chamber to or from outside air;

a liquid passage including a first supply passage allowing communication between the liquid storage container and the pressure chamber, a second supply passage allowing communication between an upstream side of the common passage and the pressure chamber, a return passage allowing communication between a downstream side of the common passage and the pressure chamber, and a short-circuit passage configured to short-circuit the second supply passage and the return passage, one end of the short-circuit passage being connected to the return passage to form a first branch portion and the other end being connected to the second supply passage to form a second branch portion;

valve bodies including a first valve body configured to open and close the first supply passage, a second valve body configured to open and close the second supply passage on a side closer to the common passage than the second branch portion, a third valve body configured to open and close the return passage on a side closer to the pressure chamber than the first branch portion and a fourth valve body configured to open and close the short-circuit passage;

a pump mechanism capable of feeding the liquid to the second supply passage; and a controller configured to control operations of the valve bodies and the pump mechanism, and the controller executes:

an ejection control for supplying the liquid from the pressure chamber to the liquid ejection head through the second supply passage by closing the third and fourth valve bodies while opening the first and second valve bodies, and setting the pump mechanism in a non-operative state with the exhaust valve closed;

a first circulation control for circulating the liquid through the second supply passage, the common passage and the return passage by opening the second and third valve bodies while closing the first and fourth valve bodies, and operating the pump mechanism with the exhaust valve closed; and a second circulation control for circulating the liquid through the second supply passage, the short-circuit passage and the return passage by closing the second valve body while opening the first, third and fourth valve bodies, and operating the pump mechanism with the exhaust valve opened.

2. A liquid ejection device according to claim 1, wherein:

the liquid supply unit further includes a bypass passage having an upstream end in a liquid supply direction connected to the first supply passage and a downstream end joining the second supply passage on a side closer to the pressure chamber than the second branch portion, and the pump mechanism is arranged in the bypass passage.

3. A liquid ejection device according to claim 1, wherein:

the liquid supply unit further includes:

an upstream chamber constituting a part of the first supply passage and arranged upstream of the pressure chamber in a liquid supply direction;

a wall member with a communication opening allowing communication between the upstream chamber and the pressure chamber;

an opening/closing member arranged in the communication opening and configured to change a posture between a closing posture for closing the communication opening and an opening posture for opening the communication opening;

a biasing member configured to bias the opening/closing member in a direction toward the closing posture; and a pressing member capable of pressing the opening/closing member in a direction toward the opening posture;

a part of the wall member defining the pressure chamber is formed by a flexible film member;

the flexible film member is a member configured to transmit a displacement force thereof to the pressing member by being displaced based on a negative pressure generated as the liquid in the pressure chamber decreases; and the pressing member includes:

a pressure receiving portion configured to receive the displacement force from the flexible film member; and a pressing portion configured to press the opening/closing member biased by the biasing member by the displacement force received by the pressure receiving portion.

4. A liquid ejection device according to claim 3, wherein:

the exhaust valve includes an operating member configured to change a posture between an exhausting posture for setting the released state by opening an opening provided in a partition wall defining the pressure chamber and a sealing posture for setting the closed state by sealing the opening, and the operating member allows the opening/closing member to be set in the closing posture in the sealing posture and causes the pressing member to perform the pressing to change the posture of the opening/closing member from the closing posture to the opening posture in the exhausting posture.

5. A liquid ejection device according to claim 4, wherein:

the pressing member includes a pivot and a flat plate portion configured to swing about the pivot, the operating member includes an input portion configured to receive an operating pressing force and a transmitting portion configured to transmit the operating pressing force, the flat plate portion includes a pressure receiving portion configured to receive a displacement force from the flexible film member, the pressing portion configured to press the opening/closing member by the displacement force received by the pressure receiving portion and an operated portion configured to receive the operating pressing force from the transmitting portion of the operating member, the flat plate portion rotates about the pivot when the pressure receiving portion receives the displacement force and the pressing portion presses the opening/closing member biased by the biasing member by the rotation of the flat plate portion, and the flat plate portion rotates about the pivot when the operated portion receives the operating pressing force and the pressing portion presses the opening/closing member biased by the biasing member by the rotation of the flat plate portion.

6. A liquid ejection device according to claim 1, wherein:

the liquid storage container is arranged above the liquid ejection head, the liquid supply unit is arranged between the liquid storage container and the liquid ejection head and the liquid is supplied to the liquid ejection head by a water head difference, the pressure chamber is set to a negative pressure during the ejection control and the first circulation control, and the flexible film member generates a pressing force exceeding a biasing force of the biasing member when a pressure in the pressure chamber reaches a negative pressure exceeding a predetermined threshold value as the liquid in the pressure chamber decreases.

7. A liquid ejection device, comprising:

a liquid ejection head configured to eject liquid; and a liquid supply unit configured to supply the liquid from a liquid storage container storing the liquid to the liquid ejection head;

wherein:

the liquid ejection head includes a plurality of liquid discharge holes, individual passages configured to individually supply the liquid to the respective liquid discharge holes, and a common passage configured to supply the liquid to the individual passages, the liquid supply unit includes:

a pressure chamber capable of storing the liquid;

an exhaust valve configured to release or close the pressure chamber to or from outside air;

a liquid passage including a first supply passage allowing communication between the liquid storage container and the pressure chamber, a second supply passage allowing communication between an upstream side of the common passage and the pressure chamber, a return passage allowing communication between a downstream side of the common passage and the pressure chamber, and a short-circuit passage configured to short-circuit the second supply passage and the return passage, one end of the short-circuit passage being connected to the return passage to form a first branch portion and the other end being connected to the second supply passage to form a second branch portion;

valve bodies including a first valve body configured to open and close the first supply passage, a second valve body configured to open and close the second supply passage on a side closer to the common passage than the second branch portion, a third valve body configured to open and close the return passage on a side closer to the liquid ejection head than the first branch portion and a fourth valve body configured to open and close the short-circuit passage;

a pump mechanism capable of feeding the liquid to the second supply passage; and a controller configured to control operations of the valve bodies and the pump mechanism, and the controller executes:

an ejection control for supplying the liquid from the pressure chamber to the liquid ejection head through the second supply passage by closing the third valve body while opening the first and second valve bodies, and setting the pump mechanism in a non-operative state with the exhaust valve closed;

a first circulation control for circulating the liquid through the second supply passage, the common passage and the return passage by opening the second and third valve bodies while closing the first and fourth valve bodies, and operating the pump mechanism with the exhaust valve closed; and a second circulation control for circulating the liquid through the second supply passage, the short-circuit passage and the return passage by closing the second valve body while opening the first and fourth valve bodies, and operating the pump mechanism with the exhaust valve opened.

* * * * *